United States Patent [19]

Braham

[11] 4,235,342

[45] Nov. 25, 1980

[54] SORTING APPARATUS USING PROGRAMMABLE CLASSIFIER

[75] Inventor: Richard R. M. Braham, Houston, Tex.

[73] Assignee: Geosource Inc., Houston, Tex.

[21] Appl. No.: 903,069

[22] Filed: May 5, 1978

[51] Int. Cl.[3] ..... B07C 5/344

[52] U.S. Cl. ..... 209/564; 209/581; 209/582; 250/226; 356/407

[58] Field of Search ..... 209/552, 559, 563, 564, 209/576, 577, 580, 581, 582, 587; 250/226; 356/410, 407

[56] References Cited

U.S. PATENT DOCUMENTS

| | | | |
|---|---|---|---|
| 4,134,498 | 1/1979 | Jones et al. | 209/564 |
| 4,143,770 | 3/1979 | Grimmell et al. | 209/564 X |

*Primary Examiner*—Joseph J. Rolla

*Attorney, Agent, or Firm*—Arnold, White & Durkee

[57] ABSTRACT

A sorting apparatus for performing an article sort based upon the intensity of light energy reflected from the article at predetermined first and second color wavelengths is characterized by an addressable memory element having a plurality of memory storage locations therein, each memory location being addressable by a different combination of the reflected light intensities at the first and second color wavelengths. Each memory location has stored therein a classification signal representative of the acceptability of an article exhibiting the reflected light intensities at the first and second color wavelengths corresponding to the address of the storage location.

13 Claims, 47 Drawing Figures

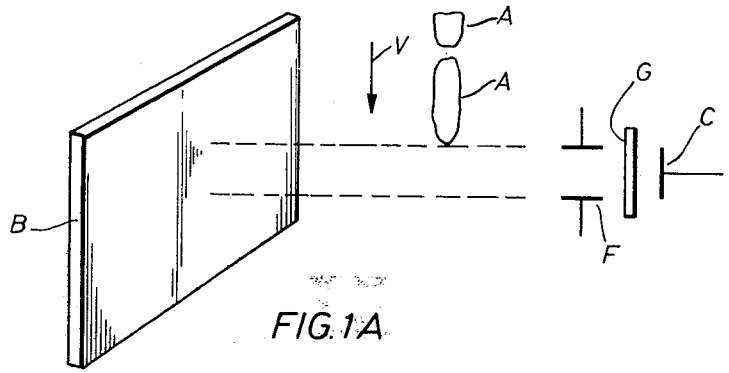
FIG. 1A
FIG. 2
← ARTICLE REFLECTIVITY →
| BACKROUND REFLECTIVITY → / % FRAME FILL ↓ | 0% | | 25% | | 50% | | 75% | | 100% | |
|---|---|---|---|---|---|---|---|---|---|---|
| | 0% | 100% | 0% | 100% | 0% | 100% | 0% | 100% | 0% | 100% |
| 100% | 0 | 0 | .25 | .25 | .50 | .50 | .75 | .75 | 1.00 | 1.00 |
| 75% | 0 | .25 | .187 | .437 | .375 | .625 | .562 | .8125 | .75 | 1.00 |
| 50% | 0 | .50 | .125 | .625 | .25 | .75 | .375 | .875 | .50 | 1.00 |
| 25% | 0 | .75 | .062 | .812 | .125 | .875 | .187 | .937 | .25 | 1.00 |
| 0% | 0 | 1.00 | 0 | 1.00 | 0 | 1.00 | 0 | 1.00 | 0 | 1.00 |
PHOTO DETECTOR OUTPUT NORMALIZED TO 1.00 VOLT WITH 100% REFLECTIVITY
FIG. 1B
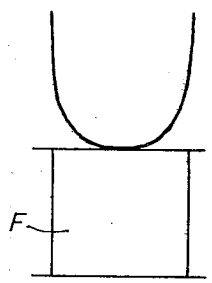
0 % FRAME FILL
FIG. 1C
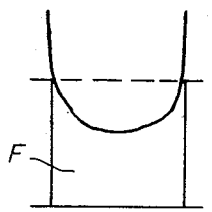
25 % FRAME FILL
FIG. 1D
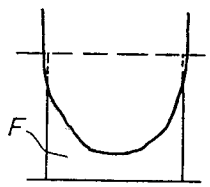
50 % FRAME FILL
FIG. 1E
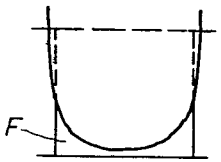
75 % FRAME FILL
FIG. 1F
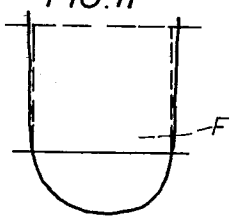
100% FRAME FILL AUTO NULL
CLASSIFY
COMPARE
GATE
EJECTOR CONTROL
DRIVER
% REF. = L / 1-K(H-L)
% F.F. = 1-K(H-L)
REF.
F.F.
EJECTION ZONE
100%
0%
150%

PREAMP OUTPUT
H
NO ARTICLE IN VIEW
ARTICLE IN VIEW

THEORETICAL
ARTICLE IN VIEW
NO ARTICLE IN VIEW
L

H
$D_3$
$D_4$

ACTUAL
L
$d_1$
$d_2$

PREVIOUS
PRESENT
NEXT SUCCESSIVE
H
147A
147B
$D_4$
176
178
L
148A
148B
$d_2$
t

TO 12

72
286
LATCH(284)
CLEAR
LATCH(284)
ENABLE
TO
294

298
3
138B
138A
157
164
68
LATCH(284)
ENABLE
B1
254

273
264
266
274
174
166B
162
152
267
268
166A
160A
160B
164
OUT
IN
A
B
MEMORY ADDRESS
ENABLE
172
68

SORTING APPARATUS USING PROGRAMMABLE CLASSIFIER

CROSS-REFERENCE TO RELATED APPLICATIONS

Subject matter disclosed and claimed herein is disclosed in the following co-pending applications:

(1) UNIVERSAL SORTING APPARATUS, Ser. No. 903,050, filed May 5, 1978;

(2) EJECTOR DWELL CONTROLLER FOR A SORTING APPARATUS, Ser. No. 903,058, filed May 5, 1978;

(3) SORTING APPARATUS, Ser. No. 903,057, filed May 5, 1978.

BACKGROUND OF THE INVENTION

1. Field of the Invention

This invention relates to a sorting apparatus having a programmable memory element in the article classifier.

2. Description of the Prior Art

It has long been desired to provide an electric sorting apparatus adapted to sort a variety of comestible or non-comestible articles without the necessity of changing or modifying the backgrounds against which the articles are detected and classified. To date, it is believed that a sorting apparatus able to sort a variety of articles without the necessity of changing the background for each article has eluded the art.

To understand the desirability of a sorting apparatus having a universally applicable background a brief overview into the state of the sorting art may be warranted.

Article sorting apparatus has traditionally utilized a background member disposed oppositely across an article stream from an optical viewer arrangement including an optical frame, an optical filter and a photoelectric detector. The frame defines a field of view or a viewing zone through which each article in a substantially singulated article stream passes. The intensity of light reflected from the article within the viewing zone at a predetermined wavelength compatible with the filter generates an electric signal output from the photodetector which is utilized in generating an article classification signal. The classification signal is utilized to classify the article viewed within the viewing zone on the basis of the presence of a predetermined physical characteristic therein, usually its color reflectivity.

In such arrangements, the background member is usually provided with the same color and reflectivity characteristics as an acceptable article. Thus, with no article within the viewing zone defined by the optical frame, an optical bias is imposed on the photocell due to the reflection of light energy from the background onto the cell. Accordingly, with no article in the viewing zone, an electrical signal output from the photocell corresponding to the output signal generated by an acceptable article is present.

When acceptable articles pass through the viewing zone no change in the electrical signal output occurs since the photodetector still is presented with reflected light at a wavelength adapted to generate an electrical classification signal output representative of an acceptable article. However, in a sorting arrangement, when an article having a portion thereon which is either darker or lighter than the color of an acceptable article enters the viewing zone, a deviation from the electrical signal output of the photodetector occurs. Typical prior art sorting apparatus have utilized such signal deviations to generate article reject signals. A reject signal known as a "light trip" occurs when the article within the viewing zone has a physical characteristic lighter than that of an acceptable article and thus generates a signal which deviates above the reference signal generated by the background. Alternatively, a reject signal known as a "dark trip" occurs when a portion of the article within the viewing zone includes a physical characteristic that is of a color darker than that of an acceptable article. The signal deviation corresponding to such a portion of the article appears as a decrease in the photodetector signal output.

In a monochromatic sorting apparatus, comparators are usually provided operable to generate article reject signals when the electrical signal output from the photodetectors deviates above or below predetermined cut points corresponding to light or dark trips, respectively. In a bichromatic sorting apparatus, the intensity of reflected light energy at two predetermined wavelengths is used to classify article reject signals representative of unacceptable articles.

It may be appreciated that the magnitude of the deviation from the background intensity signal is related to and dependent on both the reflectivity of the defective portion of the article (either light or dark or unacceptably colored) as well as the percentage of the viewing area, or frame fill, which the defective article occupies. Also, as will be discussed herein, prior art sorting arrangements generate classification signals from the portion of the article which deviates from the defined norm, that is, from the spot on the article. The prior art then utilizes the occurrence of the reject signal as the time base to establish the initiation of the article ejector.

From the foregoing, the typical prior art sorting apparatus using a fixed background is believed disadvantageous in several respects. Since the background provides an output signal of the same intensity as an acceptable article, such an arrangement is not adapted to generate signals representative of the entry of an article into the viewing zone (i.e., article detect signals) or to provide signal representations of the length of the article within the viewing zone. The circuitry associated with the typical sorting apparatus is blind to an acceptable article. Accordingly, it is necessary to provide an independent article detector and article size arrangement for use with sorting apparatus of this type.

Further, each background member must be customized for the particular sorting task. A separate background member has to be provided for sorting tomatoes which differs in color reflectivity from the background member required for sorting peanuts. As a corollary, service maintainability problems are attendant upon typical prior art sorting apparatus. Once the appropriate background member is placed in position within the sorting apparatus, the presence of dust or other foreign matter, as well as the impingement of article juices or fading of the background member, necessitate fairly periodic background changes. Yet, to place the background in a sealed and unaccessible position to guard against these factors generates maintenance and upkeep problems.

Due to the fading and clouding of the background member for the reasons set forth immediately above and due to electrical amplifier drift, it is often necessary to provide some sort of normalizing or nulling arrangement adapted to obviate the effects to the background occasioned by the passage of an article stream through the viewing zone. For example, U.S. Pat. No. 3,889,415, issued to Hoover and Codding and assigned to the assignee of the present invention relates to a normalizing arrangement for sorting apparatus. U.S. Pat. No. 3,382,975, issued to M. C. Hoover and assigned to the assignee of the present invention relates to a normalization control apparatus which includes a circuit arrangement adapted to control signal nulling when no article is in the viewed area.

Experiences with the sorting apparatus of type having the background member of the same color as an acceptable article next led practitioners in the art to utilize a non-reflective background region in an attempt to eliminate the requirement for a background member. Typical of the sorting apparatus using a non-reflective background region is that described in U.S. Pat. No. 4,088,227, issued to James F. Lockett and co-pending application Ser. No. 704,651, filed July 12, 1976 in the names of John D. P. Jones, James F. Lockett, Elias Codding and Miles Smither, now U.S. Pat. No. 4,134,498, and copending application Ser. No. 704,697, filed July 12, 1976 in the name of James F. Lockett, all assigned to the assignee of the present invention. However, the use of the non-reflective region as an alternative for elimination of the background against which the article being sorted is viewed also presents several perceived disadvantages.

Of course, the most obvious disadvantage of using a non-reflective background as the basis for classification of the article is the inability of such a background to provide an article reject signal representative of a dark or black spot on the article. Such potential defects are masked when a non-reflective background is used as the basis of the comparison. Furthermore, both light trip and dark trip activities cannot be effectively performed until the article being viewed completely fills the entire viewing area defined by the frame. Until that time, as the photodetector output signal intensity curve moves from zero intensity (representative of the view of the non-reflective background) up to the full frame signal intensity deviations on those portions of the article which are in view before the entire frame is filled usually go undetected. Furthermore, each article generates a dark trip signal (that is, the photodetector output signal trace falls below the dark trip cut point) as the article passes from the full frame view. Accordingly, based on such an occurrence, every article being sorted would be eliminated as unacceptable.

To overcome these perceived difficulties, it is believed to be advantageous to provide signal information only when the article completely fills the frame. The most obvious expedient to achieve this end would be to define the viewing zone by using a frame of a scope such that most articles would, upon entry thereinto, completely fill the viewing zone. However, this is obviously impractical for some articles. For example, rice grains or coffee beans are inherently incapable, due to their physical size, of completely filling a viewing zone. The results of the search for a sorting apparatus having a uniformly acceptable background useful for sorting any article presents the conclusion that, instead of eliminating the background, one must provide two backgrounds, each of different reflectivities. By providing two backgrounds, for example, one reflective and one non-reflective, the advantages attendant upon each type background are complemented and the disadvantages overcome. However, provision of two backgrounds effectively doubles the problems of fading or splattering. Furthermore, two backgrounds would require changing each time the article being sorted varies.

It would be advantageous, it is believed, to provide a sorting apparatus having an arrangement adaptable to produce the optical equivalent of two "background" members without physically defining a traditional background member.

It would be advantageous to provide a sorting apparatus wherein a signal representative of full viewing zone output may be generated without the frame being filled in actuality. That is to say, it is believed to be of advantage to provide a signal output equivalent to a full frame output regardless of the percentage of the viewing zone actually being occupied by an article. It is recalled that it is only when a full frame output is present that signal deviations above and below the acceptable norm (that is, light trip or dark trip) are generated representative of article unacceptability.

It is believed to be of advantage to generate and utilize an electrical output signal representative of the percentage of frame fill of an article and use that percentage frame fill signal to scale the signal intensities derived by photodetectors viewing one or the other of optically imposed backgrounds.

It is believed to be advantageous to provide a sorting apparatus characterized by a viewing arrangement adapted to optically define two "backgrounds" and having associated electronic circuitry operating in a digital mode to provide two electrical signals, each representative of the reflectivity characteristic of the same area of an article within a field of view defined by an optical frame. Each of the signal outputs is generated by a suitable electrical signal generator, as a photocell, in response to reflected light energy detected against a different one of the optically defined reflectivity "backgrounds", one "background" having a higher reflectivity level than the other. Typically, "backgrounds" representative of 0% reflectivity and 100% reflectivity may be utilized. It is also believed to be beneficial to utilize the signal outputs generated by the photodetectors against the divergent intensity "backgrounds" to generate an electrical signal representative of the percentage of the viewing zone, or "frame fill" occupied by the article. Yet further, it is believed to be advantageous to utilize the derived percentage of frame fill to scale the signal intensity generated from one or the other of the photodetectors associated with each "background" to provide an electrical signal representation of full frame percentage reflectivity of the article.

As is discussed above those prior art sorting apparatus which use a background member having the same reflectivity characteristic as that of an acceptable article are blind to the entry of the article into the viewing zone. It is important for various reasons to ascertain the entry and exit times of an article into and out of the viewing zone as well as to provide an indication of article length. Accordingly, prior art sorting apparatus usually utilize some photodetector arrangement responsive to an interruption or diminution in the intensity of the light beam incident thereon as an indication of the detection of a product.

Therefore, it is believed advantageous to utilize the same electrical signal representation of the percentage frame fill to both scale the signal intensities derived by the photodetectors to generate reflectivity percentages and to provide an indication of the entry and exit of an article into and from the viewing zone. It would be of advantage to provide an electrical article detect signal representative of the presence of an article within the viewing zone when the percentage frame fill exceeds a predetermined threshold percentage frame fill. Further, it is believed advantageous to provide a sorting arrangement wherein the threshold percentage frame fill required before an article detect signal is generated may be adjustably controlled.

As noted, the percentage reflectivity of an article can be utilized to classify that article as acceptable or unacceptable if the reflectivity figure is above or below predetermined reference cut points. This is alluded to earlier as a "light" or "dark" trip. This technique is usually utilized when sorting articles and rejecting them on the basis of blemishes or defects on their surface.

It is also possible and a usual prior art practice to sort articles based on the reflected intensities of light energy at two predetermined wavelengths. Such bichromatic sorts rely upon some ratio or other functional relationship between the reflected light intensities at each of two predetermined color wavelengths to classify articles as acceptable or unacceptable. It is also known in connection with bichromatic sorting apparatus to utilize the reflected intensities at the predetermined color wavelengths to generate a reject signal when the article within the viewing zone is a foreign object. For example, the co-pending application of James F. Lockett, Ser. No. 829,485, filed Aug. 31, 1977, and assigned to the assignee of the present invention relates to a foreign object discriminator arrangement.

It is known in the prior art to utilize the electrical signal intensities of light energy reflected from an article being sorted at each of two predetermined color wavelengths to locate a point in a Cartesian coordinate system, each coordinate corresponding to one of the reflected light intensities. For example, the electrical signal outputs of reflected light energy at each color wavelength may be used to illuminate a point on the face of a cathode ray oscilloscope. From repeated trials with a plurality of acceptable articles, it is then possible to identify the portion of the face of the oscilloscope that points corresponding to acceptable (or, alternatively, unacceptable) articles cluster. A masking sheet, usually cardboard material, is then fabricated by hand and disposed over the face of the oscilloscope. In this manner, a photoelectric detector placed in proximity to the face of the oscilloscope is then shadowed so that only the illuminated points in the exposed portion of the face of oscilloscope are responded to by the photodetector. As may be appreciated, this time-consumming and tedious process must be used to generate a mask for each article type sorted.

In view of the foregoing, it is believed to be advantageous to provide a sorting apparatus having an electronic classification arrangement responsive to the signal representations of the reflected light intensities at each predetermined color wavelengths to address a programmable memory arrangement. The memory arrangement includes a plurality of memory storage locations, each one of which is addressable by a unique combination of reflected light intensities at each of the predetermined color wavelengths. Thus, within the storage locations of the memory arrangement, a "profile" region of acceptable or unacceptable articles may be defined. It is believed advantageous to provide such a programmable classification arrangement such that various acceptable/unacceptable profiles for each of a plurality of articles may be quickly and efficiently loaded into the appropriate memory locations.

Once an article has been classified (either monochromatically, bichromatically, or otherwise) as unacceptable it must be eliminated from the article stream through the operation of an article ejector element. The article ejector element may conveniently take the form of a mechanical element extendable into the path of the article stream to deflect the rejected article therefrom. It is also common to utilize ejector elements of the type operative to remove rejected articles from the article stream by directing a jet of pressurized fluid (either a liquid or a gas) to deflect the article from the article stream.

Such ejectors are typically driven under the control of an ejector control arrangement which receive an article reject signal after that signal is delayed for a predetermined period of time sufficient to permit the article to traverse the distance from the viewing zone to the ejection zone. Since it is possible for a plurality of articles to pass through the viewing zone and be appropriately classified before the first of those articles traverses the distance from the viewing to the ejection zone, it is typically necessary to provide some sort of storage arrangement wherein signal representation of the acceptability or unacceptability of each of the articles is stored for the predetermined delay time. At the expiration of that delay period the classification signal, termed an article reject signal if the article has been classified as unacceptable, is withdrawn from the storage or delay arrangement and applied through suitable circuitry to generate an article eject signal to the ejector driver. The driver responds to the article eject signal to initiate ejector operation to deflect the rejected article from the article stream.

It is noted above that the classification signal which serves as the basis for the article reject and article eject signals is typically generated when the defective portion of the article enters into the viewing zone. Thus, due to the fixed nature of the predetermined time delay of the system, ejector operation is initiated when the same defective portion of the article which generated the unacceptable classification enters into the ejection zone. Such an arrangement is not disadvantageous if the defective portion of the article happens to fall toward the mid-portion of the article. However, if the defective portion of the article happens to occur toward the trailing edge thereof, ejector operation is not initiated until that same trailing portion of the article enters the ejection zone. This may prove to be disadvantageous in some situations. Holding ejector operation until the entry of the defective portion of the article into the ejection zone may result in the great majority of the ejecting force produced thereby being directed toward the next-successive article in the article stream with only a small, and perhaps ineffective, portion of the ejecting force being directed against the article carrying the defect.

Accordingly, it is believed advantageous to provide an ejector control arrangement operative to initiate ejector operation to apply an ejecting force (either of the mechanical or pressurized fluid type) against the same predetermined portion of each article entering the ejection zone regardless of the location on the article of the defective portion causing the unacceptable classification thereof. It is believed advantageous to direct the ejecting force toward the article having the defect thereon rather than toward the defect itself. Such an arrangement is believed advantageous in that it increases the accuracy with which the ejecting force is applied and thereby increases the efficiency and reliability of the sort.

It is also believed of advantage to provide an ejector control arrangement which utilizes storage elements operative to store only article reject signals. Since the great majority of the articles being sorted are classifiable as acceptable, memory storage capability may be reduced at a concomitant reduction in cost if only article reject signal information generated by an unacceptable article is stored and utilized to generate an article eject signal. Furthermore, it is believed advantageous to use as memory storage and delay elements registers of the type which output data stored therein on a first in-first out basis. This eliminates the need for electrical signals to increment data through various memory stages.

SUMMARY OF THE INVENTION

In accordance with the teachings of this invention a sorting apparatus for sorting articles based upon the intensity of light reflected therefrom at first and second color wavelengths includes a viewer element adapted to view a predetermined viewed area through which an article to be sorted passes and an electrical signal generator arrangement associated therewith and adapted to generate first and second electrical signals respectively representative of the intensity of light energy reflected from the article at first and second color wavelengths. The sorting apparatus includes a programmable memory element, such as a random access memory, having a matrix array of storage locations therein. Each point in the array is addressable by a combination of electrical signals corresponding to the reflected light intensity at first and second color wavelengths from an article being sorted. The memory is programmed to define in the matrix array at least one "profile" containing therein matrix points having addresses corresponding to the reflectivities (at each color) of an acceptable article. An electrical signal representation of the acceptability of an article having reflectivities defining the addressed location is loaded into the addressed location. The memory element may be loaded with the profile of acceptable article information by passing one or a plurality of acceptable articles through the viewed area prior to the initiation of the sort.

BRIEF DESCRIPTION OF THE DRAWINGS

The invention will be more fully understood from the following detailed description thereof, taken in connection with the accompanying drawings, which form a part of this application and in which:

FIGS. 1A–1F are pictorial representations of the observed physical events which form the theoretical basis of a sorting apparatus in accordance with the teachings of this invention;

FIG. 3 is a pictorial representation of a sorting apparatus in accordance with the teachings of the invention while

DESCRIPTION OF THE PREFERRED EMBODIMENT

Figure 3:
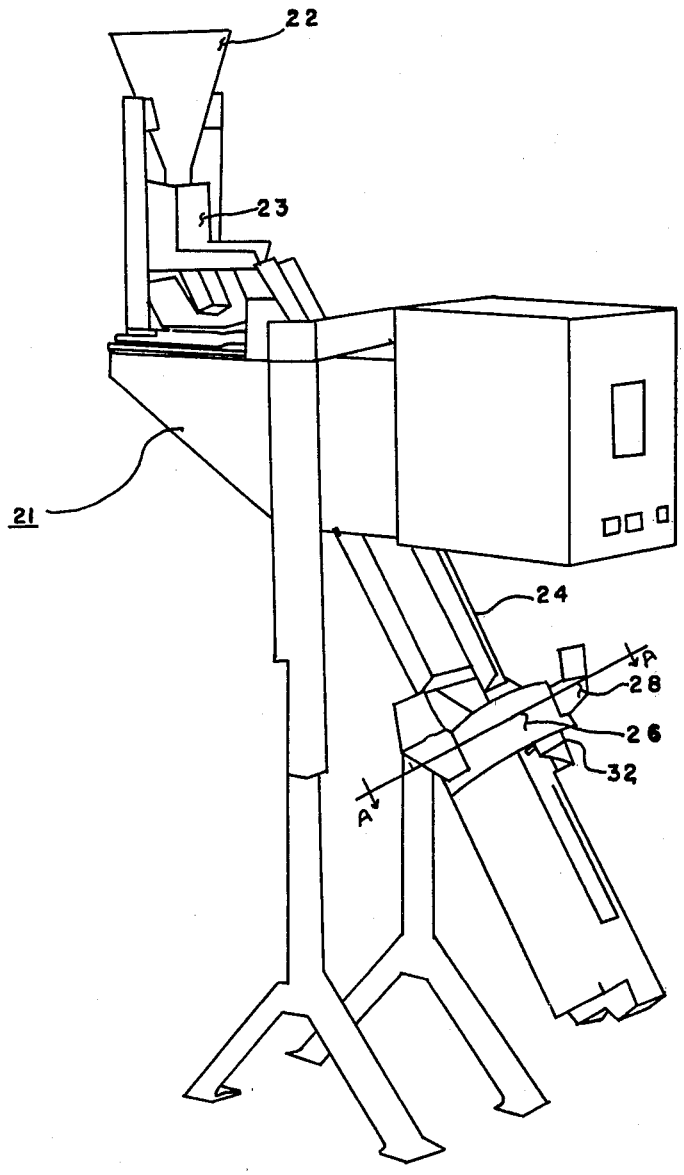

Throughout the following description, similar reference characters refer to similar elements in all Figures of the drawings.

As is discussed above, the quest to eliminate the background member in prior art sorting apparatus or to provide a universally applicable background for sorting all article types leads to the realization that this can be accomplished by performing a sort against two "backgrounds". Although this initially appears inconsistent, it has been found that by ascertaining the reflectivity characteristics of an article within a viewing zone against two "background" reference intensities—one lower than the other—it is possible to generate a signal representation of the portion of the viewing zone defined by an optical frame that the article fills and, from that, to generate an electrical signal representation of the percentage reflectivity of the article at each of a predetermined number of predetermined wavelengths.

In this context, "reflectivity" is used to mean that quality of an article as mesured by the percentage of incident light energy reflected from the article. "Reflectivity", then, is the percentage of incident light energy reflected from an article.

It is recalled that the drawback attendant upon using a non-reflective background as a substitute for the background member painted to match the reflectivity of an acceptable article is the inability for such an apparatus to detect defects appearing at the leading or the trailing edges of an article as it passes into full frame view or as it leaves full frame view. (In addition, the latter situation triggered a "dark trip" for every article).

It is appreciated that if a signal representation equivalent to the reflectivity of an article when in full frame view could be generated after only a predetermined portion of the article enters the viewing zone, then defects which occur anywhere on the article, even at the leading and trailing edges, would generate peaks or valleys above or below the full frame signal. These deviations then are relatively easily identified and detected. The expedient of decreasing the optical frame to a size substantially equal to the articles being sorted does not appear to be a workable alternative, especially in the case of small products, as rice grains or coffee beans.

In accordance with this invention, signals representative of the reflectivity of a predetermined portion of the article as detected and classified against two "background" references are used to provide a signal representation of the percentage of the frame filled by the article. Once the percentage frame fill is derived, it is used to scale the output from one of the "background" references to a level representative of the full frame reflectivity. The theoretical underpinning of such an apparatus may be appreciated by reference to FIGS. 1A through 1F and to the Table of FIG. 2, to which reference is now invited.

Figure 2:
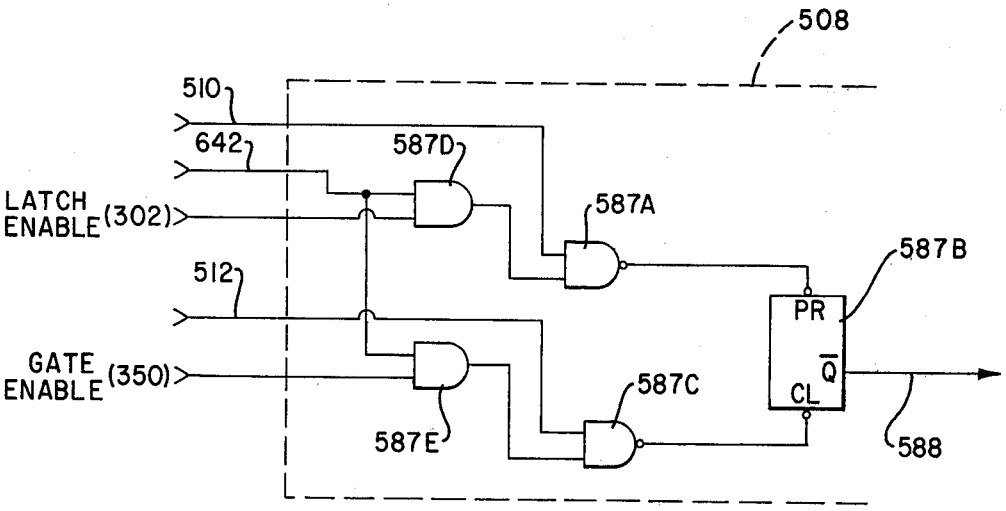
FIG. 2 is a tabular arrangement of data from which the physical relationships between observed physical parameters may be identified and quantified.

FIG. 1A is a pictorial representation of an article sorting arrangement useful in defining the environment in which the situation depicted in FIGS. 1B through 1F and tabulated in the Table of FIG. 2 occurs. In FIG. 1A, a stream of articles A moves in a singulated manner at a velocity and in the direction of the arrow V through a viewing zone Z. The boundaries of a predetermined viewed area within the viewing zone Z are defined by an optical frame F. Disposed opposite the frame F across the article stream is a background member B. A photodetector, as a photocell C, is disposed behind the frame F and generates an electrical signal output representative of the reflectivity of the object within the viewed area presented to it. A filter element G is disposed between the frame F and the photocell C. As each of the articles A moves through the viewing zone Z, the frame F is progressively filled thereby, as depicted in FIGS. 1B through 1F.

It may be intuitively appreciated that the output of the photocell C is related to the reflectivities of the article A and the background B, as well as to the portion of the frame filled by the article A and the background B. The background B, in the discussion that follows, is indicated to possess either a totally reflective characteristic (i.e., 100%) or a non-reflective characteristic (i.e., 0%) as indicated in the text. Quantified, if the article A is defined to possess a light reflectivity characteristic equal to 100% (i.e., totally reflective) and is viewed against a background B having a light reflectivity characteristic "l" equal to 0% (i.e., non-reflective), the signal outputs of the photocell C may be tabulated as in FIG. 2 for each of the frame fill conditions depicted in FIGS. 1B through 1F (with the output normalized such that 0.0 volt corresponds to zero reflectivity while 1.0 volt corresponds to 100% reflectivity).

Thus, in the case under discussion, as the percentage frame fill increases from 0% (FIG. 1B) to 100% (FIG. 1F), the signal output of the cell C progressively increases from 0.0 volt until the signal output corresponding to the situation in FIG. 1F equals 1 volt. If the same article A (i.e., having a light reflectivity equal to 100%) is viewed against a background B having a reflectivity "h" equal to 100%, then the output of the cell C as the frame fills progressively is as tabulated in the second column of the Table.

Varying the light reflectivities of the article A from the defined case results in the varying signal outputs for each article viewed against backgrounds with reflectivities "l" and "h" as shown in other columns of the Table. It is appreciated, of course, that the "l" and "h" reflectivities of the background B need not be 0% and 100%, respectively. Any suitable combination may be used, so long as the reflectivity "l" is lower than the reflectivity "h" (i.e., the reflectivity "h" is higher than the reflectivity "l").

With reference to the Table, close inspection reveals a correlation between the percentage of frame fill and the signal intensities generated by the photocell C when a given article A is viewed against the "l" and "h" backgrounds. For example, when an article A having a reflectivity characteristic of 75% is viewed against the background B having predetermined "l" and "h" reflectivities respectively equal to 0% and 100%, it may be seen that the percentage frame fill is functionally related to the difference between the photocell signal output L (corresponding to the output of the photocell C when viewing the article A against the background B having the reflectivity "l") and the signal output H (corresponding to the output of the photocell C when viewing the article A against the background B having the reflectivity "h"). More precisely, the percentage frame fill has been found to conform to the following relationship:

$$\% \text{ Frame Fill} = 1 - (H - L) \quad (1)$$

where H and L are the photocell outputs as defined immediately above.

In the specific instance presently under discussion (article having a 75% reflectivity characteristic viewed against a background having an "H" reflectivity of 100% and an "L" reflectivity of 0%), Equation (1) yields $$25\% \text{ Frame Fill} = 1 - (0.937 - 0.187).$$

Further analysis reveals that the reflectivity of the article A is functionally related to the percentage of frame fill. If one of the signal outputs L or H from the photocell C is scaled in accordance with the percentage frame fill, the result is the light reflectivity of the article.

This is best illustrated with a specific example. In the case analyzed above, the L signal output from the photocell C when viewing the 75% reflective article A against a background B having a reflectivity "l" equal to 0% is 0.187 volts (normalized). The reflectivity of the article is found if this signal intensity is scaled by the corresponding percentage frame-fill in accordance with the following relationship:

$$\text{Reflectivity of Article} = L/\%\ \text{Frame Fill} \quad (2)$$

It may be seen that the given article reflectivity (here 75%) substantially equals 0.187/25%, as predicted by Equation (2).

It is also noted that the reflectivity of the article may be determined by scaling the H signal output in accordance with the relationship:

$$\text{Reflectivity of Article} = 1 - \left[\frac{1 - H}{1 - K(H - L)}\right] \quad (2A)$$

Following the teachings of this invention, then, if an article A having an unknown reflectivity which is desired to be ascertained so as to serve as the basis of a sort partially enters a viewing zone defined by a frame, and if electrical signals output from a photocell viewing the same portion of the article A generate output signals L and H, respectively representative of the reflected light energy detected against 0% and 100% reflective backgrounds, the percent of frame fill of the article is given by the relationship defined in Equation (1). Further, the percentage reflectivity of the article (the unknown sought) may be obtained by appropriately scaling either the L or H signal output by the percentage frame fill, as exemplified by Equation (2).

Certain comments appear to be in order. It appears to be most convenient to determine the percentage reflectivity of the article by scaling the L output signal in accordance with the relationship of Equation (2). However, it is to be understood that either the L or H signals may be scaled in accordance with the frame fill to generate the electrical signal representation of the article reflectivity. It directly follows that the reflectivity characteristic of an article at a predetermined wavelength may also be generated in accordance with this invention by scaling the selected signal (L or H) representative of light intensity reflected by the article at that selected wavelength by the representation of the percentage frame fill. As will be seen, this observation serves as the basis for a bichromatic sorting apparatus in accordance with the invention. It is also clear that percentage frame fill is a signal representation that is independent of color of the article. This signal represents the portion of the frame filled by an article, regardless of the article's color.

Furthermore, it is again noted that although it is most convenient to utilize 0% and 100% "backgrounds", signal intensities L and H may be generated from backgrounds other than "l" equal 0% reflectivity and "h" equal 100% reflectivity. Any suitable values of "l" and "h" may be used. If alternate values of "l" and "h" are used, the output signals L' and H' so generated by the photodetectors are related to the L and H signal intensities produced when 0% and 100% backgrounds are used in accordance with the following equations:

$$L = k_L L' \quad (3)$$

$$H = k_H H' \quad (4)$$

where $k_L$ and $k_H$ are appropriately chosen constants adapted to convert L' and H' signal intensities into signal intensities referenced to 0% and 100% reflectivity. In a situation wherein the "l" and "h" values differ from 0% and 100% Equation (1) is altered in that the parenthetical quantity is multiplied by a constant related to the constants $R_H$ and $R_L$. Alternately stated, if the "l" and "h" values are 0% and 100%, the parenthetical expression of Equation (1) is multiplied by a constant equal to unity.

In order to accommodate the mathematically undefined result of 0/0 that is generated when the L signal is scaled according to Equation (2) when no portion of the article is in view, the percentage frame fill may be used to enable the scaling to occur only after a predetermined threshold frame fill (typically 3%) has been achieved. This arrangement also permits a percentage frame fill (typically, but not necessarily 3%) to serve as an article-detect signal.

By applying the foregoing principles, it is possible to obtain an electrical signal representation corresponding to full frame occupancy by the article from signal representations of the reflectivity of the portion of the article as viewed against "backgrounds" with intensities of "l" and "h". The two "backgrounds" need not be physically present across from the photodetectors. As is seen herein, the "backgrounds" may be optically defined. Thus, the problems generated by the presence of a background member within a viewing element are eliminated by a sorting apparatus embodying the teachings of the preferred embodiment of this invention.

Figures 4, 6A, 6B, 6C:
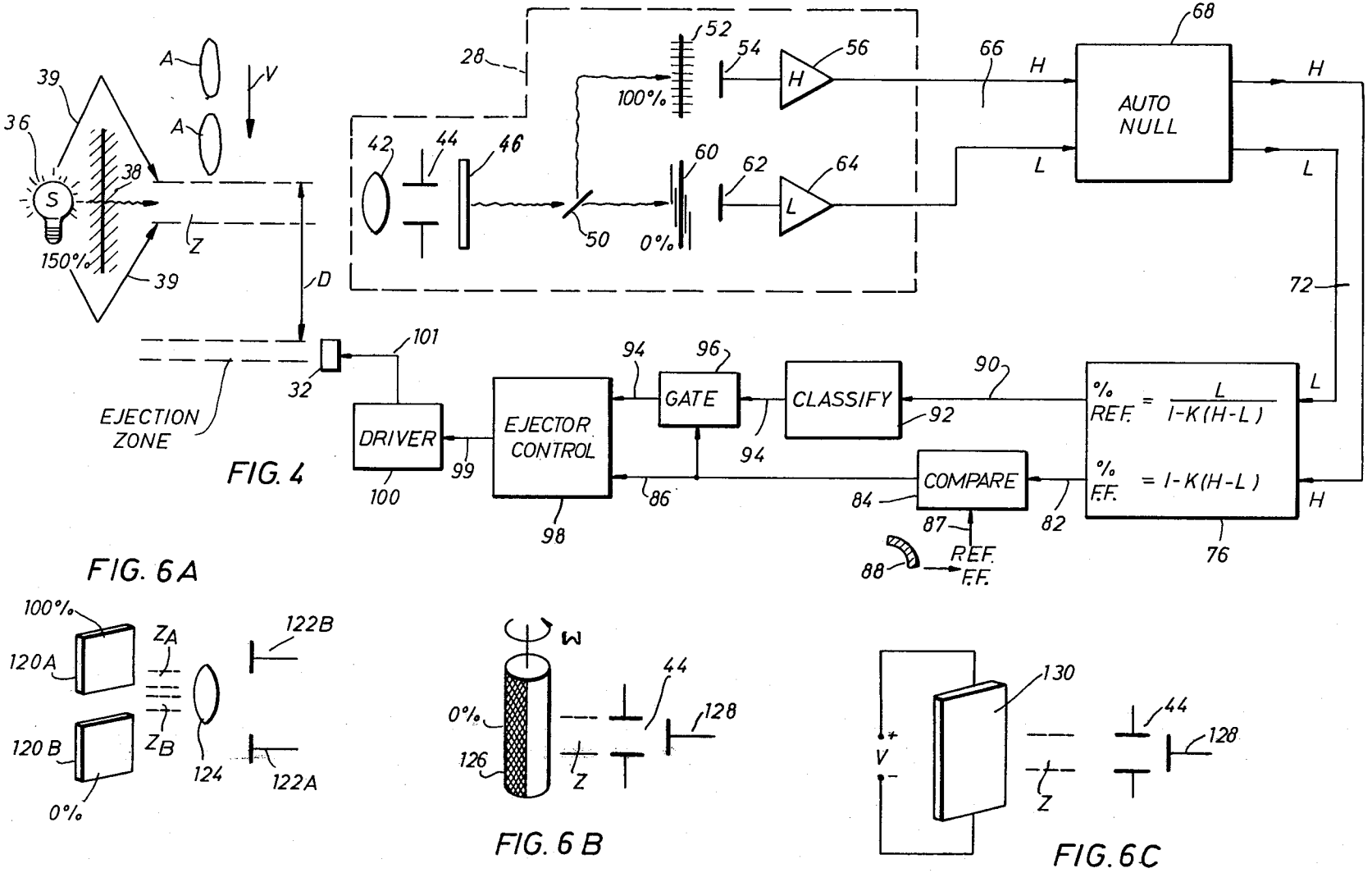
FIG. 4 is a functional block diagram of a sorting apparatus in accordance with the teachings of this invention adaptable to perform a monochromatic sort of an article stream.
FIGS. 6A through 6C are highly stylized pictorial representations of alternative embodiments by which the predetermined reflectivities against which reflected light energy from the articles to be sorted in accordance with this invention may be defined.
Figure 5:
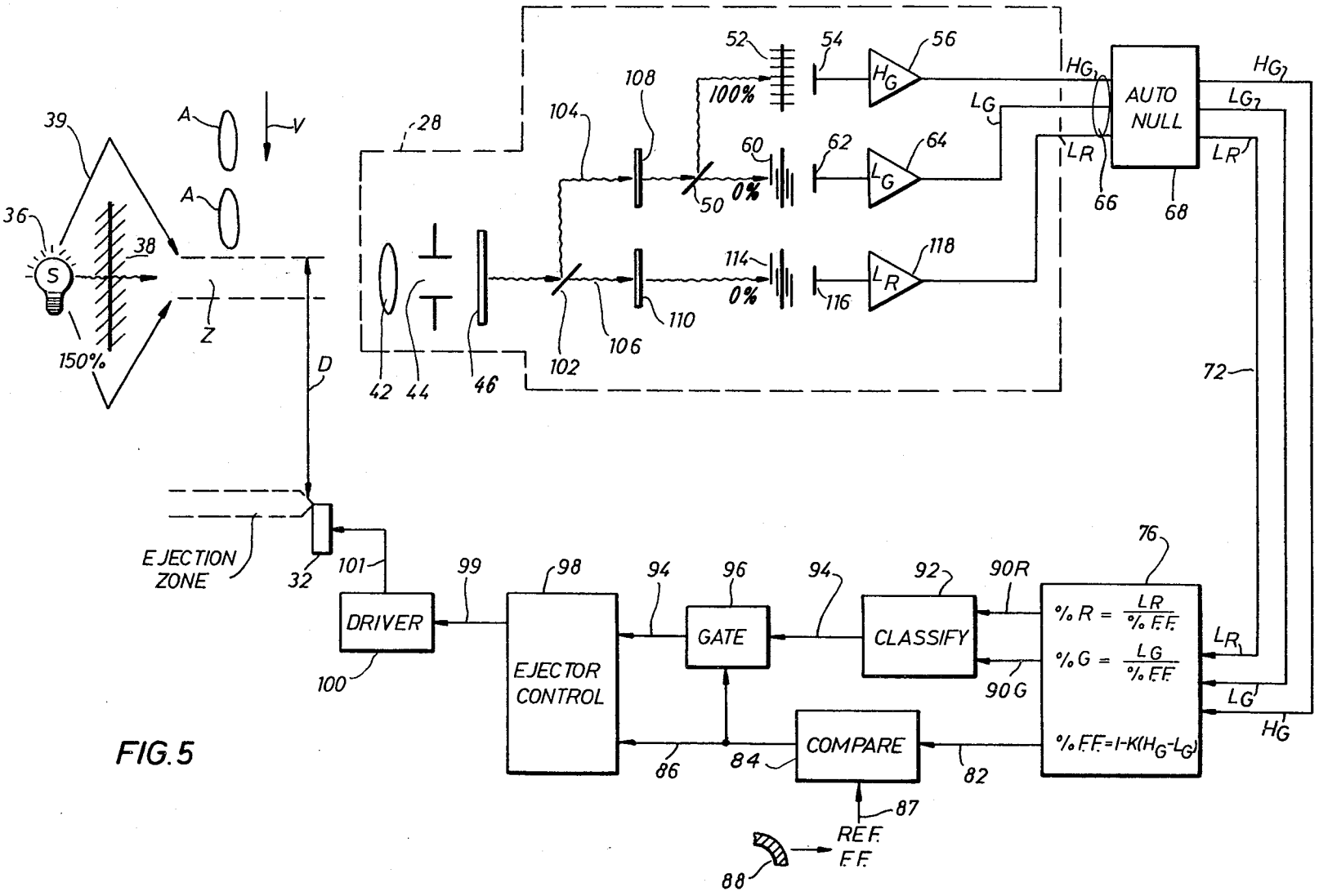
FIG. 5 is a functional block diagram of a sorting apparatus in accordance with this invention adaptable to perform a bichromatic sort of an article stream.

With reference to FIG. 3, a pictorial representation of the physical structure of a sorting apparatus 21 embodying the invention is shown, while FIGS. 4 and 5 respectively illustrate functional block diagrams of a monochromatic and a bichromatic sorting apparatus in accordance with the underlying principles of the invention just discussed. FIGS. 6A through 6C illustrate alternatives by which the reflectivities against which reflected light energy is detected may be defined.

In FIG. 3, a supply of articles to be sorted, such as coffee beans, rice grains, peanuts, or other comestibles or non-comestibles are charged into a receptacle 22. By the action of a feeding mechanism 23 the articles are fed into a slide chute 24. From the lower end of the chute 24, a highly singulated article stream falls under the influence of gravity through a viewing arrangement generally indicated by reference numeral 26. The predetermined viewed area, or viewing zone Z (FIGS. 4 and 5,) through which each article to be sorted passes is disposed within the viewing arrangement 26. Within the viewing arrangement 26 the individual articles are viewed, and light energy reflected therefrom is detected by an array of viewer elements 28. The reflected light energy is used to generate frame fill percentage and percentage reflectivity signals by which an article is classified as acceptable or unacceptable by a classifier arrangement 92 embodying this invention (FIG. 10E).

Disposed a predetermined distance D below the viewing arrangement 26 is an ejector 32 operative in response to an appropriate signal from the classifier arrangement 92 (as gated by a signal representative of the presence of an article in the viewed area) to eliminate from the article stream those articles classified as unacceptable. The ejector 32 may be of the type utilizing a jet of pressurized fluid to direct an unacceptable article from the article stream into a suitable bin (not shown). Of course, as discussed herein, other ejectors may also be used.

The physical dimensioning of the structure of the sorting apparatus is such that the distance between the end of the chute 24 and the beginning of the viewing arrangement 26 and between the viewing and ejection zones are adapted to facilitate the presence of only one article within each mentioned zone at any given time. The distance between the viewing and ejection zones is on the order of 2.5 inches. Freely falling articles traverse this distance in 10–15 milliseconds. In addition to the physical dimensioning, other precautions (discussed herein) are taken to avoid the effects of article overlap (known as "box-carring") in either the viewing of the ejection zone.

Figure 3A:
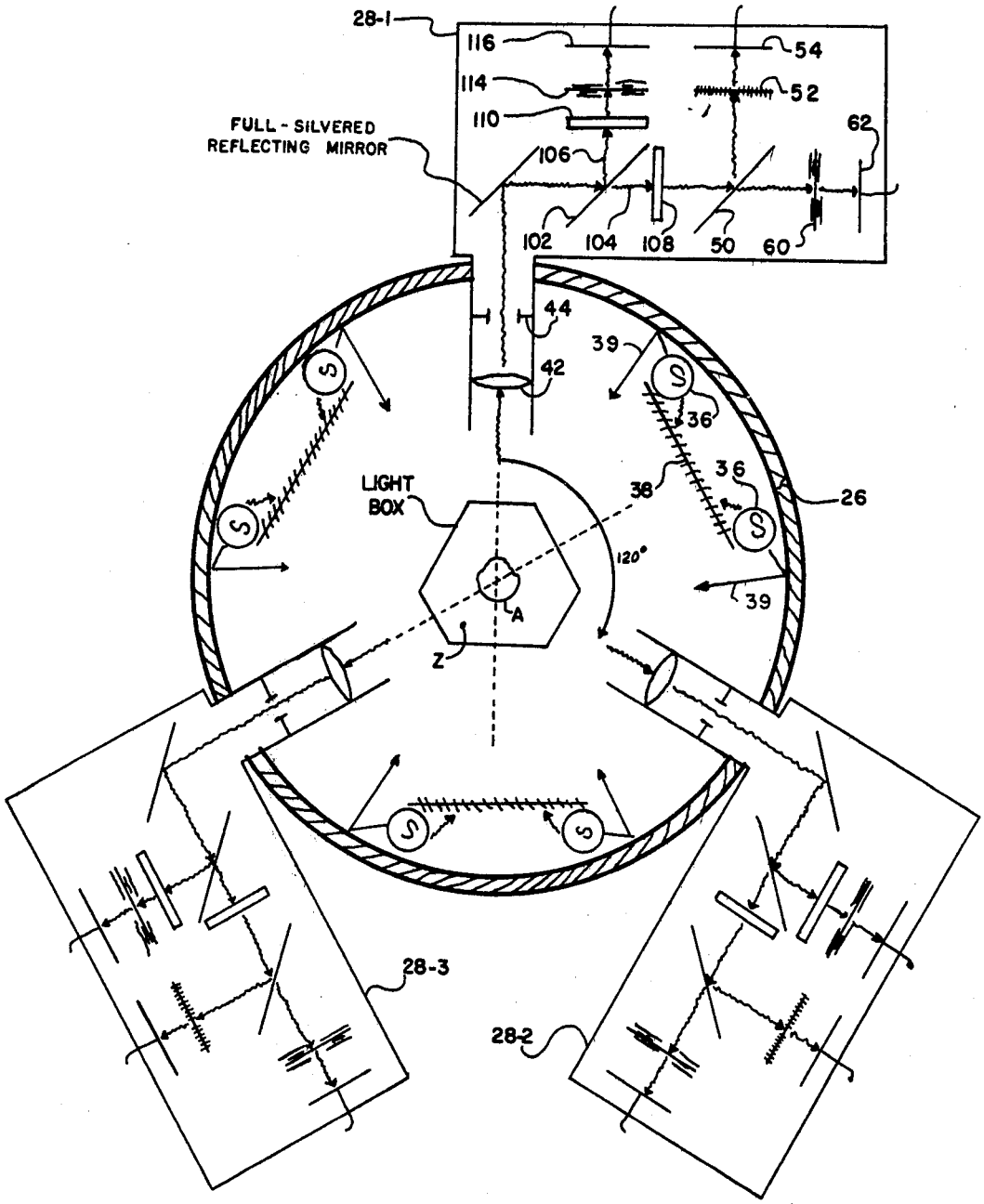
FIG. 3A is a sectional view taken along section lines A—A in FIG. 3.

In accordance with the invention, the viewing arrangement 26 includes a transparent "light box" having a predetermined cross-sectional configuration when viewed in a plane substantially perpendicular to the direction of article flow. The viewing zone through which each article to be sorted passes is disposed within the light box. As seen in FIG. 3A, which is a view taken along lines A—A in FIG. 3, the cross-sectional configuration of the light box is hexagonal, to eliminate extraneous reflections and glare. The viewing arrangement 26 is provided with a suitable lamp 36 or other element which serves as a source of light energy. If the maximum magnitude of light energy reflected from an article being sorted is defined as the reference standard, or 100% reflectivity, then the light energy of the source may be defined as a 150% source. By this it is meant that the magnitude of light energy emitted by the source is greater than the greatest magnitude of light energy able to be reflected from an article being sorted. Although the invention requires only one viewer element 28, as seen in FIG. 3A, three such viewers 28A, 28B and 28C are disposed equiangularly about the article stream, each viewer 28 being disposed oppositely from a source polarizer 38A, 38B and 38C.

As seen from FIGS. 3A, 4 and 5, the source 36 is disposed behind a source polarizing member 38 which is positioned directly across the article stream from each of the optical arrangements or viewers 28. Light energy from the lamp 36 also enters the viewing area by reflections from within the viewing arrangement, the light energy passing around, over and above the source polarizer 38, as shown at 39. Although the source polarizer 38 is disposed behind the article stream as viewed from each of the optical viewers 28, it is only in this sense that the source polarizer 38 may be thought of as a background member. As will be seen, each source polarizer 38 acts to orient light energy in a predetermined plane and to direct that energy toward its associated optical viewer 28.

The source polarizer 38 is in no way related to the reflectivity or color of the articles being sorted and, in this sense, is universally applicable to any sorting operation relying upon the basis of reflected light. It is understood that in the preferred embodiment of the invention light energy (either directly from a bulb or indirectly from reflection inside the light box) passes through the source polarizer 38 and enters the optical viewer 28 when no article is within the viewing zone Z. During the course of the passage of each article through the viewing zone, the individual articles reflect non-polarized light energy 39 into the optics.

As noted, in accordance with this invention three viewer elements 28 (FIG. 3A) are arranged approximately 120° from the other circumferentially about the article stream in substantially the same plane. For purposes of clarity of illustration, however, throughout the description of the monochromatic and bichromatic arrangements discussed herein, the optical and electronic elements associated with one of the viewers 28 will be discussed.

A functional block diagram of a monochromatic sorting apparatus embodying the teachings of this invention is shown in FIG. 4. Each viewer element 28 includes a lens 42 and an optical frame 44 (similar in function to the frame F in FIG. 1). The frame 44 is adjustable so as to define a predetermined range of sizes for the viewing zone Z. If desired, a filter 46 may be disposed in the light path directly behind the frame 44. In a monochromatic system, light energy reflected from articles and passing through the viewing zone Z (as defined by the frame 44) is focused, filtered (by filter 46 if desired), and split into first and second beam paths by a beam splitting element 50. Commonly, such element 50 may be a half-silvered mirror. Disposed within the first beam path defined by the beam splitting element 50 is a polarizer element 52 and a photodetector 54. Associated with the output of the photodetector 54 is a preamplifier 56, hereinafter referred to as the L H preamplifier. In the second beam path generated by the beam splitting element 50 there is disposed a polarizing element 60 immediately before a photodetector 62 and its associated preamplifier 64. The preamplifier 64 is hereafter referred to as the preamplifier.

The polarizer 60 is oriented at 90° cross axis to the source polarizer 38. Accordingly, with no article within the viewing zone Z it appears to the photodetector 62 and the associated L preamplifier 64 that it is viewing a substantially zero percent reflectivity background. Thus, with no article in view the output of the L preamplifier 64 equals zero volt. When an article A passes within the viewing zone Z and nonpolarized light is reflected therefrom the photodetector 62 appropriately responds by generating an output signal greater than the zero volt signal generated with no article in view.

The polarizer 52 is utilized in an attenuating mode and, as such, is oriented with respect to the polarizer 38 so as to effectively diminish the intensity of light energy directed upon the photodetector 54 when no article is within the viewing zone Z. Therefore, it may be appreciated that due to the operation of the source polarizer 38 and the attenuating polarizer 52 it appears to the photodetector 54 and its associated H preamplifier 56 that when no article is within the viewing zone it views a background member having a reflectivity characteristic substantially equal to 100%. Thus, as articles enter the viewing zone and non-polarized light is reflected therefrom the photodetector 64 appropriately responds by generating electrical signals deviating below the electrical signal representative of 100% reflectivity. As will be seen, the photodetectors 54 and 62 form an electrical signal generator arrangement associated with the viewer and adapted to respond to light energy incident thereon to generate a first and a second electrical signal representation of light energy reflected from an article being sorted against the "backgrounds" defined by the effect of the polarizers 52 and 60.

The outputs from the L and H preamplifiers are applied over lines 66 to an automatic nulling arrangement generally indicated by reference character 68. The automatic nulling arrangement 68 operates in an entirely digital mode to correct for the effects of temperature drifts or other offsets in the signals output from the preamplifiers L and H. The automatic nulling arrangement is discussed in greater detail herein but, at this point, it may be said that the portion of the nulling arrangement 68 operative to correct for the effects of electrical offset and temperature drift output from the L preamplifier 64 substantially corresponds to the automatic nulling arrangement disclosed and claimed in the co-pending application of James F. Lockett, Ser. No. 874,780 filed Feb. 3, 1978. This portion of the nulling arrangement 68 is operative to sample the output of the L preamplifier 64 a predetermined number of times during a predetermined sample time period to select the lowest positive or greatest negative signal value occurring during that time period. Since the L preamplifier 64 is operative to view a zero percent reflectivity background when no article is in view the sampled lowest positive or greatest negative signal is equal to the magnitude of the electrical offset or temperature drift of the preamplifier 64.

However, as will be detailed more fully herein, the situation differs in connection with the output of the H preamplifier 56. Correction of the electrical offset and temperature drift encountered within this preamplifier element requires the determination of the magnitude of the greatest positive signal occurring at the output of the amplifier 56 during a predetermined sample time period. This signal is utilized to generate the appropriate correction to the signal from the amplifier 56 in a manner disclosed in complete detail herein.

The appropriately nulled outputs from the nulling arrangement 68 are applied on lines 72 to an electronic reflectivity and percentage frame fill signal generator circuit arrangement, or "background computer" generally indicated by reference numeral 76 and adapted to generate electrical signal representations of both the percentage of frame filled by an article passing through the viewing zone and the percentage reflectivity thereof. As derived earlier, the percentage frame fill is functionally related to the difference in signal intensity between the electrical signals output from the preamplifiers H and L. It is also recalled that it may be necessary to appropriately scale either or both of the outputs from the preamplifiers 64 and 56 if the background references therefor differ from zero percent reflectivity and 100% reflectivity, respectively. Accordingly, a suitable constant K (itself related to the constants $k_L$ and $k_H$) may be applied to derive the signal representative of the percentage reflectivity of the article. Further, the percentage reflectivity of the article itself may be derived by appropriately scaling either the electrical signal representation from the L or H preamplifier by the percentage frame fill.

Any suitable electrical circuit configuration may be utilized to generate the electrical representations of the percentage frame fill and to also scale a selected one of the electrical signal outputs to thereby generate a signal representation of the percentage reflectivity of the article within the viewing zone. It is to be noted that the percentage reflectivity and percentage frame fill signal generator functionally detailed in FIGS. 4 and 5 may be implemented in an analog or digital hardware implementation or in a programmed software implementation, all lying within the contemplation of this invention. Furthermore, if more than one viewer element and associated electronic arrangement is used, the signal outputs from each viewer may be multiplexed. In the preferred embodiment discussed herein, the background computer 76 is digital and multiplexed.

The percentage frame fill is applied by a line 82 to an article-detect signal generator 84. The signal generator includes a comparator element operative to generate an article-detect signal on a line 86 if the magnitude of the electrical signal representative of the percentage frame fill exceeds a predetermined electrical signal representative of a threshold frame fill percentage input to the comparator on a line 87 from a suitable reference signal generator 88, such as a thumbwheel.

The output from the circuit arrangement 76 representative of the percentage reflectivity of the article is connected by a line 90 to a classifier element 92. In the case of a monochromatic sorting arrangement as illustrated in FIG. 4 the classifier element 92 may comprise a comparator arrangement adapted to generate an electrical article-reject signal on a line 94 if the percentage reflectivity signal on the line 90 from the background computer 76 deviates above or below predetermined cut points representative of light and dark trips, respectively. The output of the classifier 92 is applied through a gating arrangement 96 operative in response to the article-detect signal on the line 86. Thus, once a predetermined threshold percentage frame fill has been reached the output of the classifier 92 is applied as an article-reject signal to the line 94 if the article is classified by the classifier arrangement 92 as unacceptable.

Figure 14:
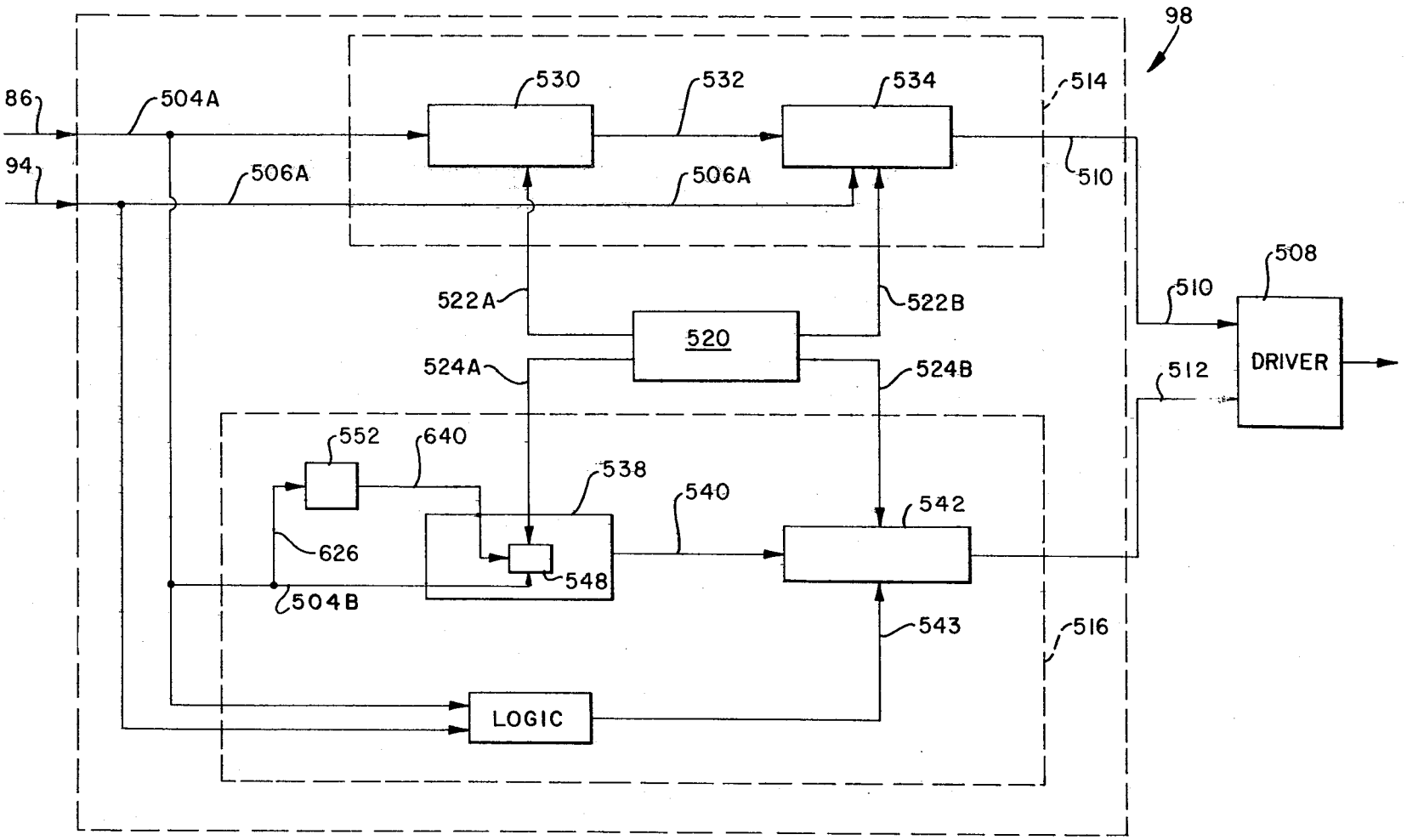
FIG. 14 is a functional block diagram of an ejector control arrangement in accordance with this invention.
Figure 15:
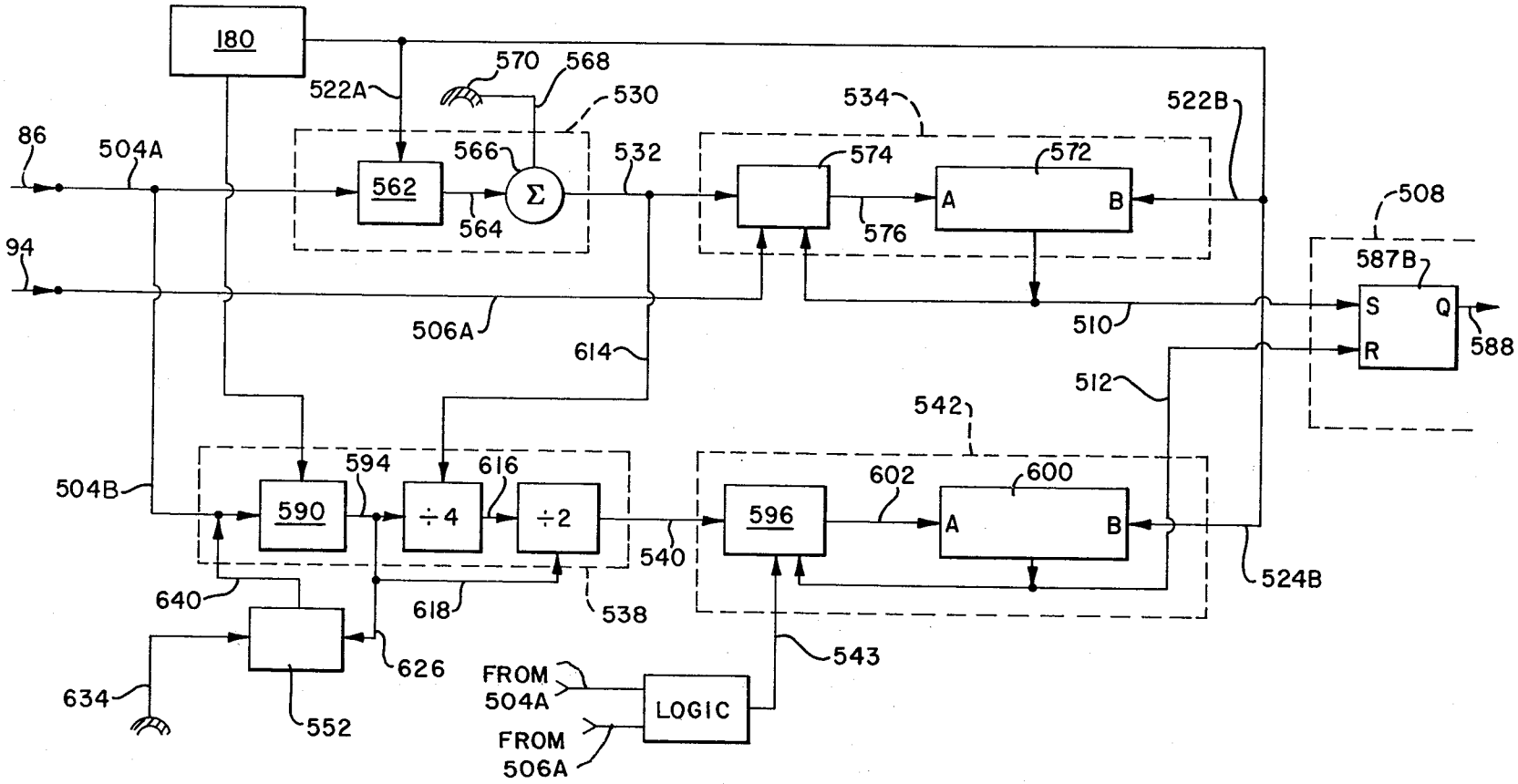
FIG. 15 is a more detailed block diagram of an ejector control arrangement in accordance with this invention.
Figure 16A:
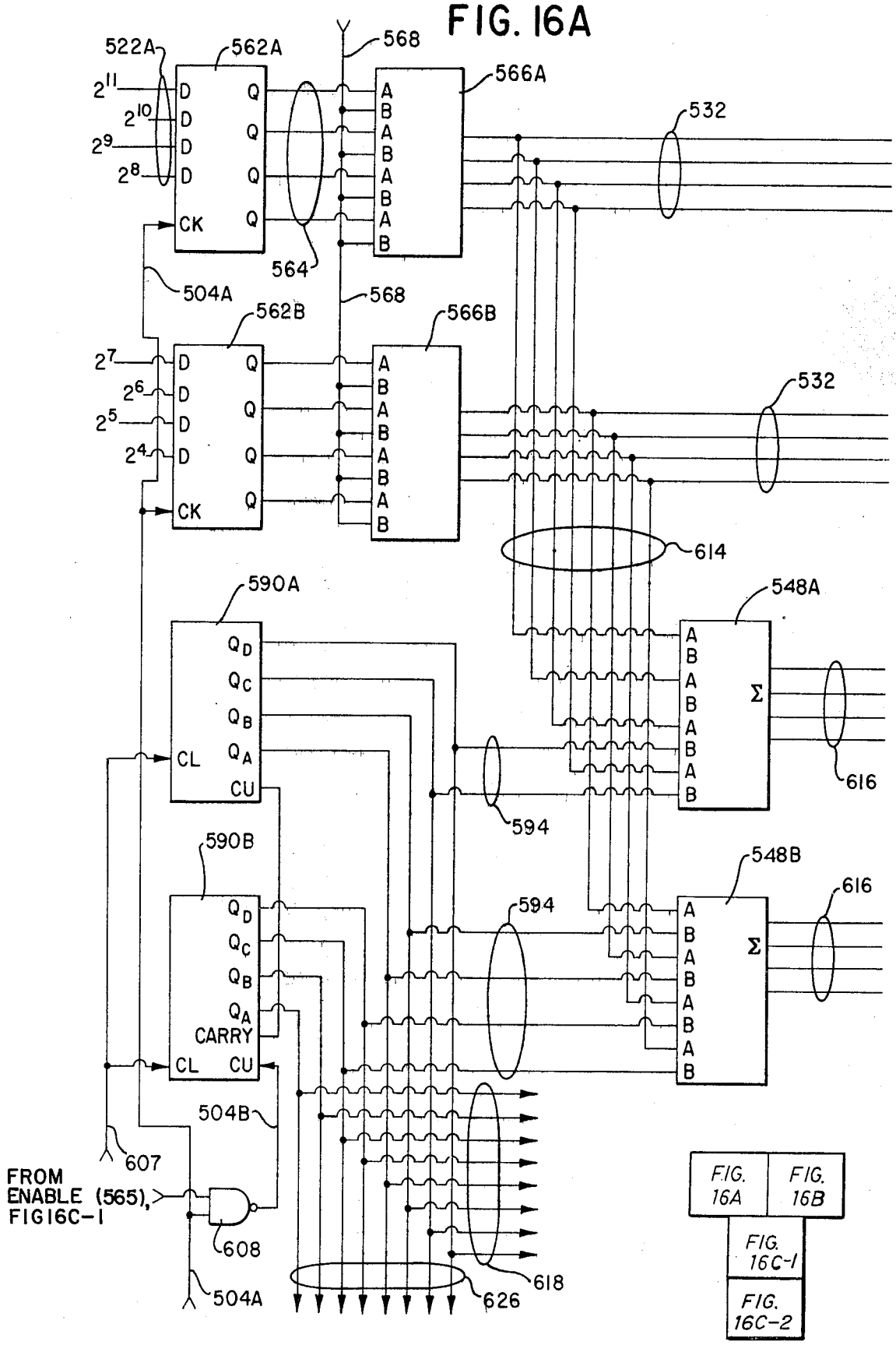
FIGS. 16A through C is a detailed schematic diagram of digital implementation of the ejector control arrangement in accordance with the functional block diagram of FIG. 15.
Figure 16B:
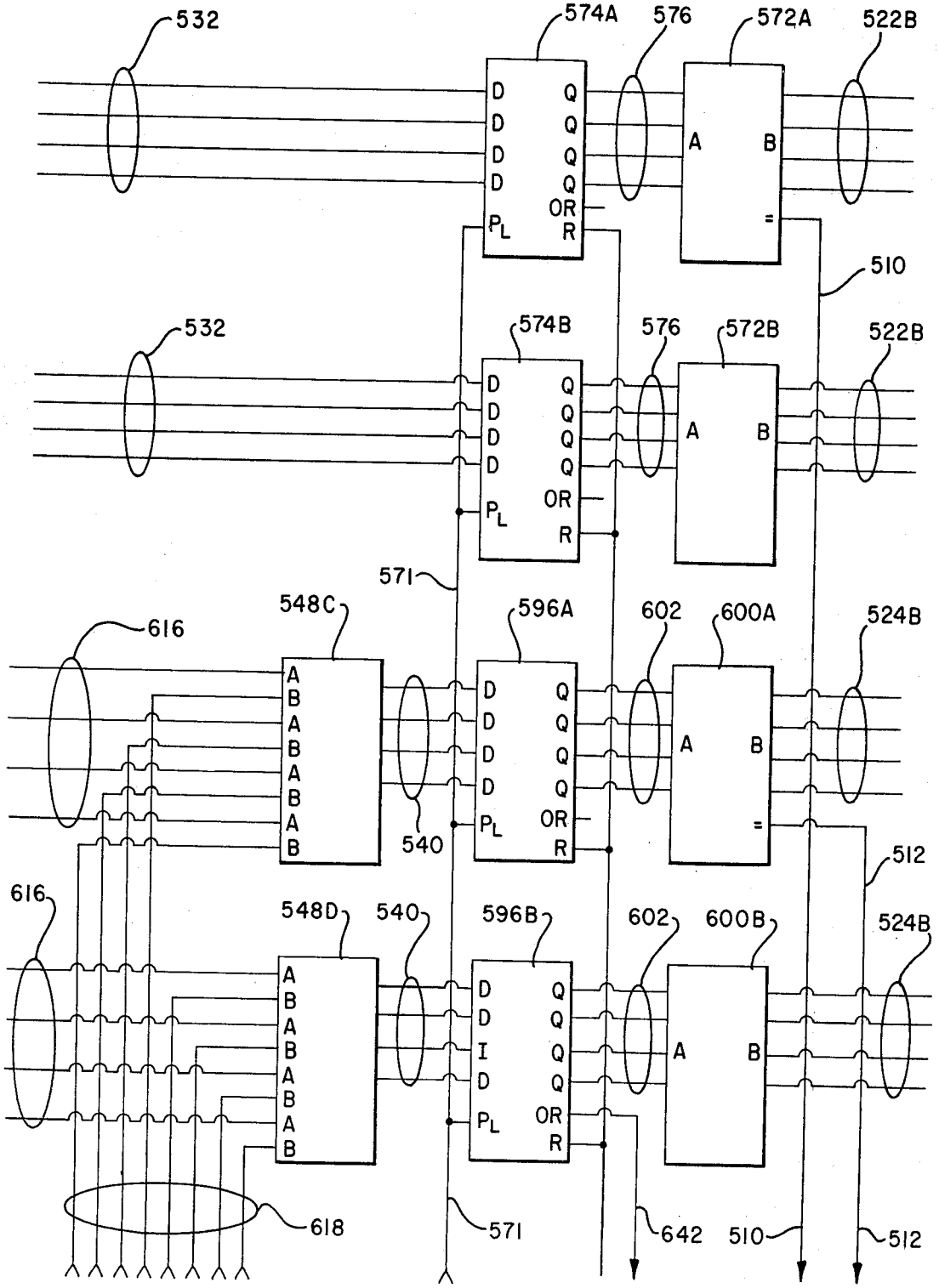
Figures 1, 16C:
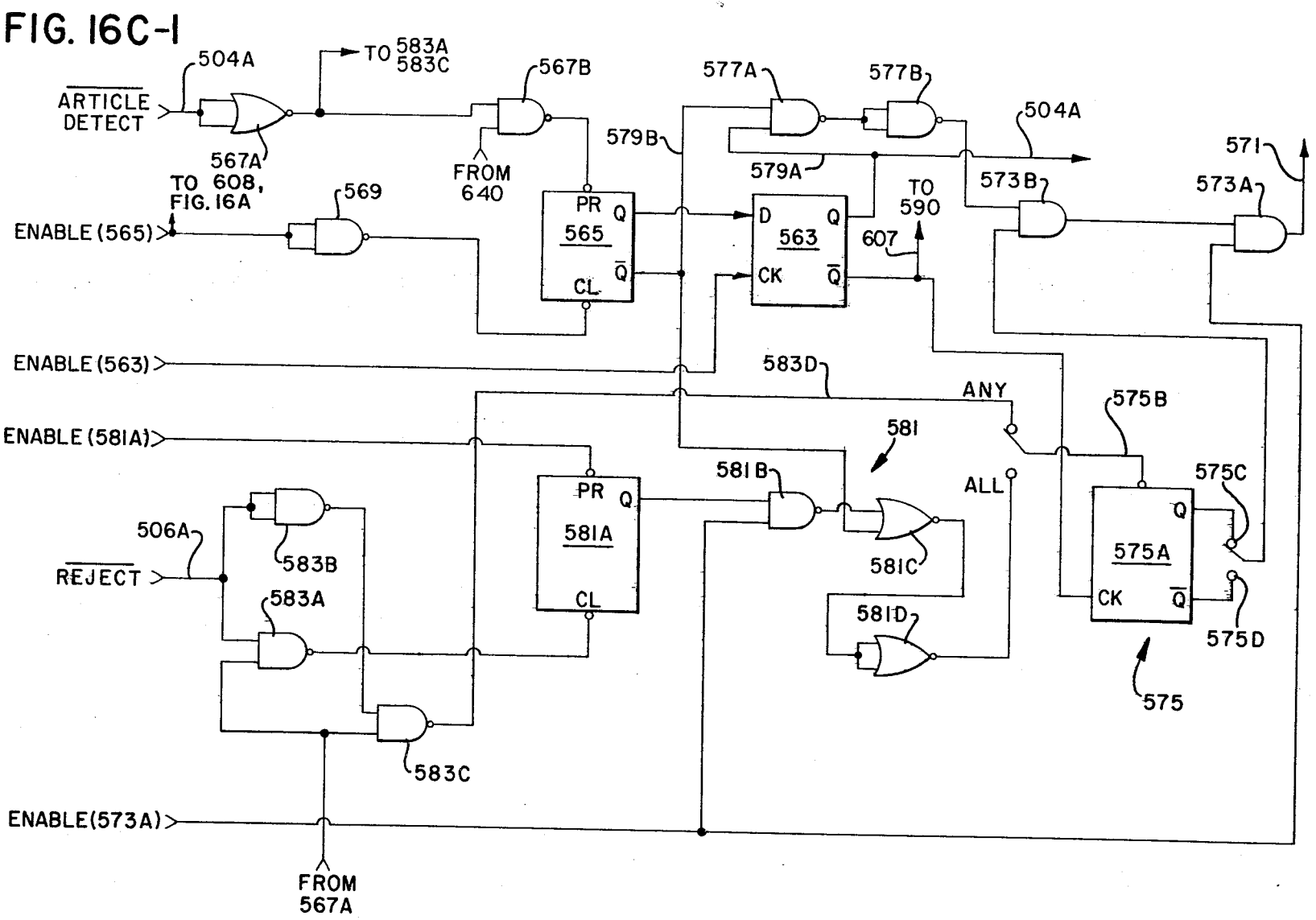
Figure 16C:
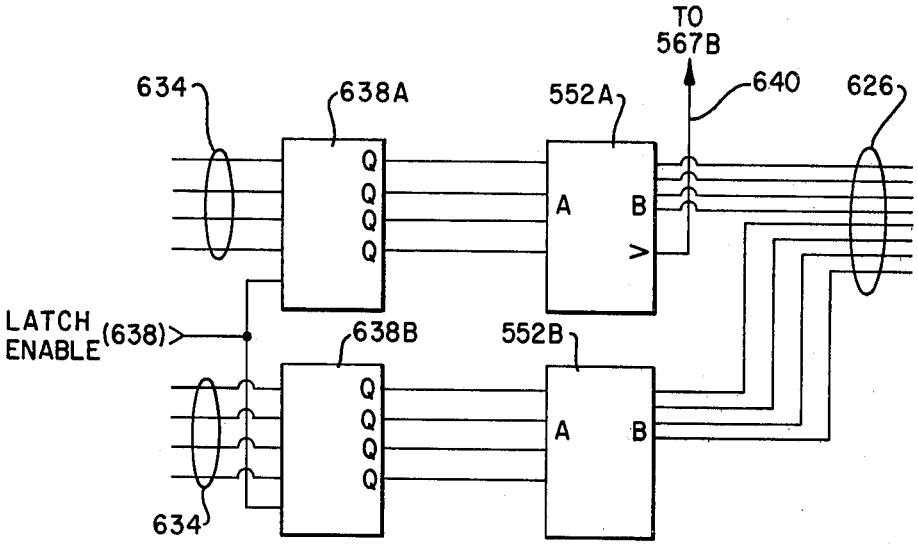

The article-detect signal on the line 86 and the articlereject signal on the line 94 are applied to an ejector control arrangement 98. The ejector control arrangement is operative to generate an electrical control signal on a line 99 to an ejector driver 100 to initiate operation of the ejector element 32. The ejector 32 responds to the control signal applied thereto on a line 101 and operates to direct an ejecting force action toward the same predetermined portion of each article being expelled from the article stream without regard to the presence on that portion of the article of the defect generating the unacceptable classification. The detailed circuit configuration of the ejector control arrangement is set forth herein (FIGS. 14 through 16).

With reference now to FIG. 5 a functional block diagram of a bichromatic sorting apparatus embodying the teachings of this invention is shown. The bichromatic sorting apparatus may, in general, be envisioned as the addition of a second "monochromatic" sorting arrangement to the system disclosed in connection with FIG. 4.

To this end, a bichromatic sorting apparatus disposes a first beam splitting element such as a dichroic mirror 102 at the output of the viewer 28. The mirror 102 is operative to bifurcate the reflected energy from an article within the viewing zone Z into first and second optical ray paths 104 and 106. If, for example, the colors upon which the bichromatic sort is being based are reflected intensities of red and green light, suitable filter elements 108 and 110 are disposed in the appropriate optical ray paths 104 and 106.

With reference to the first optical ray path 104, if it is assumed that the filter 108 acts to eliminate reflected red wavelengths, a beam of light energy is directed upon a beam splitter element 50. The beam splitter element 50, such as a half-silvered mirror, operates to generate first and second beam paths which are presented to polarizers 52 and 60 oriented as discussed in connection with FIG. 4. Photodetectors 54 ($H_G$) and 62 ($L_G$) are operative to generate electrical signals representative of the percentage of light reflectivity from the article within the viewing zone at the predetermined green wavelengths. These signals are amplified by suitable amplifier elements $H_G$ 56 and $L_G$ 64 and are presented to the output lines 66.

The second optical leg 106 contains a filter 110 adapted to eliminate green wavelengths and therefore passes reflected light at predetermined red wavelengths through a polarizer 114 oriented at 90° cross axis to the source polarizer 38. A photodetector 116 is disposed behind the polarizer 114 and is associated with a preamplifier element 118 hereinafter referred to as the preamplifier $L_R$. Due to the operation of the polarizers 38 and 114 it appears to the photodetector 116 when no article is within the viewing zone that it is viewing a background having zero percent reflectivity. The output of the preamplifier 118 is applied by one of the lines 66 to the automatic nulling arrangement 68 where all signals are appropriately nulled to eliminate the effects of electrical offset and temperature drift.

The appropriately nulled signals generated from the preamplifiers $H_G$, $L_G$, and $L_R$ are applied to a reflectivity and percentage frame fill signal generator, or "background computer" element 76. Similar to that shown in FIG. 4, the electrical circuit arrangement 76 is operative to generate electrical signal representations of the percentage of article frame fill and, when the percentage frame fill is so derived, to appropriately scale the signals representative of reflected light at the red and green wavelengths to thereby generate outputs on lines 90G and 90R respectively representative of the magnitude of the percentage of light reflecting at the predetermined green and red wavelengths. The electrical signal representative of the percentage frame fill is output from the circuit arrangement 76 and applied to the comparator element 84 on the line 82.

As mentioned above, the percentage frame fill is a quantity independent of the color of the article being sorted. Therefore, an electrical signal representation of the percentage frame fill of an article may be generated from the output signal intensities of a predetermined color of light as classified against the zero percent background and the 100% background. However, once an electrical signal representation of the percentage frame fill is generated (using either reflected light at the green or at the red wavelengths) that signal representation may be utilized to provide the signal representation of the percentage reflectivity of the article at each of the predetermined colors upon which the biochromatic sort is based. Thus, if the percentage frame fill is determined by utilizing the signal difference between the intensities of green light as classified against the zero percent and 100% backgrounds, this percentage frame fill may be used to scale both the signal representation of reflected green light as viewed against a zero percent background and the signal representation of reflected red light as viewed against a zero percent background in order to generate the signal outputs on the lines 90R and 90G.

The classifier 92 utilized in connection with the bichromatic sorting arrangement shown in FIG. 5 may take the form of a programmable memory which is addressed in accordance with the percentage reflectivities of the red and green reflected light. The memory is programmed to define a "profile" of acceptable/unacceptable articles, based upon reflectivities at each predetermined wavelength. The memory location corresponding to the appropriate address may be programmed to store an electrical signal representation of the acceptability or unacceptability of an article having reflectivity characteristics for the red and green wavelengths corresponding to the memory address.

If the addressed location indicates an unacceptable article classification, an article-reject signal is applied through the gate 96 to the line 94 and to the ejector control arrangement 98. The gate 96 is enabled by the article-detect signal output on the line 86.

Although the preferred embodiment of the invention optically defines the "backgrounds" in the manner set forth above, as seen in FIGS. 6A through 6C, other ways are available to define the reflectivities against which reflected light energy is detected. Apparatus utilizing these or other techniques are to be construed as lying within the contemplation of this invention.

For example, in FIG. 6A, two background members 120A and 120B may be physically disposed across from photodetectors 122A and 122B. The members 120A and 120B exhibit the defined reflectivity characteristics discussed above. If desired, a lens arrangement 124 may be disposed intermediate the viewing zones $Z_A$ and $Z_B$ and the photodetectors 122. Each photodetector 122 views the same predetermined portion of the article being sorted and generates an electrical signal representation of the light energy reflected therefrom against the H background (preferably 100% reflective) and the L background (preferably 0% reflective).

In FIG. 6B, a mechanically multiplexed background arrangement is defined by a rotatable cylinder 126 disposed opposite the viewer 28. The cylinder 126 rotates at a predetermined frequency to present H and L background intensities to the viewer 28 and to the signle photodetector 128 associated therewith. In FIG. 6C, the single photodetector 128 is electro-optically multiplexed by a crystalline element 130 responsive to voltage impressed thereacross to provide the desired reflectivities against which reflected light energy is detected.

AUTOMATIC NULLING ARRANGEMENT

As is well known by those skilled in the art, high gain preamplifier elements utilized for the purpose of converting low level signals presented thereto to signal levels adapted for convenient electrical manipulation by relatively standardized components are typically affected with d.c. offset and temperature drift. Such offset and drift usually cause the preamplifier output signal to deviate in an unpredictable manner from an expected output signal gain. The high gain preamplifiers $H_G$ (56), $L_G$ (64) and $L_R$ (118) shown in FIG. 5, respectively associated with the outputs of the photodetector 54 [adapted to detect reflected green light against 100% reflective (H) "background"], the photodetector 62 [adapted to detect reflected green light against a 0% (L) "background"] and the photodetector 116 [adapted to detect reflected red light against a 0% reflective (L) "background"] are no exception. Accordingly, some arrangement must be provided operative to eliminate extraneous d.c. offset and temperature drift deviations from the amplified signal outputs of the preamplifiers $H_G$, $L_G$ and $L_R$. It is for this purpose that the automatic nulling arrangement generally indicated by reference numeral 68 (FIGS. 4, 5, 7 and 8) is provided.

Different theoretical approaches must be utilized when it is desired to null preamplifiers used to amplify signals representative of reflected light energy detected by a photodetector against a background having a reflectivity characteristic outside and below the reflectivity level of the article being sorted (L backgrounds) than when nulling preamplifiers which amplify signals representative of reflected light energy detected by a photodetector against a background having a reflectivity characteristic outside and above the reflectivity level of the article (H backgrounds). Although the principles behind the former case have been set forth at length in the co-pending application of James L. Lockett, Ser. No. 874,780, filed Feb. 3, 1978, assigned to the assignee of the present invention, those principles deserve repetition at this point. Furthermore, a theoretical discussion of the situation extant in the latter case is also merited. The immediately preceding referenced application is hereby expressly incorporated by reference herein.

Figures 7A, 7B, 7C, 7D, 7E:
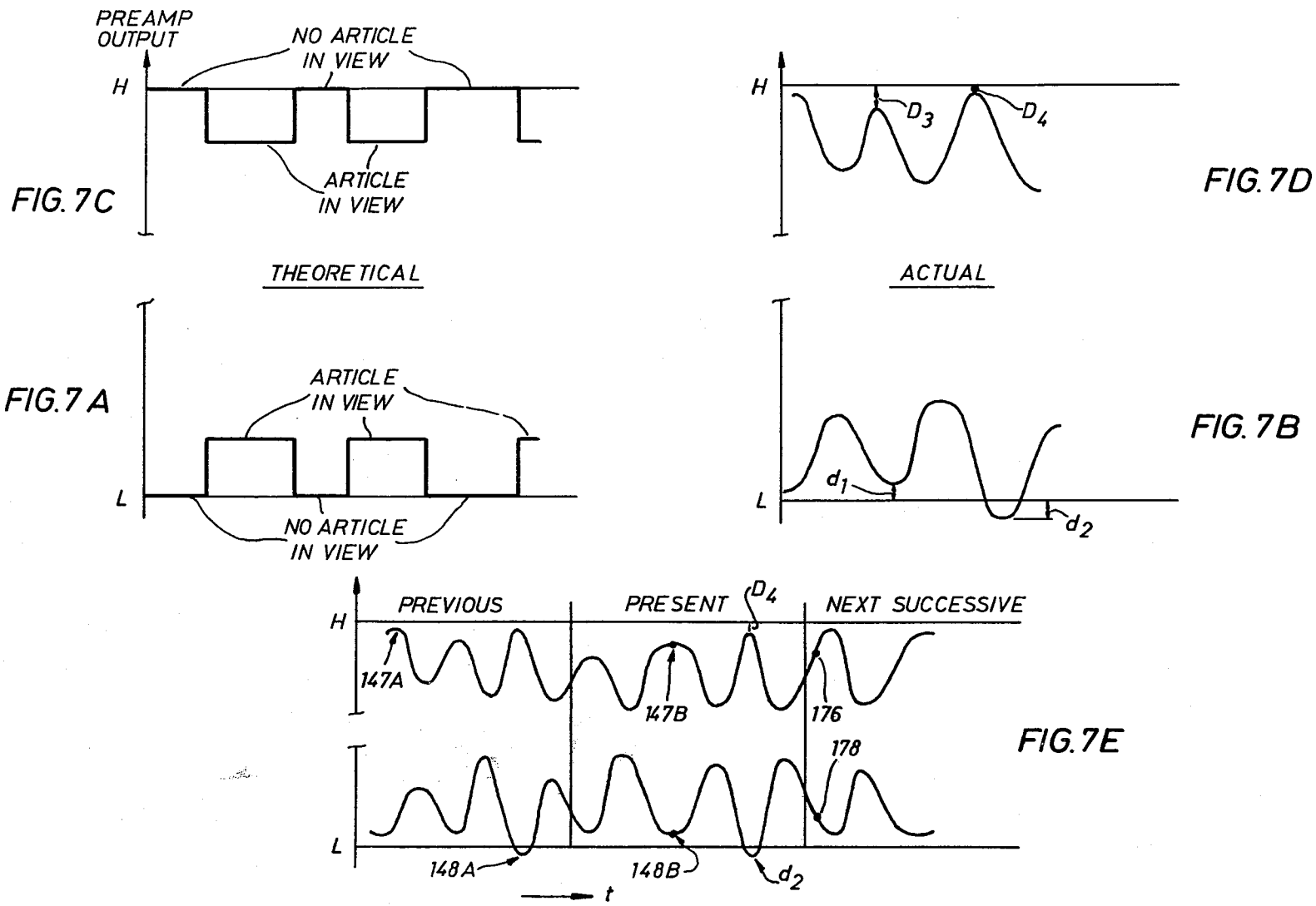
FIGS. 7A through 7E are signal representations illustrating the underlying principles of an automatic nulling arrangement in accordance with the teachings of the invention.

When a "background" member L havine a reflectivity characteristic lying outside and below the predetermined range of reflecticity characteristics of the article being sorted is utilized it has been observed that the presence of an article A within the viewing zone Z reflects light energy which generates an electrical signal from the photocells (62 in FIG. 4 and 62 and 116 in FIG. 5) that is greater than the electrical signal generated when no article is in view. This situation is graphically illustrated in FIGS. 7A and 7B which are, respectively, graphical depictions of the theoretical and actual relative signal intensities at the output of a preamplifier element associated with a photodetector which detects reflected light energy against a background having a reflectivity characteristic less than that of the article being detected when no article is in view (i.e., when light detected by the photodetector is reflected from the background) and when an article is in view. In FIG. 7A, the electrical signal output by the photodetector, when viewing the background having a reflectivity L as generated by the photodetector and as amplified by the preamplifier is indicated by reference value L. Since the reflectivity characteristic of the background L is outside and below the reflectivity characteristic of the article being sorted, when an article passes through the viewed sector light energy reflected from the article and detected by the viewer exceeds the light reflected from the background alone. Thus, the passage of an article through a viewed sector appears as a signal peak. With no article within the viewed sector, the signal output is a signal valley which, if the preamplifier had no offset or drift, equals the background value L.

However, when a preamplifier element is subjected to d.c. offset and temperature drift, bias voltage levels occur as shown in FIG. 7B. That is, offset and drift cause the signal at the output of the preamplifier 64 (in FIG. 4) or preamplifiers 64 and 118 (in FIG. 5) to deviate from the expected value of the electrical signal when the background alone is in view. These deviations are indicated on FIG. 7B by $d_1$ and $d_2$. It is readily apparent that the magnitude of the deviation $d_1$ or $d_2$ may be the instantaneous level of offset and drift of a preamplifier viewing a background having a light reflectivity characterisitic outside and below the reflectivity characterisitic of an article being sorted. (Only one of $d_1$ or $d_2$ is the magnitude of offset and drift in the preamplifier. Both are illustrated to show that it is possible to have a signal trace deviate below zero volts in the case under discussion.)

The situation is, however, completely different when the photodetector detects reflected light energy from an article against a background H which possesses a reflectivity characteristic greater than the reflectivity characteristic of the article being sorted. This situation is shown graphically in FIGS. 7C and 7D. These Figures are respectively theoretical and actual signal traces of the output of a preamplifier 56 in FIGS. 4 and 5 associated with a photodetector (as detector 54 in those Figures) adapted to detect reflected light energy against a background having a reflectivity characteristic greater than the reflectance characteristic of the article being sorted.

When no article is in view (i.e., light reflected from the background is detected by the photodetector) the theoretical signal output of the preamplifier equals a signal intensity H, representative of the reflectivity characteristic of the background. When an article passes through the zone viewed by the photodetector, light reflected therefrom generates an output signal which dips to a level representative of the reflectivity of the article until that article leaves the viewing zone. When the article exits the zone, the signal level H is restored. In the "real world" situation depicted in FIG. 7D, due to the effects of preamplifier d.c. offset and temperature drift, the preamplifier output signals do not reach the reference level H when no article is within the viewing zone. It may readily be appreciated that the magnitude of one of the deviations $D_3$ and $D_4$ represents the magnitude of the d.c. offset and temperature drift.

To summarize, in the actual situation shown in connection with FIG. 7B when the photodetector views a background having a reflectivity characteristic L lying outside and below the reflectivity characteristic of the article being sorted, the lowest signal value on the waveform is representative of the background output. (This is true whether the lowest point on the waveform is a positive number as $d_1$, or whether the lowest point on the waveform is a negative number, as $d_2$.) Thus, the largest electrical correction signal necessary to overcome the effects of d.c. offset and temperature drift in a preamplifier associated with a photodetector detecting reflected light from articles against a background having a reflectivity characteristic L outside and below the reflectivity characteristic of the articles is equal to the difference between the background signal reference L and either the lowest positive ($d_1$) or highest negative ($d_2$) signal value present at any instant during a predetermined sample time period at the preamplifier output.

However, as viewed in the signal trace shown in FIG. 7D, in the case of a preamplifier associated with a photodetector adapted to detect reflected light against a background having a background reflectivity characteristic H greater than the reflectivity characteristic of the article, the preamplifier offset and drift is equal to the difference between the reference level H and the highest positive signal value ($D_3$ or $D_4$) appearing on the waveform. (It is noted in the case depicted in FIGS. 7C and 7D that the deviation in the preamplifier output can never exceed the reference level H).

The automatic nulling arrangement in accordance with this invention utilizes the physical principles underlying the graphical relationships shown in FIGS. 7B and 7D discussed above. As seen by the dual signal trace shown in FIG. 7E, the automatic nulling arrangement 68 in accordance with this invention is operative to detect, during a predetermined sample time period, the lowest positive ($d_1$) or greatest negative ($d_2$) electrical signal value output from the preamplifier associated with a photodetector detecting light energy against a background having a reflectivity characterisitic lower than the reflectivity characteristic of the article being sorted and further, to detect the highest positive signal value ($D_4$) output from a preamplifier associated with a photodetector adapted to detect reflected light energy against a background having a reflectivity characteristic greater than the article being sorted. The lowest positive or greatest negative signal output from a preamplifier such as $L_G$ and $L_R$ and the highest positive signal value output from a preamplifier such as $H_G$, all detected during a given sample time period are stored and utilized to provide an electrical correction signal to the appropriate preamplifier output during a next-successive sample time period. and In FIG. 8, a generalized block diagram of the automatic nulling arrangement 68 in accordance with the teachings of this invention as set forth hereinabove is shown. Although the automatic nulling arrangement may be used in an analog format, the preferred embodiment (shown in FIG. 10) operates in a digital mode and, accordingly, the generalized functional block diagram of FIG. 8 will be discussed accordingly. However, it is to be understood that the principles underlying the automatic nulling arrangement of this invention may be implemented in an analog mode and lie within the contemplation of this invention.

Figure 8:
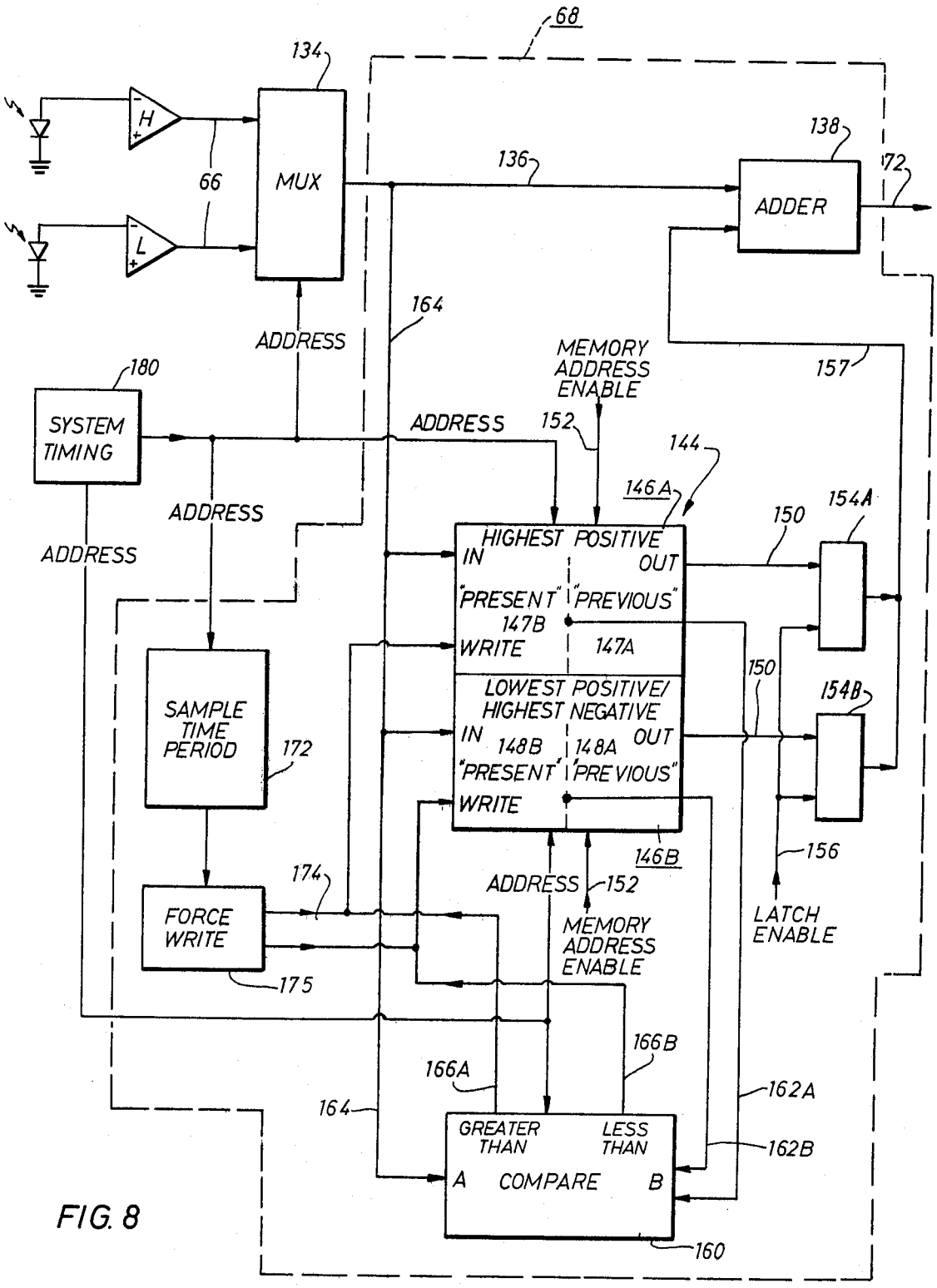
FIG. 8 is a functional block diagram of an automatic nulling arrangement in accordance with the teachings of this invention.

As shown in FIG. 8, a generalized block diagram of an automatic nulling arrangement 68 in accordance with the teachings of this invention is illustrated. The automatic nulling arrangement 68 is adapted to nullify the effects of d.c. offset and temperature drift occurring in a preamplifier element "H" associated with a photodetector detecting light energy reflected from articles against a background having a reflectivity characteristic "h" greater than the reflectivity characteristic of the article being sorted and in the preamplifier L associated with the photodetector adapted to detect light energy against a background having a reflectivity characteristic "l" less than the reflectivity characteristic of the article being sorted. In a preferred embodiment the output of the H and L preamplifiers on lines 66 are sequentially sampled by a multiplexer arrangement 134. The sequentially sampled outputs of the H and L preamplifiers are applied over a line 136 to a summing arrangement or adder 138. In the adder 138 the instantaneous signal output from the sampled preamplifier H or L is corrected by an electrical correction signal generated during the immediately previous sample time period such that an appropriately corrected instantaneous output signal appears on a line 72 for application to the remainder of the sorting apparatus circuitry.

The automatic nulling apparatus includes a memory arrangement 144 partitioned electronically or otherwise into two major divisions 146A and 146B, one adapted to store information relative to the correction factor generated from the HIGHEST POSITIVE signal output (i.e., the correction signal for the H preamplifier) and the other adapted to store information relative to the electrical correction factor generated from the LOWEST POSITIVE/HIGHEST NEGATIVE output during a given sample period (i.e., the correction signal for the L preamplifier). Furthermore, each of the memory divisions 146 is itself partitioned into a two subdivisions, or sections, 147A and 147B (for the division 146A) and 148A and 148B (for the division 146B), adapted to store correction signal information derived during the PREVIOUS sample time period (sections 147A and 148A) and to store information used to generate an electrical correction signal during the PRESENT sample time period (sections 147B and 148B). It is noted that the correction signal generated during the current sample period (stored in the PRESENT memory section of each memory division) is itself applied as the correction signal during the next-successive sample time period in a manner set forth fully herein. The memory element 144 may be addressed to either division in accordance with the same address signals used by the multiplexer 134. Furthermore, a MEMORY ADDRESS ENABLE signal on a line 152 in association with the appropriate address lines may be utilized to access storage locations in the appropriate PRESENT or PREVIOUS sections of the addressed divisions. The data output terminals of the memory 144 may be applied on lines 150 to a latch arrangement 154 itself enabled by suitable LATCH (154) ENABLE signals on a line 156. The output of the latches 154 is carried by lines 157 to the adder 138. The data output terminals of the memory 144 are applied to the B side of a comparator element 160 on a line 162A (from the section 147A) and on a line 162B (from the section 147A). The A side of the comparator element 160 is presented with the instantaneous output sampled from the multiplexer 134 on a line 164. The comparator 160 may be such as to generate an output signal when a comparison between the signals presented at the A inputs of the comparator are either greater than or less than the signals presented at the B side thereof. If the appropriate comparison is true, the WRITE terminal of the memory 144 is strobed by a WRITE ENABLE signal on a line 166A or 166B and the instantaneous data present at the input thereof is loaded into memory. A response from the comparator 160 on either the "greater than" output 166A or "less than" output 166B is selected in accordance with the preamplifier L or H being sampled in accordance with the same address line as addressing the multiplexer 134 and the memory 144. In the case of the H preamplifier, the comparator is enabled to generate an output signal on the line 166A to the WRITE terminal of the memory 144 if the instantaneous signal present at the A input is greater than the signal present at the B input. Alternatively, when the multiplexer 134 and the memory 144 locations are addressed in accordance with the address lines to sample the L preamplifier, the output of the comparator 160 is operative to generate a pulse on the line 166B to the WRITE terminal if the instantaneous signal present at the A side of the comparator is less than the signal present at the B side thereof.

In operation, the address lines enable the multiplexer 134 to sample the instantaneous H preamplifier output and present that signal on the line 136 to the adder 138. Simultaneously, the same address lines enable the first HIGHEST POSITIVE division 146A of the memory 144 (representative of the highest positive signal) and assert the "greater than" operation of the comparator 160. During the time when the H preamplifier is sampled, the MEMORY ADDRESS ENABLE line 152 first permits access to the PREVIOUS section 147A of the memory division 146A storing the electrical correction signal functionally related to the highest positive signal value detected during the immediately preceding sample time period and then permits presentation of that signal to the latch 154 associated therewith. A LATCH (154) ENABLE signal on the line 156 presents to the adder 138 on the line 157 the previously generated electrical correction signal stored in the PREVIOUS section 147A such that an appropriately nulled instantaneous electrical signal representation of the output of the H preamplifier is applied to the line 72.

With the first division 146A (HIGHEST POSITIVE) of the memory 144 still being addressed, the MEMORY ADDRESS ENABLE signal line 152 changes state to access the PRESENT section 147B of the memory division 146A and permit that section to be updated if the instantaneous sample of the H preamplifier output on the line 164 exceeds the greatest positive signal detected up to that time during the presently occurring sample time period. This is facilitated by the presentation of the highest sample taken up to that time to the B side of the comparator 160 on the line 162A for comparison with the instantaneous H preamplifier output applied to the A side thereof on the line 164. If the signal presented to the A side is greater than the signal recalled from the PRESENT section 147B of the memory applied to the B side of the comparator 160, the WRITE terminal of the memory is asserted on the line 166 and the instantaneous sample from the H preamplifier output is loaded into the appropriately addressed memory location.

When the address line to the multiplexer 134, memory 144 and comparator 160 changes state, the second major division 146B (LOWEST POSITIVE/HIGHEST NEGATIVE) of the memory 144 is addressed. That is, the memory division 146B adapted to store information relative to the lowest positive or highest negative signal (i.e., the correction for the L preamplifier) is addressed. A MEMORY ADDRESS ENABLE signal 152 then selects the PREVIOUS section 148A of the memory division 146B which stores the electrical correction signal functionally related to the lowest positive or greatest negative signal detected during the immediately preceding sample time period and applies that signal to the to the latch 154.

A LATCH (154) ENABLE signal on the line 156 applies the electrical correction signal derived from the lowest positive or highest negative output signal previously generated to the adder 138 on the line 157 such that an appropriately nulled electrical signal representation of the instantaneous output of the L preamplifier is applied to the line 72.

While the second division 146B of the memory 144 is still being addressed, the MEMORY ADDRESS ENABLE line 152 changes state to address the PRESENT section 148B of the memory division 146B adapted to store the lowest positive or highest negative preamplifier signal output sampled up to that time during the presently occurring sample time period. The lowest positive or highest negative preamplifier signal stored is applied to the B side of the comparator 160 on the line 162B. If the instantaneous signal sample applied to the A side of the comparator 160 on the line 164 is less than the lowest positive or highest negative signal sampled to that time during the presently occurring sample period, the WRITE terminal of the memory 144 is asserted by a signal from the "less than" output of the comparator 160 on the line 166B, and the instantaneous signal at the data terminals is loaded to update the PRESENT section 148B of the memory division 146B.

At the end of the presently-occurring sample time period, as determined by the sample time period signal generator 172, the data stored in the PRESENT sections 147B and 148B of each memory division 146A and 146B, respectively, is switched to the PREVIOUS section 147A and 148A. Further, to re-initialize the PRESENT section for updating during the next-successive sample time period, the FORCE WRITE pulse is applied on the lines 174 from a FORCE WRITE signal generator 175 to override the comparator outputs and to load into the PRESENT sections of the memory the instantaneous signal output from the appropriate preamplifier sampled during the initial scan of the next-successive sample time period. As viewed in FIG. 7E, the instantaneous electrical outputs of the H and L preamplifiers, indicated by reference numerals 176 and 178, respectively, are loaded into the PRESENT sections 147B and 148B of the memory 144 and updated (if appropriate) during succeeding scans in the manner discussed above.

SYSTEM TIMING

Figure 9:
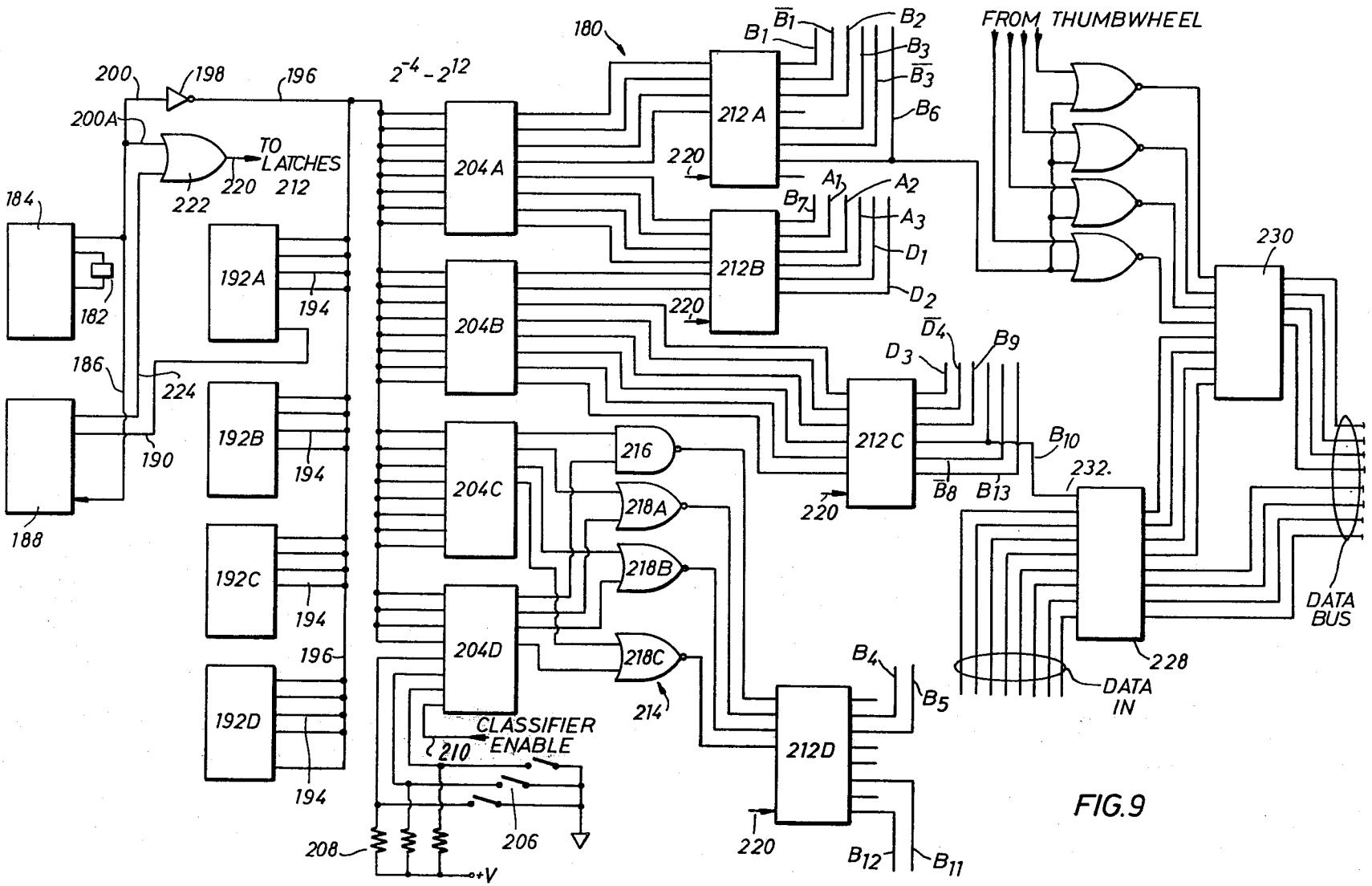
FIG. 9 is a schematic diagram of a system timing network adapted to generate system timing and enabling signals utilized in a sorting apparatus embodying the teachings of this invention.

Reference is invited to FIG. 9 wherein the electrical circuit arrangement 180 utilized to generate system clock and timing pulses used throughout the remainder of the sorting apparatus circuitry is shown.

The system timing arrangement includes a 10.24 megahertz (MHz) crystal 182 and a generator 184 such as that manufactured by Texas Instruments and sold under Model Number 74S124. The crystal generator 184 output is connected by a line 186 and clocks an up-down binary counter 188 such as that sold by Texas Instruments under Model Number 74LS193. The output of the counter 188 is applied by a line 190 to a cascaded series of similar counter elements 192A through 192D each exactly similar to the counter 188. The output lines 194 from each of the cascaded counters 192A through 192D are applied to a clock output bus 196. The output bus carries binary clock signals exhibiting binary frequencies $2^{-4}$ through $2^{12}$ as well as CARRY and CLOCK signal lines. The CLOCK signal line is derived from the output of an inverter 198 connected to an output line 200 from the generator 184. The basic frequency of the system is designated $2^0$ and has a period of 12.5 microseconds.

The outputs from the counter 192B generates timing signals $2^0$ through $2^3$ and the counter 192B may therefore be referred to as the multiplex channel timing signal generator. The counter 192A outputs binary frequencies $2^{-1}$ through $2^{-4}$ which have a frequency greater than the frequency of the basic timing signal $2^0$ and are utilized to define the 16 subdivisions, or microcycles, occurring within each of the basic multiplex channel times. Further, the counters 192C and 192D respectively provide timing signal outputs $2^4$ through $2^7$ and $2^8$ through $2^{11}$, as well as CARRY. The counters 192C and 192D output timing signals useful to regulate the scan time of the system. It will be shown that 16 multiplex channel times comprise one scan and a selected number of scans defines the predetermined sample time period for the automatic nulling arrangement.

9, read-only memories 204A, 204B, 204C and 204D, such as those manufactured by Geosource Inc. under Model Numbers 57857-8 and 57857-9, are connected to the output lines from the counters 192. The PROM's 204A, 204B and 204C are each input with binary frequencies $2^{-4}$ through $2^3$ while the PROM 204D is input with timing signals $2^0$ through $2^3$. Other of the input pins of the PROM 204D are connected to enable switches 206A, 206B and 206C which, when closed, turn off the electrical operations performed on signal outputs from viewer channel 1, viewer channel 2 and viewer channel 3. The switches 206 are normally in an open position thereby imposing a predetermined positive voltage bias through a resistor grid 208 to the appropriate input terminals of the PROM 204D. Another input pin of the PROM 204D is provided with a classifier enable signal on a line 210.

The outputs of the PROMs 204 are applied as inputs to an array of latches 212A, 212B, 212C and 212D. The outputs of the PROM's 204C and 204D are applied through a logic network 214 (including NAND gate 216, NOR gates 218A, 218B and 218C) as inputs to the latch 212D. Suitable latches 212B and 212C may be those manufactured by Texas instruments and sold under Model Number 74LS175 while the latches 212A and 212D may be those sold under Model Number 74LS174. Each of the latches 212 are clocked by a signal on the line 220 derived from the output of an AND gate 222 itself deriving its inputs from the CLOCK signal on the line 200A and from the output of the counter 188 on a line 224.

The output lines from the latches 212 provide the various timing signals to initiate electronic operations throughout the sorting apparatus. The signal lines are appropriately designated, with reference numerals as seen in FIG. 9, to correspond to the reference numerals of the timing signals shown in the system timing diagram FIG. 11.

As seen heretofore and as will be seen hereinafter there are several predetermined reference standards used for various purposes throughout the circuitry included in the preferred digital embodiment of the invention. For example, a predetermined reference signal is compared to the instantaneous percentage frame fill in the comparator 342 (FIG. 10) in order to generate an ARTICLE-DETECT signal used elsewhere in the circuitry. Further, in a monochromatic sorting arrangement predetermined reference intensities representative of a LIGHT TRIP and a DARK TRIP signal condition are utilized if the percentage reflectivity from an article exceeds or dips below these predetermined cut points. Further, as seen in connection with the ejector control 98 (FIGS. 4 and 5, 16), a predetermined reference time delay signal $t_d$ and a predetermined reference average article length signal are there utilized to generate ARTICLE-EJECT and EJECT-TERMINATION signals.

These predetermined reference signals may be manually set into the circuitry through the use of thumb wheel indicators or the like. Such reference signals may be directly connected to the appropriate comparators or circuitry utilizing them and remain within the contemplation of this invention. Alternatively, and for convenience, each of the referenced signals may be carried to its associated user circuit arrangement on a shared data bus. If this arrangement is utilized it is necessary to place on the data bus at the appropriate times the reference signals utilized by the various user apparatus throughout the circuitry. Accordingly, appropriate time signals may be provided by the timing network to enable the appropriate reference signals to be placed on the data bus and transmitted to the appropriate user circuit element at predetermined times within the system operation.

To this end, appropriate timing signals may be derived from the system timing network 180 and applied over the system data bus in accordance with the outputs of a PROM 228, such as that manufactured by Geosource Inc. and sold under Model Number 57857-7. The PROM 228 may be used to enable a multiplexer 230 to place data on the system data bus. Alternatively, the PROM 228, when addressed by inputs representative of the various references and appropriately enabled by an output 232 from the system timing network, directly places data on the system bus.

BACKGROUND COMPUTER

Referring now to FIGS. 10A–10F, a detailed schematic diagram of the circuit configuration of the reflectivity and frame fill signal generator 76 used in connection with a bichromatic sorting apparatus embodying the teachings of the invention is shown. Thereafter, in connection with the system timing diagram of FIG. 11, the sequence of operations performed by the various circuit elements is described in detail.

It was mentioned in connection with the generalized system block diagram of FIG. 5 that it is preferred to dispose three viewer elements in the same plane approximately 120 degrees apart around the article stream. Each viewer includes three photodetector transducers (FIG. 5) operative to generate electrical signal outputs representative of light energy reflected from an article within the viewing zone Z at predetermined color wavelengths, assumed for discussion to be green and red wavelengths. The green and red reflected light energy is detected against reference "backgrounds" equal to 100% and 0% reflectivity, due to the presence of the appropriately oriented polarizers within the optical viewer arrangement. Light at each color wavelength may be detected against both the 100% (the H) "background" and the 0% (the L) "background". However, as was demonstrated earlier, it is necessary for proper operation of the biochromatic apparatus to detect reflected light energy against both the H and the L "backgrounds" for only one color wavelength. With regard to the other color wavelength, reflected light energy may be detected against either the H or L "background".

Figure 10A:
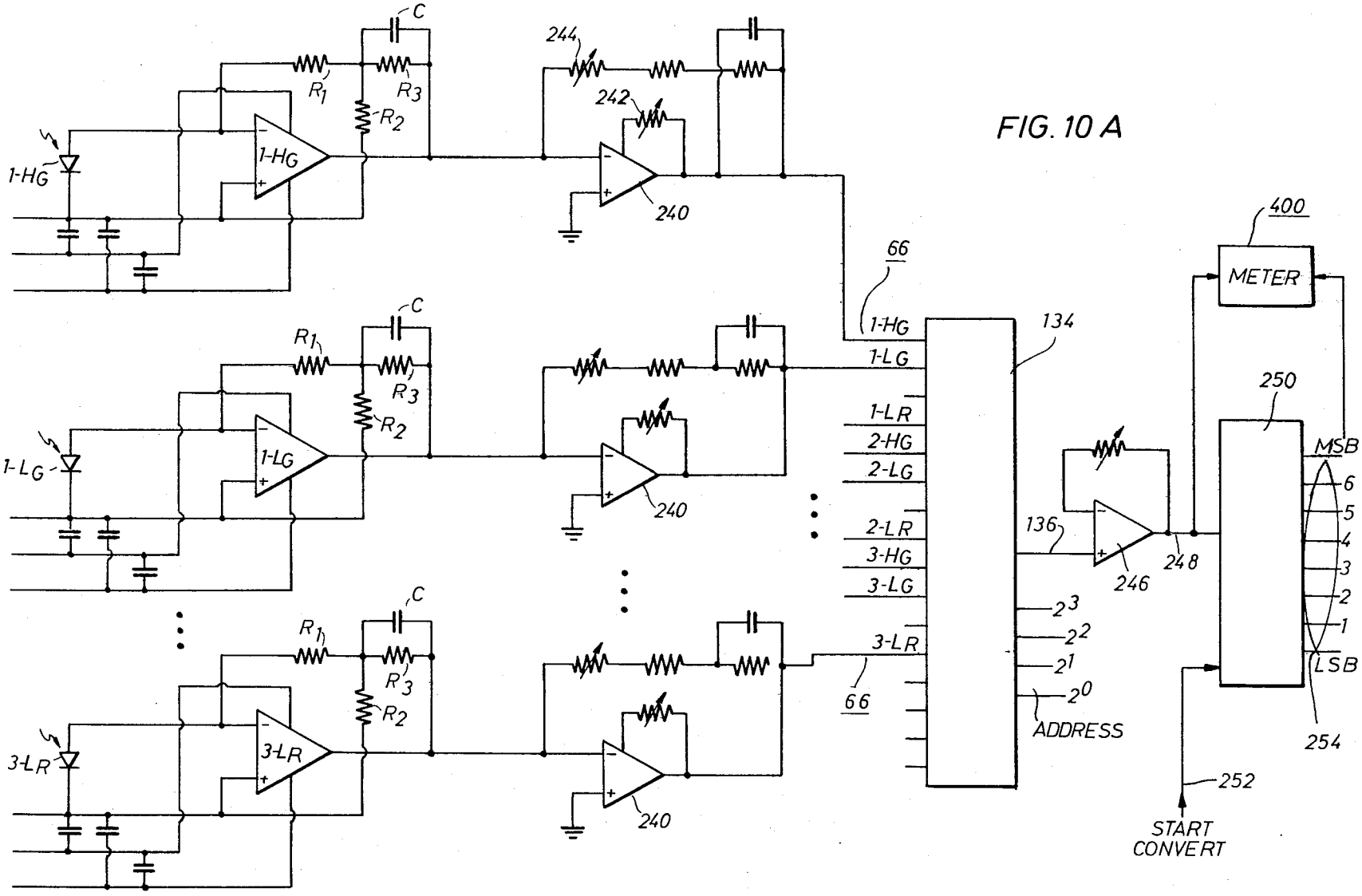
FIGS. 10A through 10F are detailed schematic diagrams of an article reflectivity and percentage frame fill signal generator and an article classifier embodying the teachings of this invention and adapted for use with the bichromatic sorting apparatus of FIG. 5.
Figures 1, 10B, 10C:
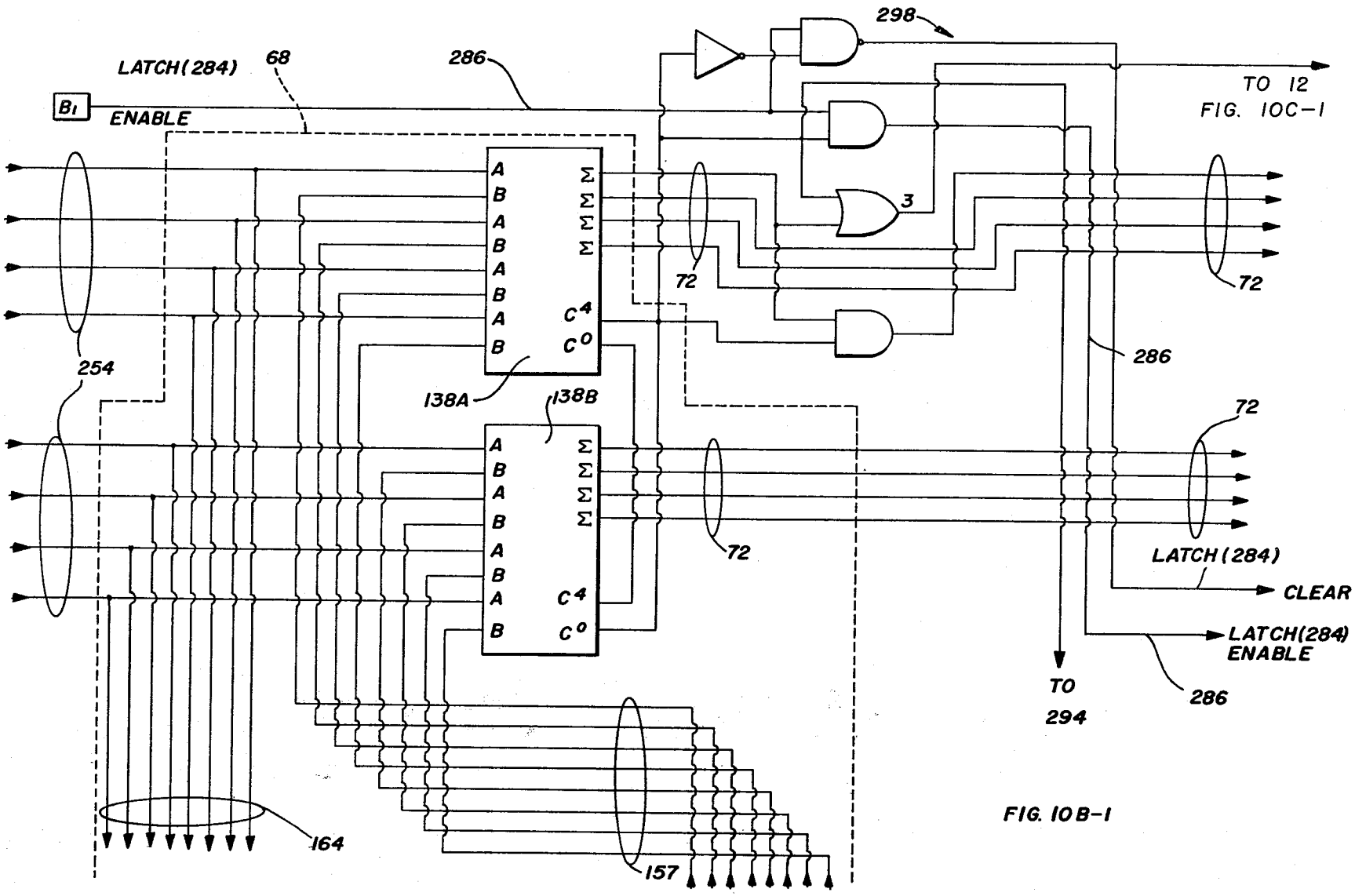

Accordingly, in FIG. 10A, each viewer element 28 includes three photodetectors: one detector adapted to generate a current signal representative of the magnitude of green light detected against the H "background", or the $H_G$ detector; a second photodetector adapted to generate a current signal representative of the magnitude of green light detected against the L "background", or the $L_G$ detector; and a third photodetector adapted to generate a current signal representative of the magnitude of red light detected against the L "background", or the $L_R$ detector. The numerical prefix "1", "2" or "3" represents the viewer element with which each detector is associated. In total, then, there are nine photodetectors each operative to generate electrical current signal representations of light at one of two predetermined color wavelengths as detected against one of two predetermined, optically generated, "backgrounds".

Each photodetector is associated with a suitable preamplifier element (as discussed) operative to convert the output current signal from the photodetectors to a voltage level. Suitable resistors and capacitive elements are arranged to adjust the gain and to match the characteristics of the photodetectors to the preamplifiers. The gain of the preamplifier is, of course, determined by the resistances $R_1$, $R_2$ and $R_3$, while the capacitor C is chosen to match the photodetector.

The output of each of the preamplifiers is tied to an appropriate low gain amplification stage 240 which includes nulling potentiometer 242 as well as an adjustable gain potentiometer 244. The appropriately amplified voltage signals representative of detected light energy at one of the predetermined color wavelengths as detected against one of the "backgrounds" H or L is applied over the array of lines 66 to the inputs of a multiplexer 134, such as that sold by Analog Devices under Model Number 7506. Of course, any suitable multiplexer unit may be utilized to sequentially sample the signals present on the lines 66. The multiplexer 134 is stepped in accordance with binary clock pulses at binary frequencies $2^0$ through $2_3$. These and other binary clock frequencies are generated by the system timing arangement shown in detail in FIG. 9.

Figure 11:
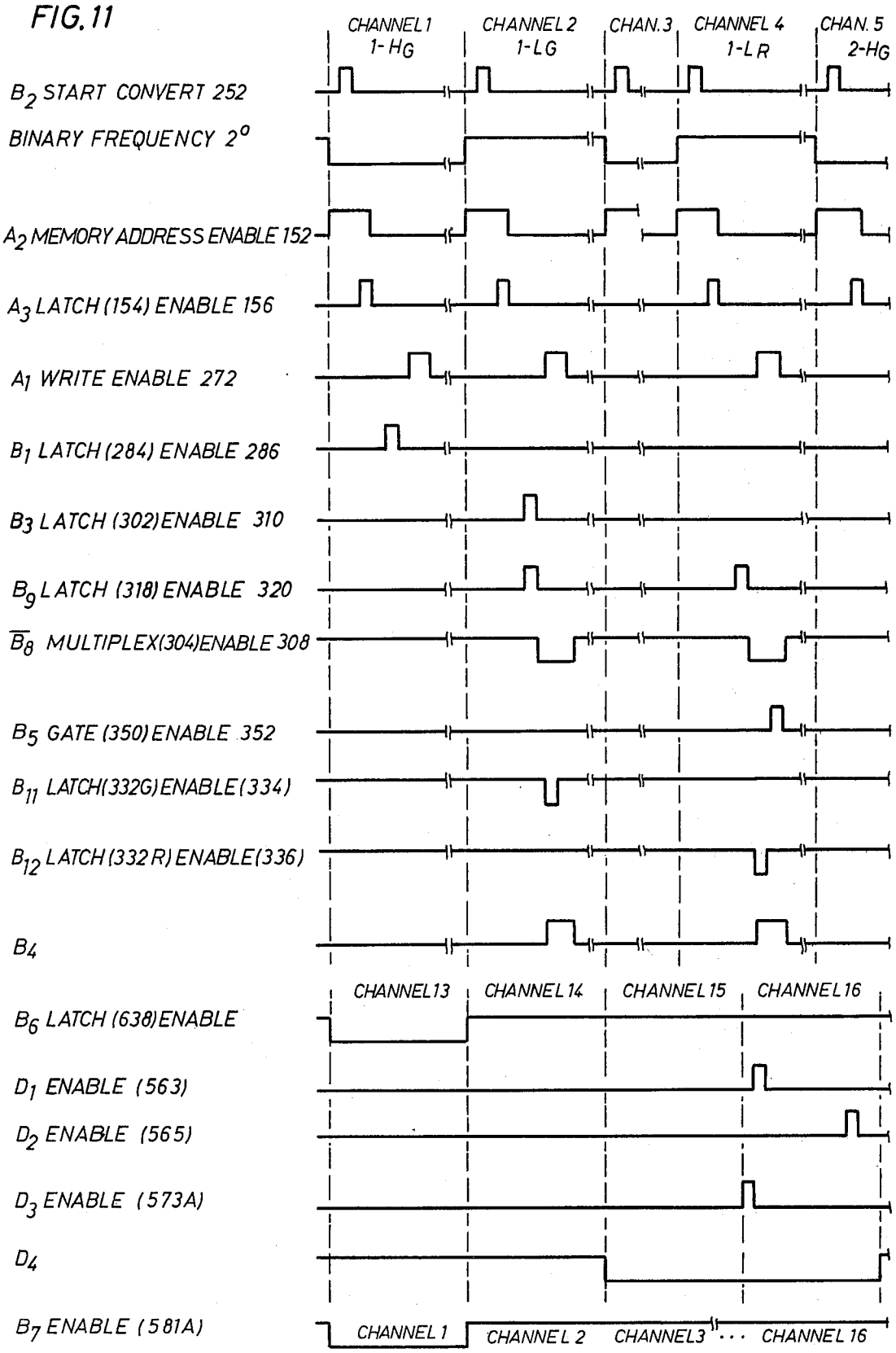
FIG. 11 is a timing diagram for the circuit of FIG. 10.

The nine output signals from the amplifiers 240 are sampled in a predetermined sequence and sequentially presented at the output line 136 of the multiplexer 134. For a purpose to be made clear herein in connection with the detailed discussion of the automatic nulling arrangement, the signal outputs corresponding to the photodetectors 1-$H_G$, 2-$H_G$ and 3-$H_G$ are sampled during a channel time when the state of the binary frequency signal $2^0$ is the same. Typically, this is a logic low state (FIG. 11).

The basic multiplex channel time during which each of the outputs on the lines 66 is sampled is governed by the frequency of $2^0$. Preferably, the basic channel time is 12.5 microseconds. Each multiplex channel time (as defined by $2^0$) is itself subdivided into sixteen subdivisions, or "microcycles" in accordance with the binary frequencies $2^{-4}$, $2^{-3}$, $2^{-2}$ and $2^{-1}$. A complete "scan" of all nine data channels on the lines 66, as well as necessary space channels and dead time, occupies 200 microseconds. That is, during each second, the multiplexer "scans" all nine input channels five thousand times.

The sampled signals on the output line 136 from the multiplexer 134 are presented to the non-inverting input of an amplifier 246 where the signals are amplified and applied by a line 248 to the input terminal of an analog-to-digital converter 250. The converter 250 operates in response to an enabling signal START CONVERT presented on a line 252 to convert the analog voltage information input thereto into an eight-bit digital representation on the array of output lines 254. A suitable analog-to-digital converter is that manufactured by Burr-Brown and sold under Model Number ADC82. Due to the peculiarities of the analog-to-digital converter used in the preferred embodiment, the output signals on the array of output lines 254 appear as if multiplied by a negative one (−1). The output of the converter 250, then, may be viewed as the complement of the true converted output.

As is discussed in more detail herein, a meter control network 400 (FIG. 19) is provided in operative association with the converter 250.

The output of the analog-to-digital converter 250, appropriately inverted due to the action of the converter, is applied to the appropriate inputs of a digital summing arrangement 138 which forms a portion of a digital automatic nulling arrangement 68 in accordance with the invention. The summing arrangement 138 includes first and second digital adders 138A and 138B which are presented at the "A" inputs with the digital signal representation of the instantaneously sampled preamplifier output and at the "B" inputs on an array of lines 157 with the appropriate correction factor being applied to correct for amplifier d.c. offset and temperature drift during the predetermined sample period under consideration. Suitable adders include those manufactured and sold by Texas Instruments under Model Number 74LS83.

The automatic nulling arrangement 68 includes the memory arrangement 144 having first and second random-access memory elements 144A and 144B therein. The memory arrangement 144 is divided into first and second memory divisions (FIG. 8) respectively utilized to generate the appropriate electrical correction signal for preamplifiers associated with photodetectors viewing articles against background intensities above and below the article reflectivities. The first and second memory divisions relate to HIGHEST POSITIVE (used to null H preamplifiers) and LOWEST POSITIVE/HIGHEST NEGATIVE (used to null L preamplifiers) as discussed in connection with FIG. 8. Each of the divisions of the memory elements 144A and 144B are themselves partitioned into PREVIOUS and PRESENT sections. The PREVIOUS section stores the correction signal generated during the immediately preceding, or "previous" sample time period which is applied to the adders 138 to obviate preamplifier offset and drift during the presently occurring sample time period. The PRESENT section stores information used to update the greatest positive or lowest positive/highest negative signal detected during the presently occurring sample time period. This is used to generate the correction signal to be applied during the next-successive sample time period.

The correction signals applied to the adders 138 in certain instances (with $2^0$ low) are functionally related to the greatest positive signal magnitude detected and stored during the preceding sample time period and are used to correct for temperature drift and d.c. offset in the amplifiers associated with photodetectors 1-$H_G$, 2-$H_G$ and 3-$H_G$ viewing "backgrounds" having reflectivities greater than the reflectivity of the article being sorted. At other times, (with $2^0$ low) the correction signals applied to the adders 138 are functionally related to the lowest positive or highest negative signal sampled during the previous sample period and applied to correct d.c. offsets and temperature drifts in amplifiers 1-$L_G$, 1-$L_R$, 2-$L_G$, 2-$L_R$, 3-$L_G$ and 3-$L_R$ associated with photodetectors viewing "backgrounds" having reflectivity characteristics less than those of the articles being sorted. Suitable memory elements are those manufactured by Texas Instruments and sold under Model Number 2101.

The output lines 254 from the converter 250 are applied to the data input terminals of the memory 144 by an array of lines 164. The partitioning of the memory 144 into the two major divisions and the sectioning of each division into PREVIOUS and PRESENT sections are controlled by suitable timing pulses input to the memory address terminals $A_0$ through $A_3$. The memory address pulses are derived from the same system timing signals $2^0$ through $2^3$ used to step the multiplexer 134. The memory address pulses are conditioned by an enabling signal input to the address terminal $A_7$ on a line 264 from a multiplexer 266. One input to the multiplexer 266 is derived from a MEMORY ADDRESS ENABLE signal (152) output from the system timing. The other input to the multiplex arrangement 266 is derived from the output line 267 from the localized sample time period generator 172, as applied through an inverter 268. The sample time signal generator 172 derives its inputs from address lines $2^4$ through $2^{11}$.

The data output terminals of the memory elements 144 are connected by lines 150 to the "A" inputs of latch elements 154A and 154B which form a latch arrangement 154. Suitable latches are those manufactured by Texas Instruments and sold under Model Number 74LS175. The latch arrangement 154 is enabled by a LATCH (154) ENABLE signal from the system timing network on a line 156. The Q outputs of the latch arrangement 154 (owing to the inversion of the signals by the components selected to practice the invention) apply the appropriate correction signals to the appropriate terminals of the adders 138A and 138B through the lines 157.

The output from the memory is also applied by lines 162 to the "B" side of comparator elements 160A and 160B, such as those manufactured by Texas Instruments and sold under Model Number 74LS85. The "A" side of the comparators 160 are connected to the data output lines 254 from the converter 250 by lines 164.

The WRITE terminals of the memory elements 144 are connected to an output line 268 from a gate 270. The gate 270 derives one input from a WRITE ENABLE line 272 from the system timing. Another input to the gate 270 is derived from an output line 273 leading from a multiplexer arrangement 274. The multiplexer 274 is operative in response to the sample time signal generator output 174 to place a FORCE WRITE signal on the line 273 (and through the gate 270 to the line 268) during the first scan through all channels occurring immediately after the start of each next-successive sample time period.

The localized timing arrangement 172 responsive to the binary frequencies $2^4$ through $2^{11}$ includes a binary counter 278 and a logic arrangement 280 associated therewith and is operative to generate a FORCE WRITE pulse on the line 174 during selected scans. The system is operative to override the results of the comparison to force-write into each appropriately addressed memory location the actual signal value present at the output of the converter during scan 512, 1024, 2048 or 4096, as selected by the operator. It is recalled that each scan time through all nine channels plus system dead time equals 200 microseconds. Thus, the selection of the appropriate scan defines the system sample time for automatic nulling purposes and forces an initialization of the automatic nulling arrangement at the end of each sample time period.

An operation of the automatic nulling arrangement 68 is discussed in full detail in connection with the system timing diagram shown in FIG. 11.

The output of the digital adders 138 is applied by an array of lines 72 to the data input terminals of latches 284A and 284B. The latches 284 are enabled by a LATCH (284) ENABLE signal on a line 286 from the system timing. Suitable latches 284 are those manufactured and sold by Texas Instruments under Model Number 74LS83. The inverted data output terminals of the latches 284 are connected by lines 288 to digital adders 290A and 290B, such as those manufactured and sold by Texas Instruments under Model Number 74LS83.

The outputs of the digital adders 138A and 138B are also applied by an array of lines 292 through a normally open gating array 294 and an array of lines 296 to the adders 290. The gating array 294 is operative in response to an error condition network 298 provided to insure against error conditions in the adders 138 and elsewhere in the system. With the lower inputs to the gates 294 in a logic low state, the signal inputs to the upper inputs of the gates 294 pass therethrough. However, if an overflow in the adders 138 should occur, the lower inputs to the gates 294 goes to a logic high state, forcing the outputs of the gates 294 to a level consistent with the background reflectivity against which the photodetectors are being nulled.

The outputs of the adders 290A and 290B are applied to latches 302A and 302B, the non-inverted data outputs of which are applied to the "A" inputs of multiplexers 304A and 304B. The latches 302 are those manufactured and sold by Texas Instruments under Model Number 74LS175, while suitable multiplexers 304 may be those manufactured and sold under Model Number 74LS158 by Texas Instruments. The outputs of the gates 294 are applied by an array of lines 306 to the "B" inputs of the multiplexer 304. The multiplexer 304 is enabled by a MULTIPLEX (304) ENABLE signal on a line 308 from the system timing network while the latches are enabled by a LATCH (302) ENABLE output from system timing on a line 310.

The inverted outputs of the multiplexer 304 are connected by an array of lines 312 to a programmable read-only memory adapted to provide the logarithm of the number presented thereto. This is referred to as log-PROM 314. A suitable device is manufactured and sold by Geosource Inc. under Model Number 57857-5. The output of the log-PROM 314 is connected by an array of lines 316 to latches 318A and 318B, similar to those used hereinbefore. The inverted outputs of the latches 318, when enabled by the LATCH (318) ENABLE signal on the line 320 from the system timing network, are applied to digital adders 322A and 322B, similar to those used above. Also, the outputs from the log-PROM 314 are directly connected by an array of lines 324 to the adders 322. The output of the adders 322 is connected by an array of lines 325 to an anti-logarithmic programmable read-only memory (anti-log PROM) 326 operative to generate an electrical signal output equal to the antilogarithm or exponential of a logarithmic sum presented thereto from the adders 322. A suitable anti-log PROM is that manufactured and sold by Geosource Inc. under Model Number 57857-6. The output lines 328 from the anti-log PROM 326 are applied over an array of lines 330G and 330R to latches 332G and 332R, respectively. The latch 332G is enabled by a LATCH (332G) ENABLE signal on a line 334 while the latch 332R is enabled by a LATCH (332R) ENABLE signal on a line 336, both being derived from the system timing network.

The output from the multiplexer 304 is also applied by an array of lines 82 to the "A" inputs of a digital comparator arrangement 84. The "B" side inputs of the comparator arrangement 84 are provided with a predetermined reference representative of a predetermined frame fill value on lines 87. The signals on the lines 87 may be derived directly from a suitable thumbwheel 88 or by connection and enablement of the system data bus. Once the multiplexer 304 samples and inverts the signals representative of the green light as detected against the H and L "backgrounds", i.e., generates the quantity $1-(H_G-L_G)$ representative of percentage frame-fill, the comparator 84 generates an output signal on the line 349 to a gate 350 if the percentage frame fill exceeds the predetermined threshold frame fill reference signal on the lines 87. This action is used to define an ARTICLE-DETECT condition on an output line 86. The gate 350 is enabled by a GATE (350) ENABLE signal output from the system timing network on the line 352.

At the end of the fourth channel time, information relative to percentage frame-fill and percentage reflectivity at green and red wavelengths from the first viewer are presented and applied to the classifier arrangement 92. In the case of a bichromatic sort, the signal representation of the first color reflectivity generated (in the case discussed, green light reflectivity) is stored in the latch 332G until the second color reflectivity value is also generated. The storage element 332G is enabled by the LATCH (332G) ENABLE signal on the line 334 and passes, along with the information relating to the second color reflectivity latched through the latch 332R in response to the LATCH (332R) ENABLE signal on the line 336 to the classifier 92. The ARTICLE-DETECT signal is gated through the gate 350 to the line 86 in response to a GATE (350) ENABLE signal on the line 352. The process repeats for the second and third viewers during channel times five through eight and nine through twelve, respectively.

Of course, it is appreciated that the monochromatic embodiment of the invention may use a similar circuit configuration. Since the monochromatic arrangement utilizes reflectivity of only one color against the H and L backgrounds, it is operative in a manner substantially consistent with the discussion of channels one and two.

Operation

Having described the preferred circuit configuration of a bichromatic sorting apparatus in accordance with the preferred embodiment of the invention, the operation thereof may be understood by reference thereto in connection with the signal timing diagram shown in FIG. 11 of the drawings.

Figure 10:
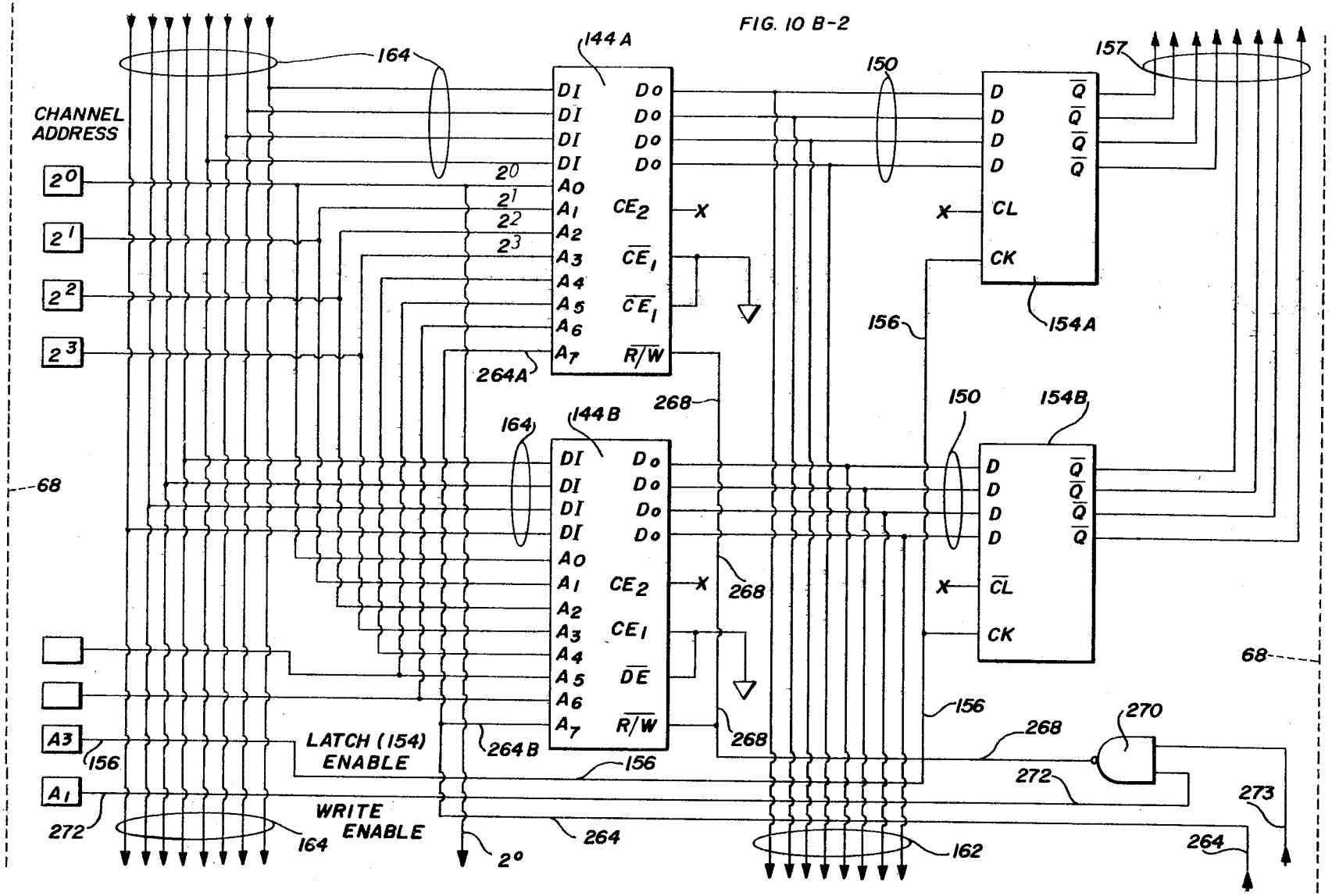
Figures 3, 10B:
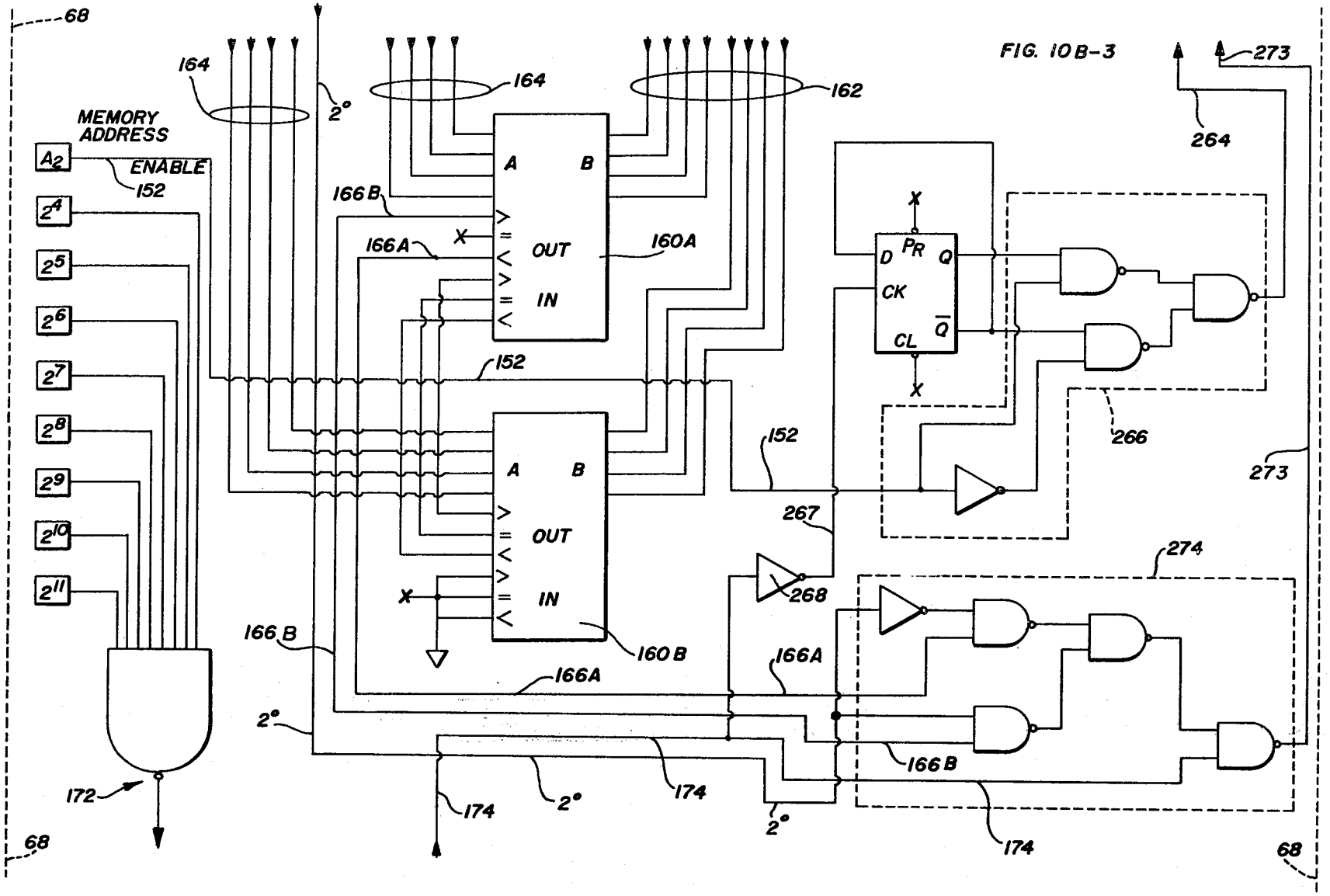
Figures 4, 10B:
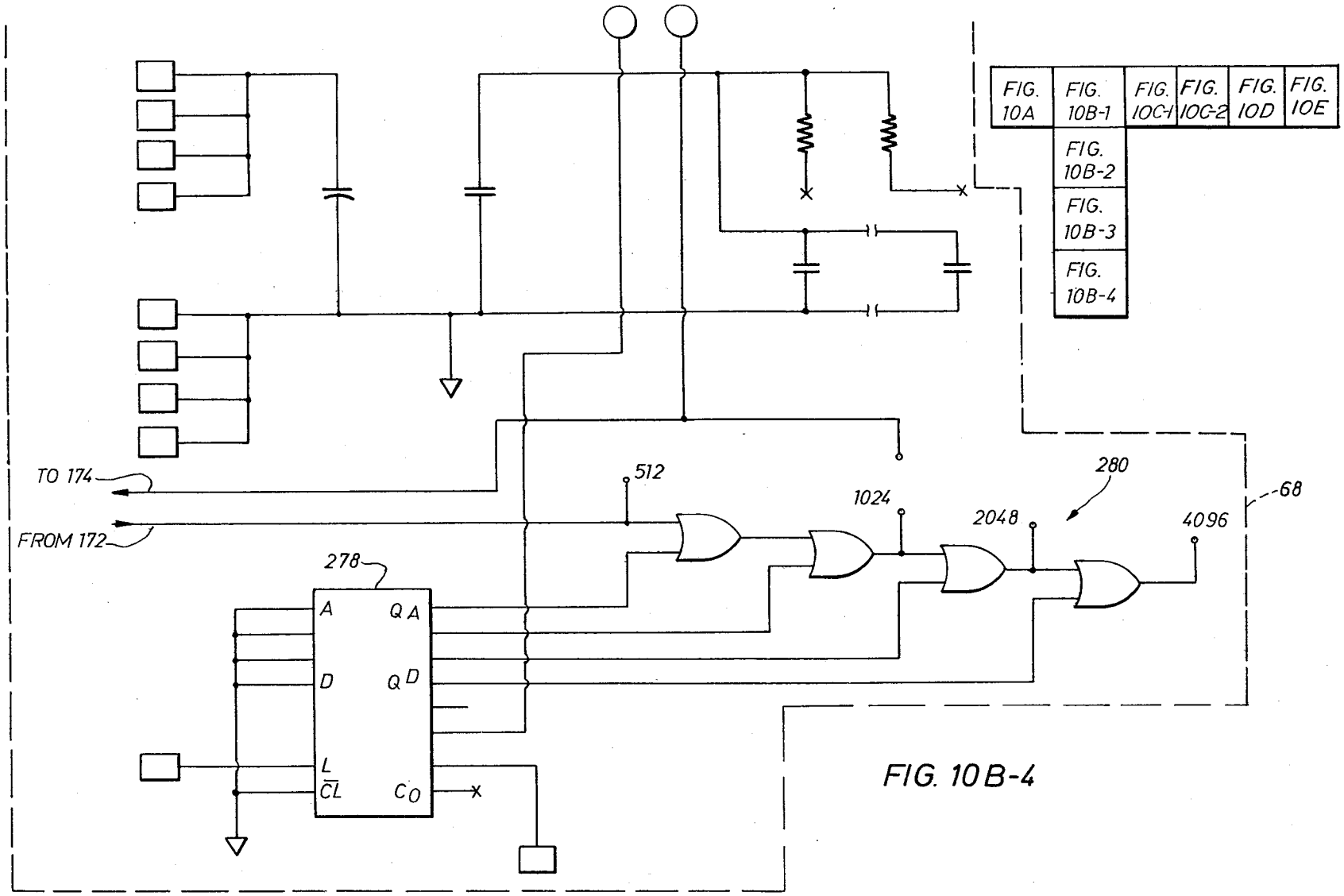
Figures 1, 10C:
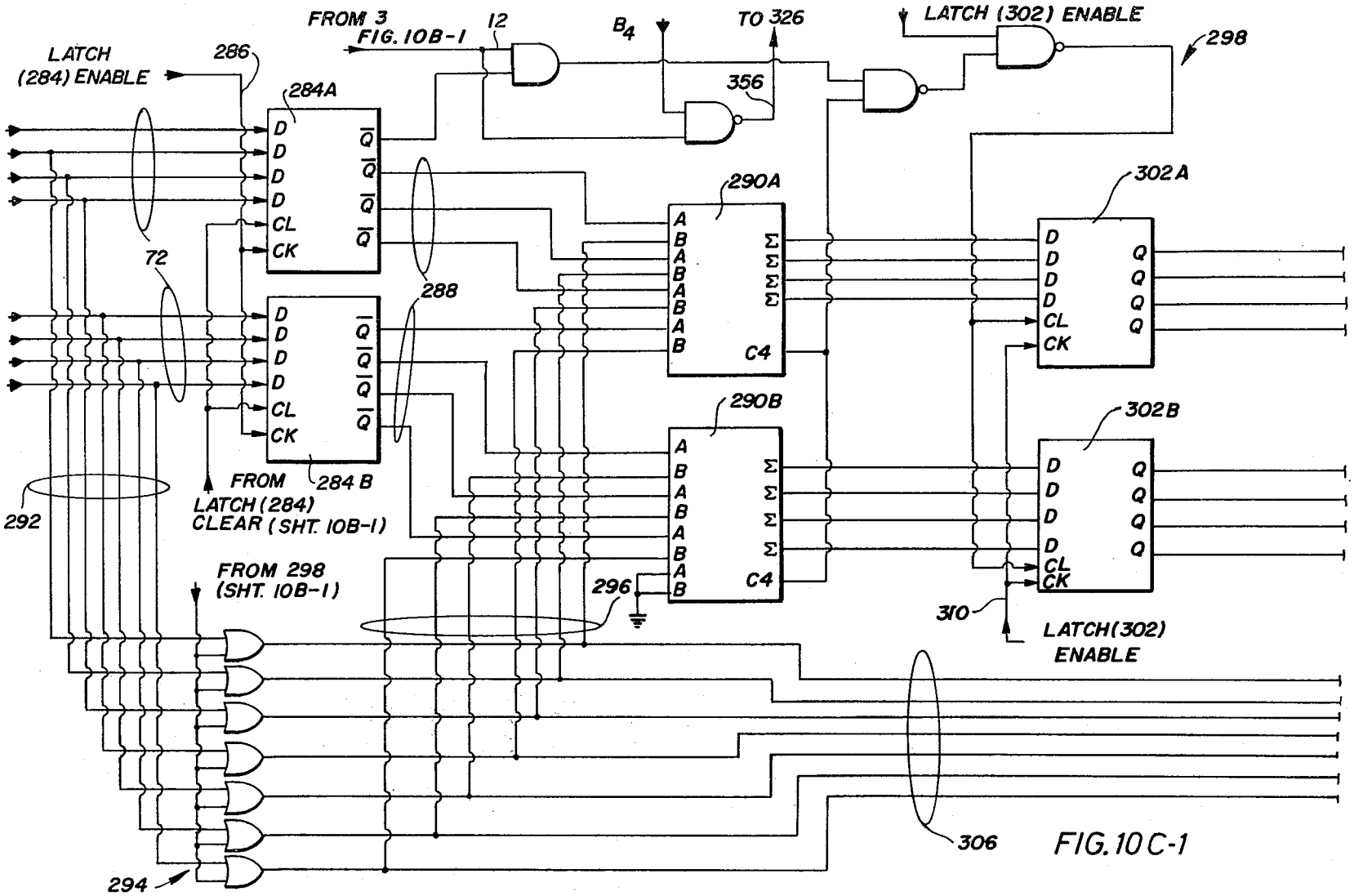
Figure 10:
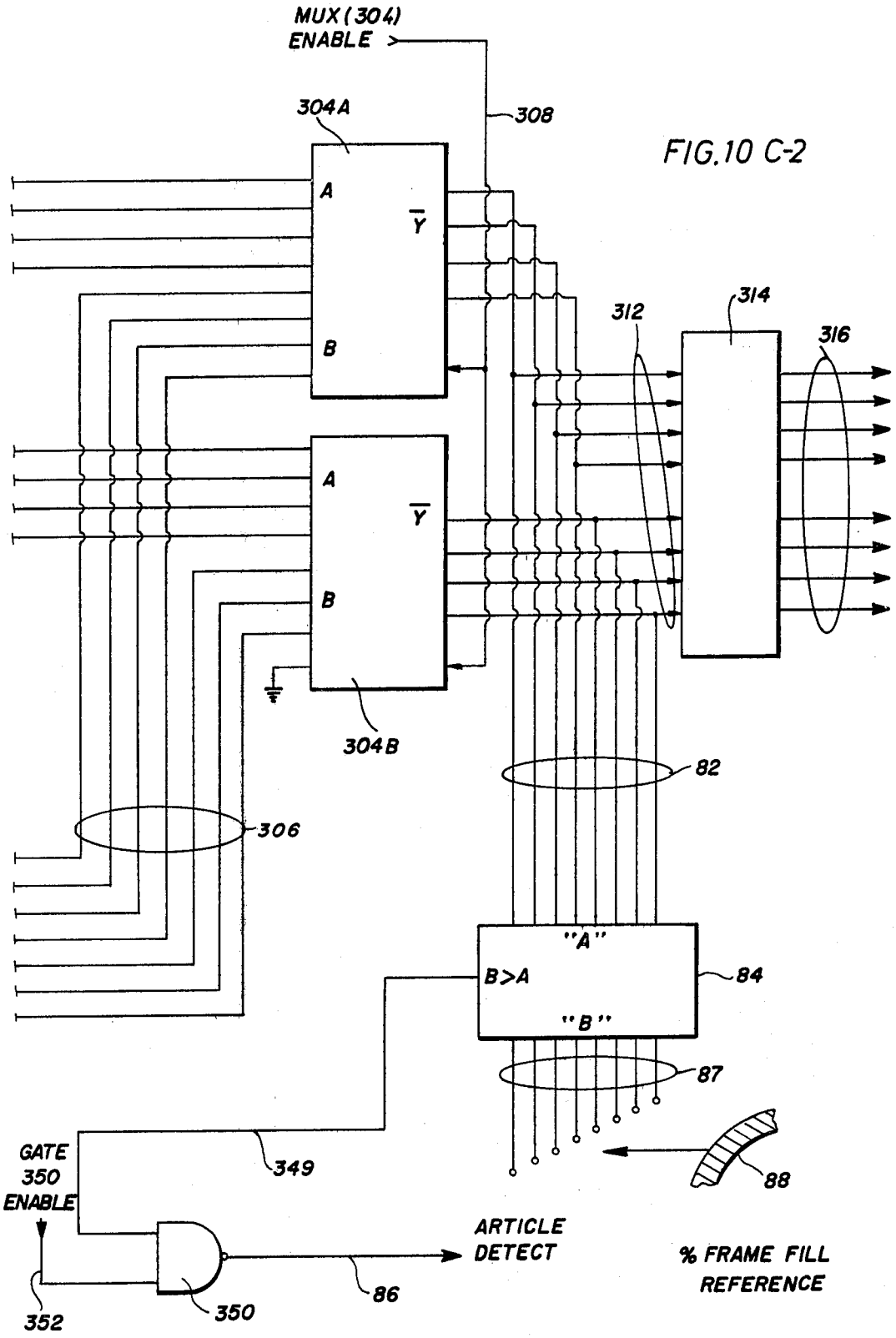
Figure 10D:
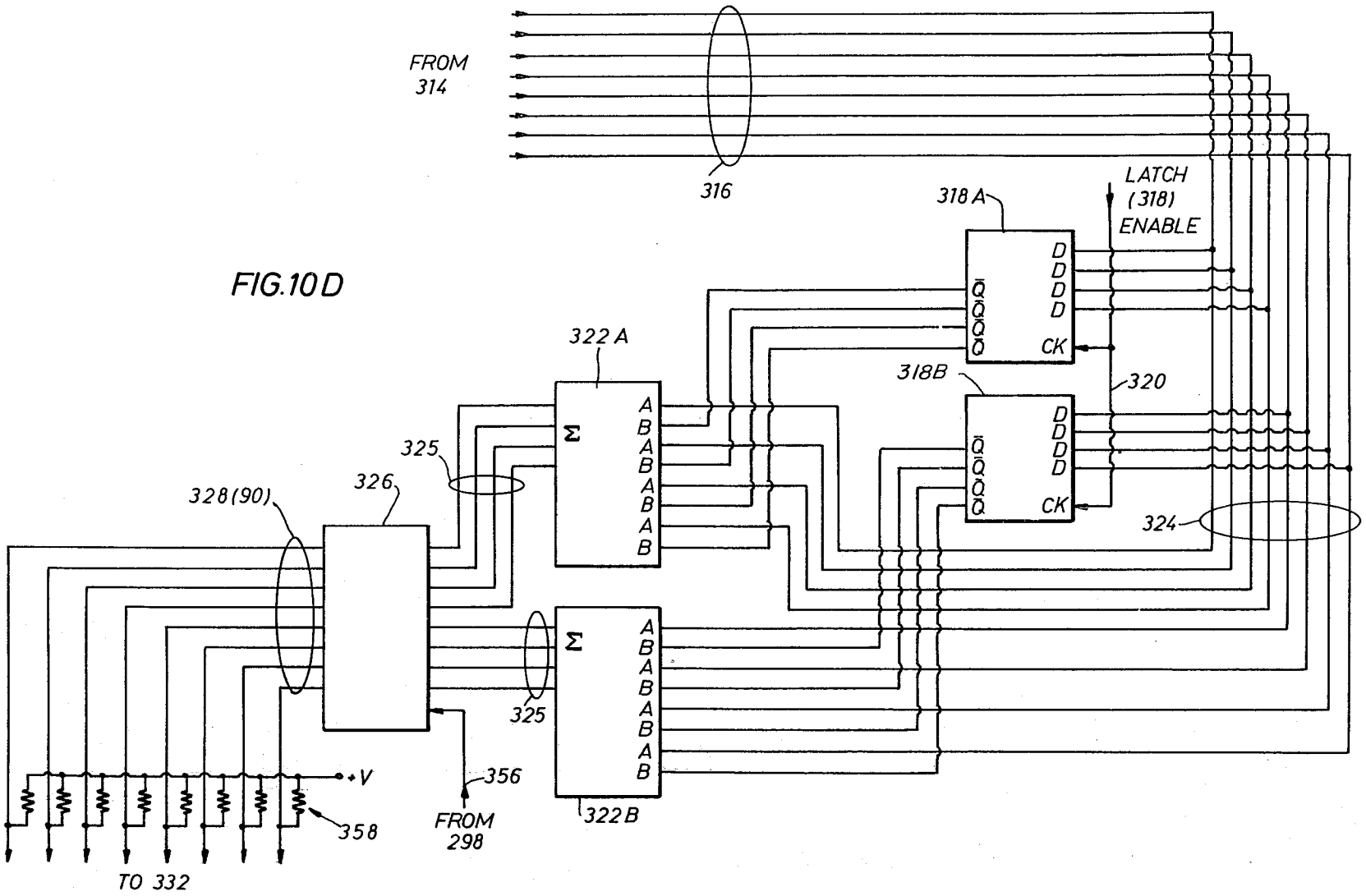
Figures 10E, 10F:
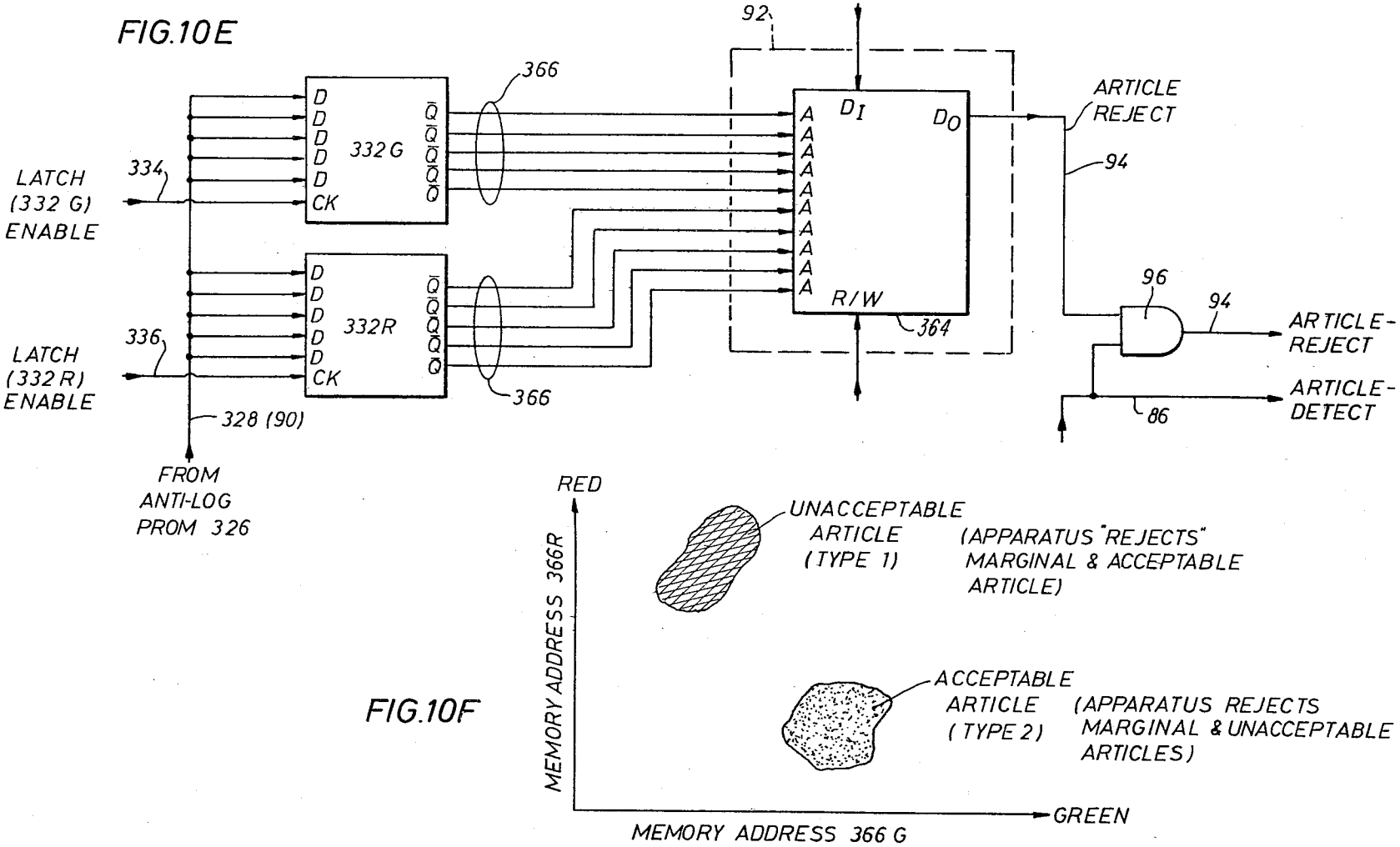

FIG. 11 is a signal timing diagram illustrating the time sequence of enabling signals to various of the circuit components set forth in FIG. 10 which serve to initiate the operation of the circuit components to perform their stated functions. In FIG. 11 the timing sequence for only selected ones of the sixteen channel times defined during one scan by the total operation of the multiplexer 134 are shown. However, from a discussion of the first four of the channel times substantially the total operation of the system may be discerned. It is understood from the preceding discussion that channel times one through four correspond to activities related to the first viewer, channel times five through eight correspond to the activities related to the second viewer element, and channel times nine through twelve relate to operations in connection with the third viewer element. The remaining channel times thirteen through sixteen are not devoted to a viewer per se, although some system activities relating to ejector dwell control occur.

Within each of the four channel times alloted to each viewer, activites are performed only in the first, second and fourth channel times thereof. The third channel time is a dead time zone. Furthermore, within each of the defined channel times, sixteen time subdivisions or "microcycles" are defined during which the electrical manipulations occur.

The first and second channel times associated with any viewer element are devoted to activities relating to electrical signals derived from the photodetectors responsive to reflected light intensity at a first given wavelength, in this case, green light. More particularly, the first channel time relates to activities relative to the electrical signal representative of green light intensity reflected and detected against the 100% reflective background. The second channel time relates to activities and operations on the electrical signal derived from the photodetector detecting reflected green light against the 0% background. In the fourth channel time activities related to the electrical signal generated by the photodetector in response to reflected light intensity at the other predetermined wavelength, here red light, as detected against the 0% background are performed.

During the first channel time the multiplexer 134 operates to sample the electrical signal output from the photodetector $1-H_G$ as appropriately amplified by the associated preamplifier $1-H_G$ and its associated low gain amplifier stage 240. The multiplexer 134 responds to the binary address frequencies $2^0$ through $2^3$ and presents the instantaneous sampled electrical signal output to the amplifier 246. The output of the amplifier 246 is applied to the analog-to-digital converter 250 which responds to the START CONVERT signal on the line 252. Due to the peculiarities of the internal configuration of the analog-to-digital converter 250 the output thereof presented on the array of lines 254 is the one's complement of the digital signal representation of the analog voltage value of the signal at the output of the low gain stage amplifier 240 associated with the preamplifier $1-H_G$. This signal is presented to the automatic nulling arrangement 68.

During the first channel time the polarity of $2^0$ is such as to address the memory division HIGHEST POSITIVE operative to store the highest positive signal value and to generate an electrical correction signal functionally related thereto. This follows directly since during channel 1 the multiplexer is sampling the output of a preamplifier associated with a photodetector which detects reflected light energy against a background having a reflectance characteristic h greater than the reflectance characteristic of the article being sorted. With the state of $2^0$ being a logic low, the MEMORY ADDRESS ENABLE signal on the line 152 is in a logic high state so that the PREVIOUS section of the first memory division is addressed. In this memory section is stored the electrical correction signal generated during the immediately preceding sample time period. This correction signal is withdrawn from memory and applied on the lines 150 to the data terminals of the latches 154. The latches 154 are strobed in response to the LATCH (154) ENABLE signal on the line 156 and the data recalled from the PREVIOUS memory section is used to generate the appropriate electrical correction signal for the sampled preamplifier output and is applied on the lines 157 to the digital adders 138. Accordingly, the appropriately nulled instantaneous preamplifier output is presented to the output lines 72 leading from the adders 138.

With the state of $2^0$ still logic low, the MEMORY ADDRESS ENABLE line 152 changes state to address the PRESENT section of the memory division adapted to store the most-current highest positive signal sampled during the present sample period. This data is applied over lines 162 to the B side of the comparators 160 and compared with the instantaneous sample presented to the A side of the comparators on the lines 164. If the comparison is true an enabling output signal on the line 166A is applied through the multiplex arrangement 274 and the line 273 to the gate 270. The enabling signal to the WRITE terminal of the memory 144 is gated through the gate 270 upon the occurrence of the WRITE ENABLE signal on the line 272 from the system timing.

It should be noted that the enable signal to the WRITE terminal is asserted if the comparison made by the comparators 160 is true. Although in theory when updating the PRESENT section of the memory the comparison is true when the instantaneous signal exceeds the highest signal stored in the PRESENT section to that time. It is noted in connection with this specific embodiment shown in FIG. 10B that the WRITE terminal is asserted by an output signal from the "less than" output of the comparators 160. This occurs due to the inversion of the output signals from the analog-to-digital converter and is to be considered a particularity of the circuitry used to implement this embodiment of the invention. The theoretical background underlying the automatic nulling arrangement as discussed in connection with FIGS. 7 and 8 remains intact.

Deviating momentarily from the operational sequence to complete discussion of the automatic nulling arrangement, when $2^0$ changes state signifying the occurrence of the second channel the automatic nulling arrangement acts in an analagous manner. Thus, in accordance with the state of the MEMORY ADDRESS ENABLE line 152 the PREVIOUS section of the second memory division (LOWEST POSITIVE/HIGHEST NEGATIVE) relating to the electrical correction signal generated during the immediately preceding sampled time period is addressed and applied to the latches 154. The latches are again strobed in accordance with the LATCH (154) ENABLE signal on the line 156 and applied over lines 157 to the digital adders 138 so that an appropriately nulled instantaneous electrical signal is applied to the output lines 72.

When the signal on the line 152 changes state the PRESENT section of the memory division is addressed and updated if a comparison between the lowest positive or greatest negative signal detected up to that time in the present sample time period exceeds the instantaneous sample applied to the A side of the comparators on the line 160. (Consistent with the peculiarity of the implementation if the comparison is true an output signal on the line 166 A from the "greater than" output as conditioned by the WRITE ENABLE pulse on the line 272 enables the WRITE terminal to appropriately update the address memory location.)

After a predetermined number of scans as selected by the operator the data in the PRESENT sections of each memory division is loaded into the PREVIOUS sections thereof. During the first channel time of the initial scan immediately following the onset of the new sample time period a FORCE WRITE signal overrides the output of the comparators and is applied through the multiplex arrangement 274 and over the line 273. This signal is conditioned by the WRITE ENABLE pulse on the line 272 and loads into the PRESENT section of the memory the instantaneous signal sampled during the first channel time of the new sample period that the particular channel is addressed.

During the first channel time ($2^0$ being a logic low,) the appropriately nulled output of the digital adders 138 is presented on the lines 172 to the data terminals of the latches 284. It is noted that the signal is still inverted while on the lines. During the first channel time the signal presented on the lines 72 to the latches 284 is the appropriately nulled instantaneous electrical signal representation of the output of the $H_G$ preamplifier. In response to the LATCH (284) ENABLE signal on the line 286 the data present on the lines 72 is latched into the inverting outputs of the latches 284 and is presented by the lines 288 to the A inputs of the adders 290. At the end of the first channel time, when the polarity of the timing signal $2^0$ changes state, it may then be appreciated that there is present at the A inputs of the adders 290 the non-inverted electrical signal representation of the instantaneous output signal generated by the preamplifier $H_G$.

During the second channel time as determined by the state of the timing frequency $2^0$ the output signal generated by the preamplifier $L_G$ is sampled by the multiplexer 134 and appropriately nulled in accordance with the operation of the automatic nulling arrangement 68 discussed above. Therefore, during the second channel time, the appropriately nulled instantaneous output of the $L_G$ preamplifier is presented over the lines 292, through the gates 294 and over the lines 296 to the B inputs of the digital adders 290. It is noted that while the data representative of the signal at the output of the amplifier $L_G$ is applied to the data terminals of the latch 284, that latch is not strobed during the second channel time and accordingly the data present at the output of the inverted terminals (representative of the signal $H_G$) remains present at the A inputs of the adders 290.

It will be recalled that the percentage frame fill may be derived and is functionally related to the difference between the signal representations of the reflected intensities of a given color derived against a 100% background and a 0% background in accordance with the relation $1-(H-L)$.

Since the signal presented to the B inputs of the digital adders 290 on the lines 296 remains inverted due to the operation of the analog-to-digital converter, the signal present at the output of the adders 290 is equal to the difference in signal intensitites between the H and L preamplifiers. That is, a signal representation equal to the quantity $(H_G-L_G)$ is electronically defined at the output of the adders 290. In response to the LATCH (302) ENABLE signal on the line 310 the difference in signal intensities between the H and L preamplifiers with respect to the intensity of reflected green light is latched into the non-inverting output of latches 302 and presented to the A terminals of the multiplexer 304. Connected to the B terminals of the multiplexer 304 by the lines 306 is the still-inverted $L_G$ output instantaneously sampled by the multiplexer 134 during the second channel time.

It will further be recalled in connection with this invention that the percentage frame fill is equal to the difference between the quantity $(H-L)$ for a given color and unity, as set forth by the relationship $1-(H-L)$. Furthermore the percentage frame fill so derived may be utilized to appropriately scale one or the other, but preferably the L signal from the preamplifiers to generate the reflectivity of the article.

In accordance with the preferred embodiment of the invention, during that portion of the second channel time in which the MULTIPLEX (304) ENABLE signal on the line 308 to the multiplexers 304 remains in a logic high state, the $L_G$ signals presented to the multiplexers 304 on the lines 306 are sampled thereby and presented at the inverting outputs thereof. Thus, while the multiplex enable signal 308 is high, an electrical signal corresponding to the non-inverted $L_G$ signal is presented to the log-PROM 314. Responsive to the LATCH (318) ENABLE signal on the line 320 the inverse of the logarithm of the $L_G$ signal is applied to the digital adders 322.

Immediately after the MULTIPLEX (304) ENABLE signal on the line 308 changes to a logic low state, the electrical signal representation of the difference between the H and L signals for the reflected green color is sampled and appears at the inverting outputs of the multiplexer 304. Due to the inversion occasioned by the multiplexer 304, presented to the terminals of the log-PROM 314 is an electrical signal equal to the quantity $1-(H-L)$. This signal magnitude is recognized as the percentage frame fill. The log-PROM 314 acts to determine the logarithm of the percentage frame fill quantity $1-(H-L)$ and that signal is presented over the lines 316 and 324 to the digital adders 322. The output of the digital adders 322 is therefore a number equal to the logarithm of the difference between the logarithm of $L_G$ and the logarithm of the percentage frame fill. Thus, the signal $L_G$ is electronically scaled (divided) by the representation of the percentage frame fill. This logarithmic signal is presented to the anti-log PROM 326 and an electrical signal representative of the percentage of green light reflected from the article is applied at the output lines 328 of the anti-log PROM 326. In response to the LATCH (332G) ENABLE signal on the line 334, the signal representation of the percentage reflectivity of the article at the green color wavelength is latched and stored for use.

During the dead time slot occupied by the third multiplex channel time no activities occur.

During the fourth channel time the electrical output signal equal to the percentage of red light reflected from the article being sorted as detected against a 0% reflected background (the signal representation of $L_R$) is sampled by the multiplexer 134 and converted to an 8-bit digital number by the analog-to-digital converter 250 in response to the START CONVERT signal on the line 252.

This signal is applied to the automatic nulling arrangement 68 which, due to the polarity of the timing signal $2^0$ in connection with the MEMORY ADDRESS ENABLE signal on the line 152 and LATCH (154) ENABLE signal on the line 156, operates to call from the appropriate section of the memory element 144 the lowest positive or highest negative correction signal generated during the immediately preceding sample time period. This signal is latched in the latches 154 and applied to the adders 138 so that the output lines 140 carry an appropriately nulled and inverted instantaneous signal $L_R$. (During the remainder of channel time four the appropriate lowest positive or greatest negative signal is updated in a manner discussed above.)

The inverted $L_R$ signal is applied through the lines 292, the gates 294, and the lines 306 to the B inputs of the multiplexer 304. Responsive to the MULTIPLEX (304) ENABLE signal on the line 308 and the LATCH (318) ENABLE signal on the line 320, the logarithm of the non-inverted signal $L_R$ is loaded into the latches 318 and appears at the inverting outputs thereof as an inverse logarithm. The inverse of the log ($L_R$) is presented at the B inputs of the adders 322.

When the MULTIPLEX (304) ENABLE signal on the line 308 changes state, the signal representation of the difference between the H and L signals for the green wavelengths [i.e., the quantity $(H_G-L_G)$] still present at the output of the latches 302 is sampled by the multiplexer 304, appropriately inverted by the inverting outputs, and output to provide the signal representation equal to the percentage frame fill. That is, the complement of the quantity $(H_G-L_G)$ is equal to the value $1-(H_G-L_G)$. The logarithm of this quantity is generated by the log-PROM 314 and is carried by the lines 316 and 324 to the A inputs of the adders 322. The outputs of the adders 322 generate a logarithm equal to the electrical signal $L_R$ appropriately scaled by the percentage frame fill (a color-independent quantity). This signal is presented to the anti-log PROM 326. During the fourth channel time, an electrical signal representation of the reflected light intensity $L_R$ as scaled by the percentage frame fill, the percentage reflectivity of red light is present on the output lines 328 from the anti-log PROM 326. In response to the LATCH (332R) ENABLE signal on the line 336, the percentage reflectivity of reflected light at the second color wavelength (red) is loaded into the latch 332R.

Also during the fourth channel time, the results of the comparison between the instantaneous percentage frame fill applied to the "A" side of the comparator 84 and the reference frame fill applied over reference lines 87 is gated through the gate 350 in response to the GATE (350) ENABLE signal on the line 352. The output signal, ARTICLE-DETECT is thus applied to the line 86 at the output of the gate 350.

Thus, at the end of the first four channel times associated with the first viewer, the percentage reflectivity of the article being sorted at the predetermined green and red wavelengths and the ARTICLE-DETECT signal (if true) are output from the percentage reflectivity and percentage frame fill signal generator 76.

Before discussion of the classifier 92, a review of the error condition network 298 as shown in the Figures is set forth. It is possible that certain spurious conditions may occur at the outputs of various of the circuit components within the percentage reflectivity and frame fill arrangement 76 if errors are made in the initial calibration of the apparatus. In order to insure the operation of the apparatus in as "error-proof" a manner as possible circuitry is disposed in operative association with the outputs of predetermined components to monitor the outputs therefrom. If these monitored outputs deviate from expected norms due to errors in calibration, corrective action is taken to bring the monitored outputs back within an expected range of values.

For example, if when sampling the output of an H preamplifier during multiplex channels two, six, or ten, the sampled instantaneous output signal drifts above reference background H, appropriate corrective action is to clear the latches 284A and 284B. By monitoring the CARRY terminals of the adders 138, the occurrence of a signal output exceeding the reference H clears the latches 284 to effectively present a signal representation equal to the H background level on the lines 288.

Further, if when sampling channels two, six, or ten (i.e., the channels viewing the H background) the output signal seeks to drop below the L reference, several reasonable assumptions may be made. It is logical in such a case to assume that the frame is entirely filled by an article having a dark, low reflectivity portion thereon. In this occurrence, the output of the latches 302 are forced to a signal condition representative of full frame fill. As a result, if the situation persists, a substantially zero percent reflectivity output is generated.

When sampling channels four, eight and twelve, which are associated with L backgrounds, if the sampled output deviates below the L reference, appropriate corrective action is to force the outputs of the gates 294 to a signal state representative of the L background. By again monitoring the CARRY terminal of the adders 138, the lower input terminals of the gates are asserted to generate an output equal to the L background level.

Similarly, if the outputs sampled during channels four, eight and twelve deviate above the H reference level, it is again logical to assume a full frame with a highly reflective article therein. The appropriate corrective action is to disable the outputs of the anti-log PROM 326 by the line 356. The output 328 is then pulled to a signal condition representative of the H reference through the action of a resistor grid 358. Further, a full frame fill signal output is generated by clearing the latches 302.

If the signal representations of the H and L sampled channels do not coincide (e.g., if the sampled output of the H channel is below the sampled output of the L channel), the latches 302 are also cleared to generate a full frame output. Thus, the output percentage reflectivity is driven to that of the sampled L channel.

Finally, if the output of the adders 322 exceeds a whole number output, the anti-log PROM 326 is inoperative. Accordingly, in such a case, the anti-log PROM 326 is disabled in a manner similar to that discussed above, to force the output thereof to a level representative of the H reference.

ARTICLE CLASSIFIER

From the output of the percentage frame fill and percentage reflectivity signal generator 76 as discussed above, an electrical signal representation of the percentage reflectivity of an article is applied to an article classifier network 92 (FIGS. 10E and 10F). In the classifier, an electrical classification signal representative of the acceptability or nonacceptability of the article is generated. This signal, the ARTICLE-REJECT signal, together with the ARTICLE-DETECT signal on the line 86 is used by the ejector control arrangement (FIG. 16) to generate ejection action to thereby eliminate an unacceptably classified article from the article stream. The ARTICLE-REJECT signal is also gated with the ARTICLE-DETECT signal to prevent spurious signal outputs from the classifier being applied to the ejector control arrangement until an article is actually present within the viewing zone, as evidenced by the presence of an ARTICLE-DETECT signal.

As pointed out in the discussion of FIG. 4, in a monochromatic sorting arrangement embodying the teachings of this invention the classifier network may conveniently take the form of first and second comparator elements each input with a predetermined reference reflectivity level representative of the light and dark trip, respectively. If the percentage reflectivity signal output representative of the reflectivity of the article goes above or below the predetermined cut points defined by the light and dark trip comparators an electrical ARTICLE-REJECT signal is generated. The predetermined light and dark reference signals may be applied to the appropriate terminals of comparator elements (such as those manufactured by Texas Instruments and sold under Model Number 74LS85) on the system data bus. In response to appropriate timing signals the light and dark trip reference signals may be appropriately applied to the respective comparator so as to provide a basis against which the percentage reflectivity of the article is compared. Of course, the reference intensities may be applied directly to the comparators. A comparator arrangement of this type may also be used to generate light and dark trip signals at each color in a bichromatic sort.

In a bichromatic sorting arrangement the background computer 76 is operative in a manner set forth above to generate electrical signal representations of the percentage reflectivity of the article at two predetermined wavelengths in connection with each of three viewer elements disposed about the article stream. As discussed, during channels two, six and ten the percentage reflectivity of the article at the selected green wavelength is generated from the output of the anti-log PROM. During multiplex channel times four, eight and twelve the electrical signal representation of the percentage reflectivity of the article at predetermined red wavelengths is generated.

During channel times two and four, therefore, the electrical signal representation of the percentage reflectivity of the article at the predetermined green and red wavelengths as detected by the first viewer element 28-1 are respectively latched into latch elements 332G and 332R. Similarly, during the sixth and eighth channel times the percentage reflectivity of light reflected from an article as detected by the photodetectors associated with the second viewer element 28-2 is applied at the latches 332. Likewise, during the tenth and twelfth channel times the appropriate reflectivity percentages derived from the third viewer 28-3 are applied to the latches 332.

During the fourth channel time when the appropriate percentage reflectivity values for the predetermined color wavelengths detected by the photodetectors in the first viewer element are latched into the latches 332 the percentage reflectivity signals are applied to the classifier to generate an electrical classification signal representative of the acceptability or unacceptability of the article viewed by the first viewer. Likewise, during the eighth and twelfth channel times the percentage reflectivities of the article viewed by the second and third viewers, respectively, are presented to the classifier.

In accordance with the bichromatic embodiment of the invention the classifier element 92 includes a random access memory element 364 connected to the outputs of the latches 332 by an array of lines 366. A suitable memory element 364 for use in the classifier is that manufactured by Texas Instruments and sold under Model Number 4033. The memory element 364 defines a matrix array of memory storage locations. Each memory location may be assigned a predetermined five-digit address corresponding to the five most-significant digits representative of the color reflectivity of the article at the green and red wavelengths. The percentage reflectivity at the green wavelengths may be disposed along the abscissa of the matrix array while the percentage reflectivity at the red wavelengths are disposed along the ordinate (FIG. 10F). It is possible to preload into each memory location at an address corresponding to a particular green and red reflected intensity a signal representation of the acceptability or unacceptability of an article exhibiting these percentage reflectivities. In this manner a predetermined profile of acceptable articles may be defined within the matrix storage array within the memory element 364.

As viewed in FIG. 10F the particular profile for two given articles is illustrated. If the output of the background computer 76 during the second and fourth channel times, for example, generates percentage reflectivities at the green and red wavelengths which correspond to an address location lying within the particular profile defined within the memory an electrical output signal representative of the acceptability of that article is provided at the data output terminal of the random access memory. Alternatively, however, if the percentage reflectivity output from the appropriate channels associated with a given viewer addresses a memory location outside of the predetermined profile an electrical classification signal indicative of the unacceptability of the article is output from the memory. This unacceptable article classification, or ARTICLE-REJECT signal, is applied to the line 94 and is gated with the ARTICLE-DETECT signal 86 in the gate 96. If an ARTICLE-DETECT signal is present on the line 86 the ARTICLE-REJECT signal is passed to the ejector control arrangement. The ARTICLE-DETECT signal is also utilized in the ejector control arrangement.

With the utilization of a memory profile arrangement several of the perceived limitations of prior art sorting arrangements are believed eliminated. In accordance with this invention the utilization of a preloaded memory profile corresponding to an acceptable article provides high speed and high reliability digital article classification. Set-up procedures are substantially reduced. The article profile may be viewed on an appropriate output display as a sort is in progress. If a plurality of sorting apparatus are utilized each may be preprogrammed with the same acceptable article profile to thereby provide substantially the same quality sort regardless of minor variations in lighting, analog gain and analog offset which may be present between each apparatus. Further, the classification profile for several different article types may be stored in the same memory and selected in accordance with the article being sorted.

The profile for a particular article may be loaded into the memory element by passing a sample of an acceptable article through the viewing zone during the initial calibration and set-up of the apparatus. With the Write terminal of the memory asserted signal representations of acceptable articles are loaded into the memory locations corresponding to addresses defined by the percentage reflectivity at the predetermined color wavelengths. Any predetermined number of acceptable samples may be utilized to generate the acceptability profile within the memory. Once the profile is generated the read function is asserted and the memory will be utilized to generate acceptable and unacceptable article classifications in a manner discussed above.

As is discussed herein the generation of an ARTICLE-REJECT signal from any or all of the viewers may be required before operation of the ejector is initiated. However, in accordance with this invention, the acceptability or unacceptability of the article viewed by each viewer element is generated by addressing the memory storage location corresponding to the percentage reflectivities of the article at the selected color wavelengths and reading from the memory the preloaded classification signal therefor. If the addressed location falls outside the preloaded acceptable article profile, an electrical ARTICLE-REJECT signal representative of the unacceptability of the article viewed by the appropriate viewer is generated.

The matrix array of memory storage locations disposed in the memory 364 is programmed by passing either acceptable or unacceptable articles and marginally acceptable articles through the viewing zone with the memory WRITE ENABLE terminal asserted and the DATA INPUT terminal set to a logic high (representative of unacceptable articles) or a logic low (representative of acceptable articles). This effectively defines the profiles shown in FIG. 10F. Of course, the memory could be a read-only memory preprogrammed to read a known profile pattern. Before programming the memory 364 must be initialized whereby all storage locations are placed in a known state. For example, if writing an unacceptable article profile (a logic high), the memory 364 is initialized to all zeroes. Once so initialized, the profile may be altered without the need for re-initialization.

Metering Arrangement

All sorting apparatus require the use of some form of metering arrangement to assist in the initialization and set-up of the apparatus. For example, co-pending application Ser. No. 704,652, filed July 12, 1976, now U.S. Pat. No. 4,088,227, assigned to the assignee of the present invention relates to a multiplexed sorting apparatus in which an analog signal derived from a predetermined circuit test point is sampled during a given multiplex channel time, held in a suitable holding arrangement, and displayed. In the appropriate environments, metering activities are performed using an oscilloscope. Since the areas in which a sorting apparatus employing the teachings of this invention are unlikely to have such a capability, a metering network 400 using the already available digital outputs of the converter 134 is provided to assist in initialization of the apparatus.

Figure 19:
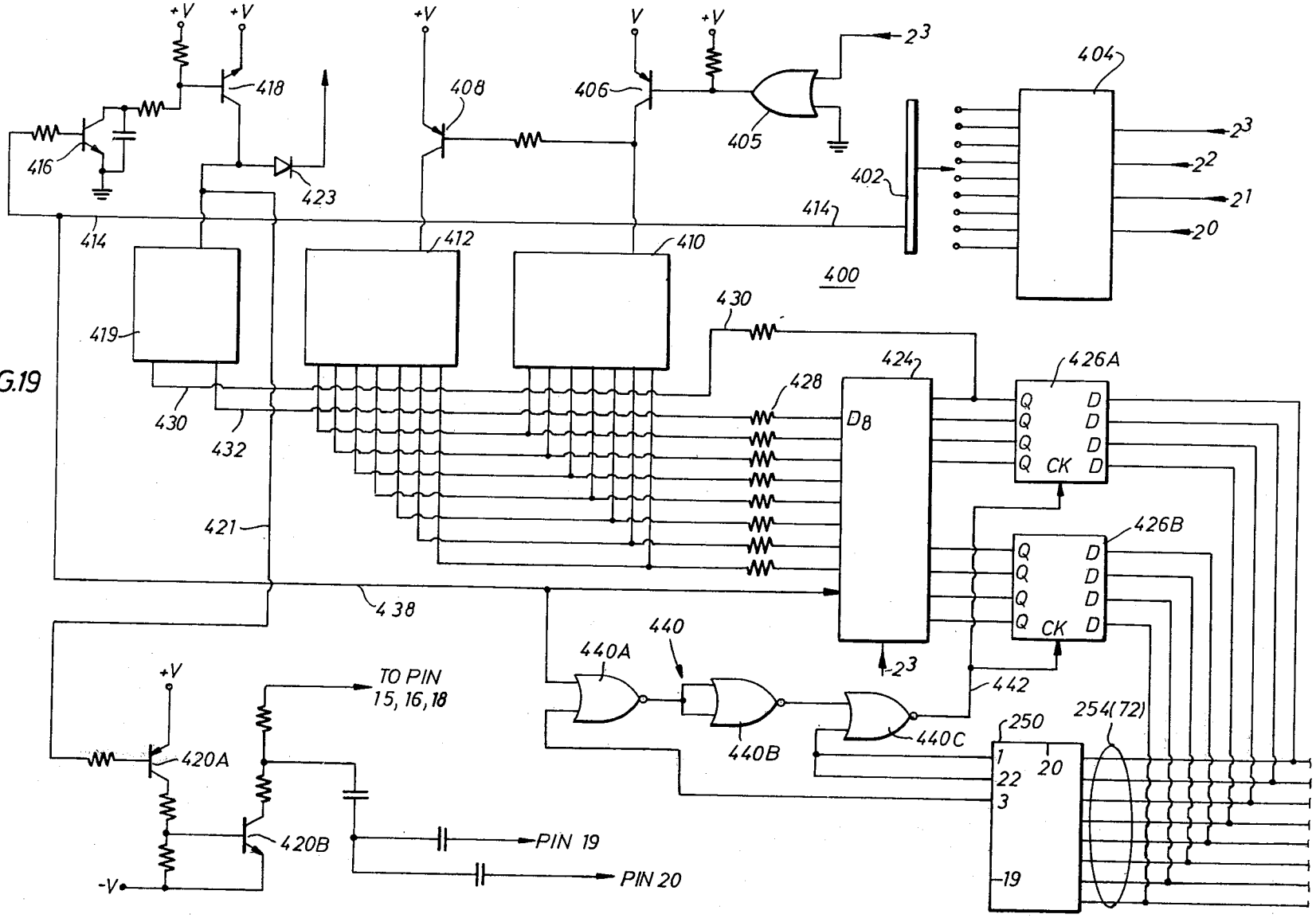

In FIG. 19 the metering network 400 includes a nine position thumbwheel channel selector 402 connected to the output of a decoder 404 such as that sold by Texas Instruments under Model Number 74154. The inputs to the decoder 404 are derived from the timing signals $2^0$ through $2^3$ used to step the multiplexer 134. The timing signal $2^3$ is also applied to a NOR gate 405, the and output of which is tied to the base of cascaded PNP transistors 406 and 408. The collectors of the transistors 406 and 408 respectively enable seven-segment LED displays 410 and 412 in accordance with the state of timing signal $2^3$. The output line from the switch 402 is applied over a line 414 to the base of a PNP transistor 416. The transistor 416 is connected at its collector to the base of an NPN transistor 418 which enables a seven-segment LED display 419 used to display sign bit information. The collector of the transistor 418 is also applied to a cascaded array of transistors 420A and 420B over a line 421 to enable the analog-to-digital converter 250 during each selected channel time. When the display 419 is enabled, the feeding mechanism 23 (FIG. 3) is inhibited by the collector signal applied through a diode 423.

The timing signal $2^3$ output is also applied to one of the address terminals of a programmable read-only memory 424 such as that sold by Geosource Inc. under Model Number 57857-4. The other address terminals of the PROM 424 are derived from the Q outputs of latches 426A and 426B, such as those manufactured and sold under Model Number 74LS175 by Texas Instruments. The data outputs of the PROM 424 are applied to the seven input terminals of the displays 410 and 412 through a resistor network 428. The display 419 derives its inputs from the $Q_4$ output of the latch 426A and the $D_8$ output of the PROM 424 over signal lines 430 and 432, respectively.

The PROM 424 is enabled during each occurrence of the selected channel by a line 438 connected to the selector switch output line 414. The same output signal is applied to a logic network 440, including a NOR-gate 440A, an inverter, 440B, and a NOR-gate 440C. The other input to the gate 440A is derived from the STATUS terminal of the converter 250 while the second input of the gate 440C is derived when the conversion performed by the converter at the selected channel is complete. The output signal from the logic 440 is applied to clock the latches 426 over a line 442. When the latches 426 are clocked, the converted output signals on the lines 254 from the converter 250 are loaded into the Q outputs of the latches and address the appropriate memory location in the PROM 424. In accordance with the change of state of the timing signal $2^3$, the least significant bit and the least significant bit-plus-one are displayed on the panels 410 and 412, respectively. The most significant digit is a one. The PROM 424 is believed unique in that it directly drives the seven-segment displays when addressed, thus directly converting the digital inputs into seven-segment codes without the need for the binary-coded-decimal-to-seven-segment converters used in the prior art.

Thus, in operation, at approximately every tenth of a second (in accordance with the timing pulse $2^3$) on the selected channel, when a conversion-complete signal is applied to the logic 440, the converted digital data output from the converter 250 is latched into the latches 426 to address the PROM 424 to directly output a seven-segment drive to the panels 410 and 412 in the percentage format. In accordance with the invention, one PROM chip 424 converts a binary output from the converter directly into a percentage readout in seven-segment code, thus, eliminating the need for a separate chip to effect a binary-to-BCD conversion, a BCD-to-seven-segment conversion, and a voltage-to-percentage conversion.

EJECTOR CONTROL ARRANGEMENT

Figure 12A:
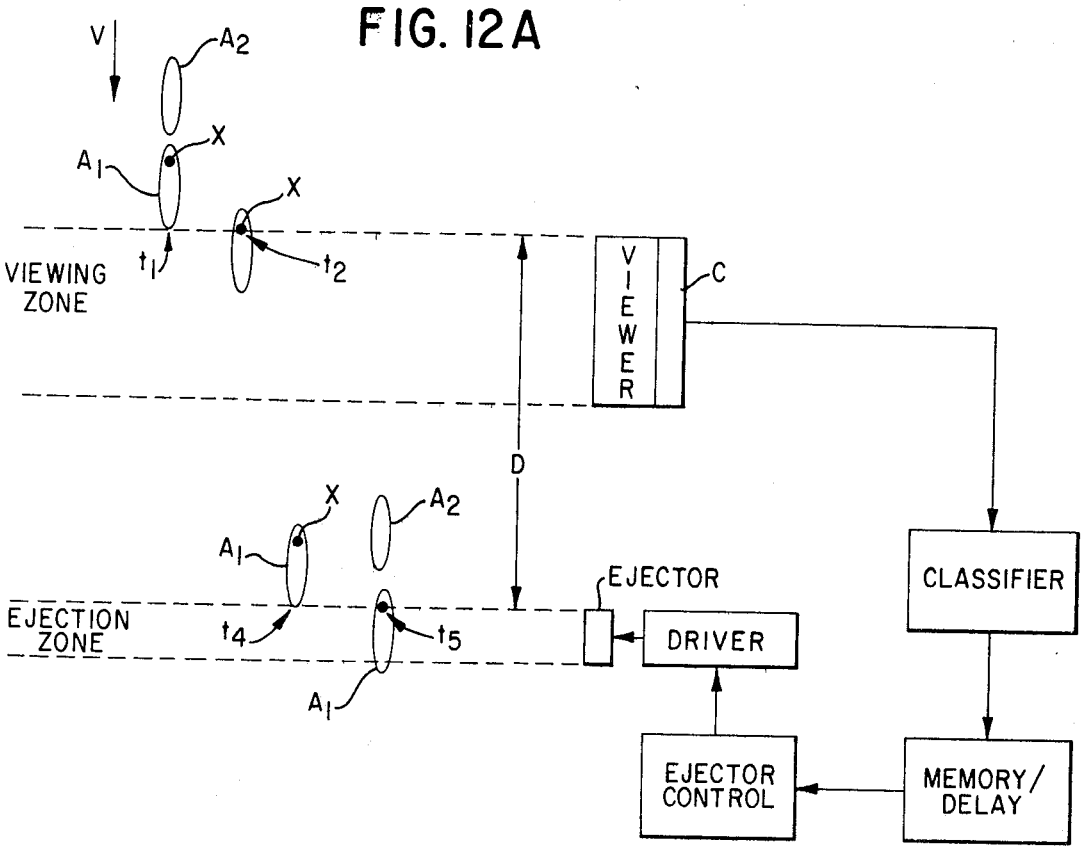
FIGS. 12A and 12B are respectively, highly stylized pictorial representations of a Prior Art sorting apparatus adapted to direct an ejecting force toward the location of the defect on an article being ejected and a timing diagram indicating the sequence of operations therein.
Figure 12B:
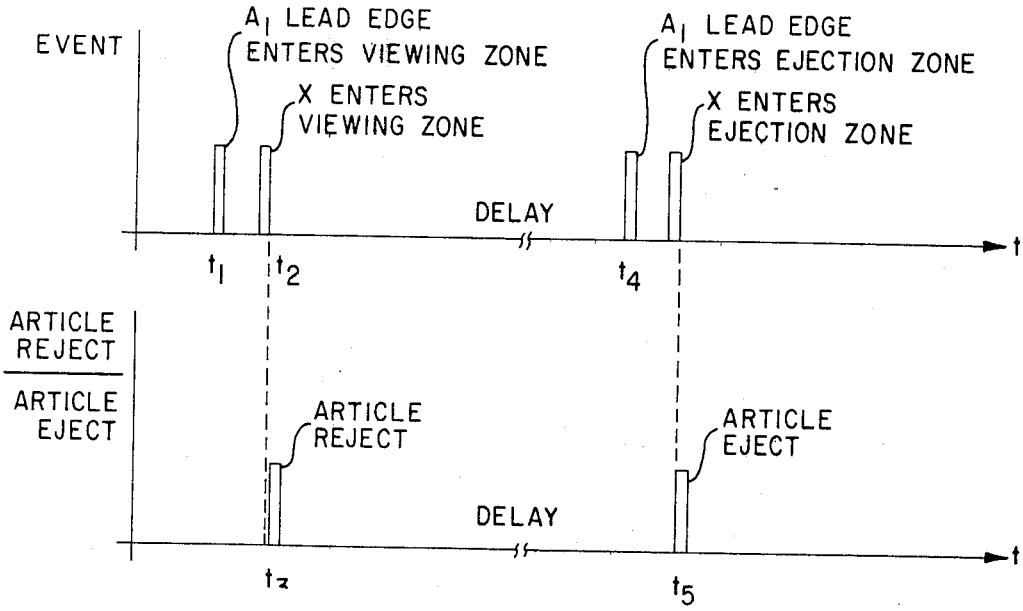

Referring to FIG. 12A a highly stylized pictorial representation of the principle of operation behind a prior art ejector control arrangement is illustrated. FIG. 12B is a timing diagram indicating the sequence of events for the prior art system shown in FIG. 12A. (It is noted in the timing diagrams of FIGS. 12B and 13B that the occurrence of events is indicated in bar form. The width of the bar with respect to the time abscissa has no relevance to the discussion.)

The article stream moving in the direction of the arrow V is shown to include a lead article $A_1$ followed in next-succession by a trailing article $A_2$. The lead article $A_1$ is shown to contain a defect indicated by X adjacent to the trailing portion thereof.

In a typical prior art sorting apparatus the articles $A_1$ and $A_2$ sequentially enter into a viewing zone Z viewed by a viewer element where electrical signals representative of the light reflectivity (or light transmissivity) of the article to be sorted are generated by a photodetector cell C associated with the viewer. The signals are utilized by an electrical classifier operative to generate an article accept or an article reject signal respectively representative of the acceptability or unacceptability of the article based on any predetermined criteria. It is assumed that the defect X is of the type which would render the article $A_1$ unacceptable.

The output of the electrical classifier is stored in a suitable delay element, such as a memory, and applied to an ejector control arrangement. The ejector control arrangement generates an article eject signal at the appropriate time to an ejector driver. The article eject signal initiates ejector operation to direct an ejecting force toward an article classified as unacceptable to expel that article from the article stream. The ejector may be of the paddle-type wherein a mechanical element is extendable into the path of the article stream to strike and thereby expel an unacceptably classified article therefrom. Alternatively, and as illustrated diagramatically in the Figures, the ejector may be of the pressurized fluid type operative to direct a jet of pressurized liquid or gas toward the article stream to expel an article classified as unacceptable therefrom. The region or ejection zone in which the ejecting force is applied to an unacceptable article is spaced a predetermined distance D from the viewing zone. It is noted that some memory capability may be necessary in order to store the classification information relative to succeeding articles in the article stream which may pass through the viewing zone before the lead article enters into the ejection zone.

As seen in FIGS. 12A and 12B the forward edge of the lead article $A_1$ enters into the viewing zone at a time $t_1$. A predetermined time later at $t_2$ the defect X enters the viewing zone and shortly thereafter (at a time $t_3$) an electrical article reject signal is generated by the classifier. The signal representation of the unacceptability of the article $A_1$ is stored or otherwise delayed for a period of time sufficient to permit the article $A_1$ to traverse the distance D between the viewing zone and the ejection zone. This time period is functionally related to the distance D and to the velocity V at which the articles within the singulated stream are moving.

In a prior art system, at a time $t_4$ the lead edge of the article $A_1$ enters into the rejection zone. At a time $t_5$ shortly thereafter the defect X enters the rejection zone. Substantially contemporaneously therewith, an article eject signal is output from the ejector control arrangement to the driver to initiate operation of the ejector element. It is noted that the time different between the generation of the article reject and article eject signals is functionally related to the delay time D/V.

Such a typical prior art system operates on a principle of directing ejection action toward the defect X on the article $A_1$ rather than directing the ejecting force toward the article $A_1$ having the defect X thereon. One of the perceived disadvantages of such an arrangement may be appreciated with reference to FIG. 12A. With the defect X located near the trailing edge of the lead article $A_1$ ejector operation is not initiated until the time $t_5$ when defect X enters the ejection zone (see timing diagram, FIG. 12B). Accordingly, it is possible that the ejecting force will be delivered not only to the trailing portion of the article $A_1$ but also to some portion of the article $A_2$ next-succeeding the article $A_1$ in the singulated stream. It is a distinct possibility that the ejecting force directed toward the defect X on the article $A_1$ will be insufficient to expel that article from the singulated stream. However, the ejecting force to which the article $A_2$ is inadvertently exposed may be sufficient to expel the acceptable article $A_2$ from the article stream. This is believed to be disadvantageous. An ejector control arrangement embodying the teachings of this invention is believed to remedy the perceived disadvantage of prior art ejector control arrangements.

Figure 13A:
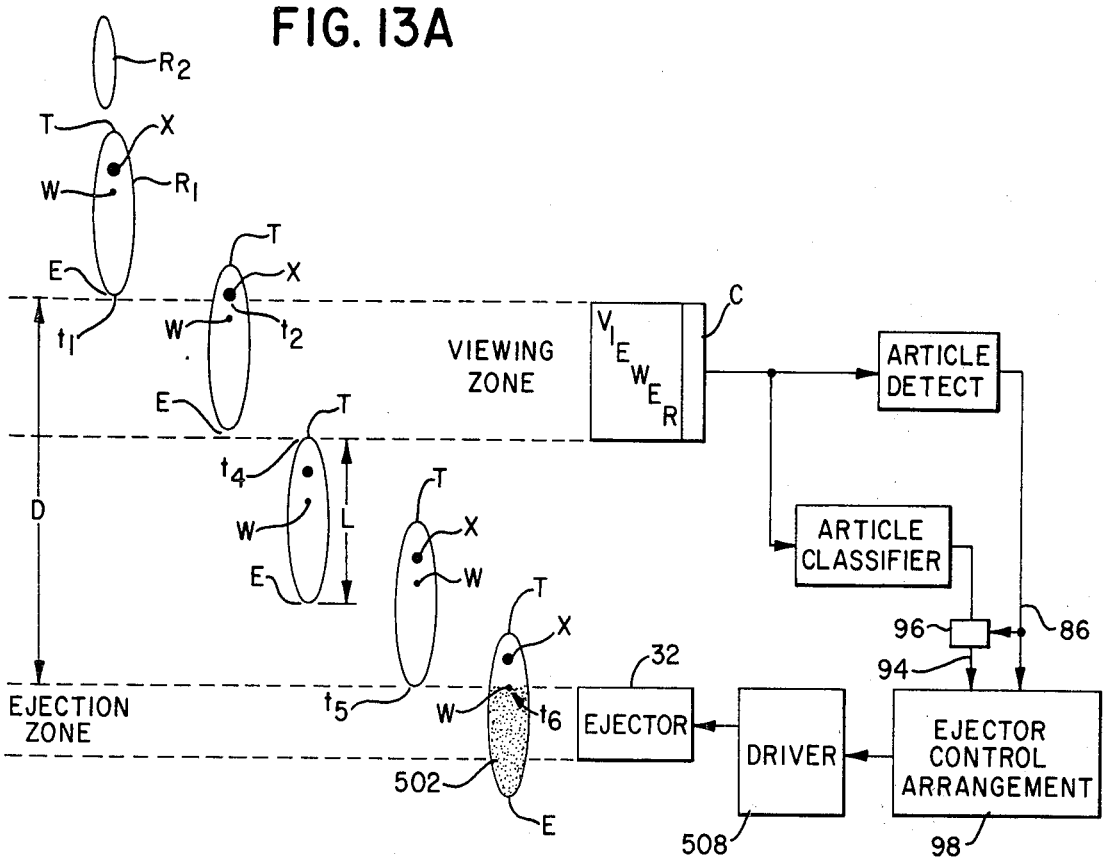
FIGS. 13A and 13B are, respectively, a stylized representation of a sorting apparatus embodying the teachings of this invention and a timing diagram indicating the sequence of operations therein.

With reference to FIG. 13A of the drawings, stylized pictorial representation of the principle of operation underlying the ejector control arrangement of the instant invention is illustrated. The ejector control arrangement is adapted to eliminate an article $R_1$ having a defective portion X thereon in a manner believed more efficient than that of the prior art. Of course, the ejector control arrangement disclosed and claimed herein may be used in connection with any sorting apparatus and its use is not necessarily limited to a sorting apparatus having those other inventive teachings disclosed herein.

As may be seen in FIG. 13A, the sorting apparatus in accordance with this invention includes a viewer element adapted to view the viewing zone through which articles $R_1$ and $R_2$ pass. The article $R_1$ has a defect X thereon sufficient to generate an unacceptable classification. Any suitable photodetector arrangement C may be associated with the viewer to generate an electrical signal representation of the light reflected or transmitted by or through the article viewed within the viewing zone. A suitable article detector arrangement is associated with the photodetector C to generate an electrical ARTICLE-DETECT signal when a predetermined lead-point E on the article, usually the leading edge thereof, enters the viewing zone. As is discussed herein, the ARTICLE-DETECT signal is usually of a time duration coextensive with the time period in which a portion of the article between the predetermined lead-point E (typically, but not necessarily, the leading edge of the article) and the terminal point T (again, typically, but not necessarily the trailing edge of the article) lies within the viewing zone. The article $R_1$ to be ejected thus defines a length L. For later discussion, any suitable cut-off point W may be chosen between the E and T points.

Coupled operatively to the photodetector C is any suitable article classifier arrangement for generating an electrical article classification signal representative of the acceptability of the article as viewed by the viewer. Herein, the article classification signal is referred to as an "ARTICLE-REJECT" signal, it being understood that the invention is equally applicable for use in a sorting apparatus wherein acceptable articles are separated from the article stream while those articles exhibiting an unacceptable characteristic are retained as discussed herein. The ARTICLE-REJECT signal from the classifier represents the presence on at least some portion of the article $R_1$ of the unacceptable physical characteristic X.

The outputs from the article detector and the article classifier are applied to an ejector control arrangement 98 in accordance with the invention. If desired, they may be gated, as at 96. (See FIGS. 4, 5 and 10E). As is set forth herein, based upon the results of the article classification, the article $R_1$ is separated from the article stream by the action of an article ejector element 32 (FIG. 3) disposed in proximity to the ejection zone. The ejector element is driven by a suitable ejector driver itself responsive to an article eject signal generated by the ejector control arrangement 98 in a manner set forth in full herein.

Although any suitable unacceptable element 32 may be used, including that type having a mechanical member extendable into the article path, the ejector element in FIG. 13 is shown to be of the type operable to direct an ejecting force in the form of a pressurized fluid, either a gas or a liquid, to impinge upon an unacceptable article to deflect that article from the article stream as it passes through the ejection zone. The ejector 32 may be of the type which emits a pressurized fluid only while an electrical actuation signal from the driver is applied thereto, or may be of the type which emits a jet of fluid for a predetermined duration. Both remain within the contemplation of the invention although the former type, wherein the ejector is operative only while presented with an actuation signal, is discussed hereafter.

As in the prior art, in order to accommodate the time necessary for the article classified as unacceptable to traverse the distance D it is necessary to provide a time delay. Further, some memory or storage capability is also necessary, since several articles typically pass through the viewing zone and are classified before the lead article traverses the distance D. A capability to both store and delay this data is included with the ejector control 98.

To obviate the perceived disadvantage in the art discussed above, an ejector control arrangement 98 in accordance with the invention is operative to initiate and to direct an ejecting force toward a predetermined lead-point on the article having the defect thereon when that point enters the ejection zone. Further, the ejecting force is maintained for a time sufficient to expose a predetermined portion of the length of the article lying between the lead-point and a predetermined cut-off point to ejecting force without regard to whether the physical defect lies within the portion of the article so exposed. Thus, in accordance with this invention, the ejector driver 508 responds to an ARTICLE-EJECT signal from the ejector control 98 to initiate ejection action to fire at the article having the defect, rather than at the situs of the defect on the article.

In accordance with this invention, when a predetermined lead-point E on the article $R_1$, usually but not necessarily the leading edge thereof, enters the viewing zone at the time $t_1$, the article detector element generates an electrical ARTICLE-DETECT signal. The ARTICLE-DETECT signal usually remains asserted until the time $t_4$ when the trailing edge T of the article $R_1$ passes from the viewing zone. In the case of the article $R_1$ the article classifier element will not generate an ARTICLE-REJECT signal until a time $t_3$ (shortly after the time $t_2$ when the defect X enters the viewing zone). On an absolute time scale, the ARTICLE-DETECT signal begins at the time $t_1$ (when the predetermined lead-point E enters the viewing zone) and ends at the time $t_4$ (when the predetermined trail point edge T leaves the viewing zone). The electrical ARTICLE-REJECT signal, however, is not generated from the classifier until the time $t_3$ after the defect X enters the zone.

The ejector control arrangement 98 embodying the teachings of this invention is adapted to expose substantially the same portion of each article ejected from the stream to the pressurized fluid jet from the ejector. This goal is effectuated by the initiation of the ejector 32 (through the generation of an ARTICLE-EJECT signal) at the time $t_5$. The time $t_5$ is the time on an absolute time scale when the lead-point on the article $R_1$ (in this example, the leading edge E) which generated the ARTICLE-DETECT signal event at the time $t_1$, enters into the ejection zone. With respect to the time $t_5$, $$t_5 = t_1 + t_d$$

where $t_d$ is the delay time needed for the lead-point E on the article $R_1$ to displace the distance D. Similarly, it may be stated that the time $t_6$ (FIGS. 13A and 13B) when the cut-off point W enters the ejection zone is equal to the time (not indicated) when the cut-off point W enters the viewing zone added to the time delay $t_d$.

Also in accordance with this invention, the article $R_1$ is exposed to the ejecting force of the pressurized fluid over a predetermined portion of its length measured between the predetermined lead-point E and a cut-off point W lying intermediate the edges E and T. The area 502 between the points E and W exposed to the ejecting force is any convenient percentage of the length L of the article $R_1$, and is, in most cases, selected to be the leading three-fourths thereof.

Figure 13B:
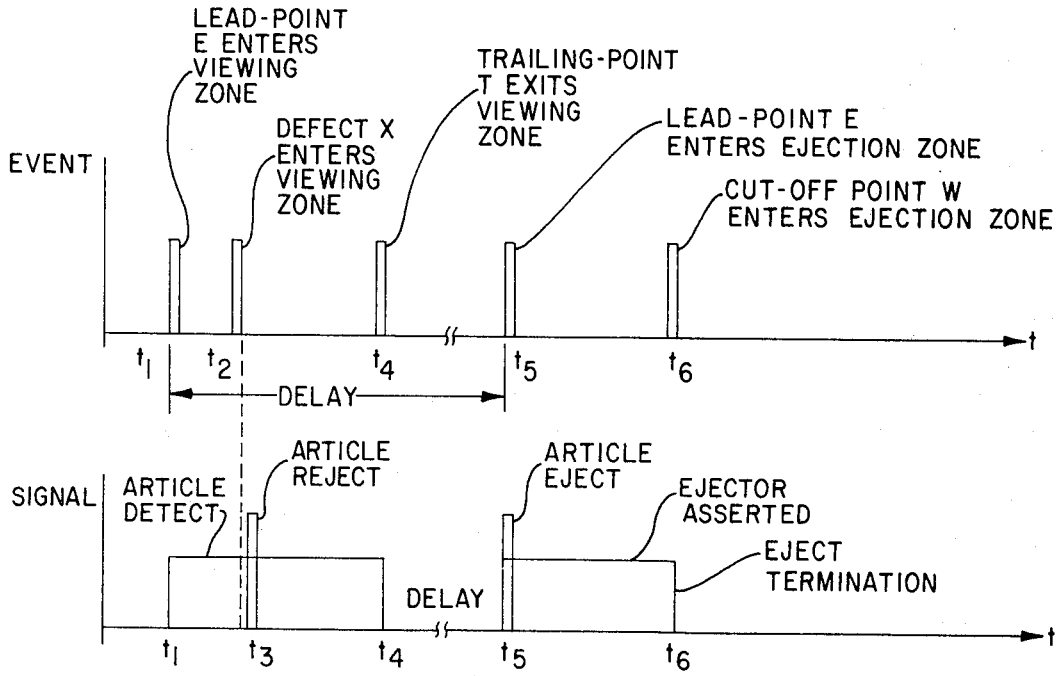

The exposure of the area 502 between the points E and W is effectuated in accordance with this invention by maintaining the ejector 32 asserted until there occurs an EJECT-TERMINATION signal to the ejector driver from the ejector control arrangement 98 at time $t_6$. The time $t_6$ corresponds on an absolute scale to the time the cut-off point W enters the ejection zone. In this manner, the ejector control arrangement initiates the operation of the ejector (through the driver) at the time $t_5$ when the predetermined lead-point E on the article $R_1$ enters the ejection zone and maintains assertion of the ejecting force until the time $t_6$ when the cut-off point W enters the ejection zone. Thus, substantially the same predetermined area 502 of each article being ejected is exposed to the ejecting force of the jet of pressurized fluid from the ejector without regard to the location of the defect X with respect to the predetermined lead-point E. It is irrelevant whether the defect X lies within the exposed area of the article $R_1$, as seen in FIGS. 13A and 13B. In some cases, the ejecting force is terminated in accordance with the invention at time $t_6$ before the defect X has entered into the ejection zone.

It is noted that any lead-point E, terminal point T, and cut-off point W may be selected so that any predetermined portion of the length L of the article $R_1$ is exposed to the ejecting force of the fluid from the ejector 32, the only limitation being that the cut-off point W lies between the selected lead-point and termination point. Thus, for example, a lead-point E' may be selected to lie approximately one-fourth the length L of the article, from the leading edge and the ejector element 32 may be responsive to the control arrangement 98 to fire at an area 502' comprising the middle one-half of the article.

In FIG. 14, the ejector control arrangement 98 in accordance with this invention is illustrated in block diagrammatic functional form. The control arrangement 98 responds to the ARTICLE-DETECT signal input thereto on a line 86 from the background computer 76 (FIG. 10D) and the ARTICLE-REJECT signal input thereto on a line 94 from the article classifier 92 (FIG. 10E) to generate appropriate control signals to assert the operation of the ejector element 32. The ARTICLE-DETECT signal line 86 is tied to lines 504, while the ARTICLE-REJECT signal line 94 is tied to the lines 506. The control arrangement 98 is associated with an ejector driver 508 by output lines 510 and 512. (The ejector driver 508 also includes the ejector coil current control network discussed in connection with FIG. 18). The driver 508 responds to an ARTICLE-EJECT signal presented thereto on the line 510 from an article-eject signal generator 514 and to an EJECT-TERMINATION signal carried by the line 512 from an eject-termination signal generator 516. The occurrence of an ARTICLE-EJECT signal on the line 510 serves to initiate the operation of the ejector element (through the driver 508 in a manner to be discussed herein) to introduce a jet of pressurized fluid into the ejection zone when the predetermined lead-point on the article $R_1$ enters thereinto. The occurrence of an EJECT-TERMINATION signal on the line 512 serves to end the operation of the ejector. The EJECT-TERMINATION signal is generated only after the predetermined portion 502 of the length L of the article $R_1$ is exposed to the ejecting force of the jet of pressurized fluid. The ARTICLE-EJECT and EJECT-TERMINATION signals are generated without regard to the location of the defect X either with respect to the lead-point E or to the exposed area 502.

In the general case, the ejector control arrangement 98 may include a localized timing network 502 associated with the article-reject signal generator 514 and with the eject-termination signal generator 516 by the lines 522 and 524, respectively. The timing network 520 produces an electrical signal representation of real time and is useful in a manner disclosed herein to generate the ejector control signals to the driver 508. Of course, if desired, the electrical signal representations of real time as provided by the timing network 520 may be derived from elsewhere in the circuitry of the sorting apparatus, such as, from the overall sorting apparatus system timing network (FIG. 9).

The article-eject signal generator 514 comprises a lead-point ejection zone entry-time signal generator 530 which is input with the electrical signal representation of real time as applied thereto from the timing network 520 on the line 522A and which is responsive to the ARTICLE-DETECT signal applied thereto over the line 504A for generating an electrical signal representation of 138) time $t_5$ (FIG. 138) at which the predetermined lead point E (conveniently the leading edge) of the article $R_1$ enters the ejection zone. The output from the lead-point ejection zone entry-time signal generator is applied by a line 532 to a time-comparator arrangement 534 operative in response to the ARTICLE-REJECT signal applied thereto on a line 506A to compare the electrical signal representation of the lead-point ejection zone entry-time with the electrical signal representation of real time input thereto from the timing network on the line 522B. When the comparison is true, the time-comparator arrangement 534 outputs the ARTICLE-EJECT signal to the driver 508 on the line 510.

In essence, the lead-point ejection zone entry-time signal generator responds to the ARTICLE-DETECT signal occurring at the time $t_1$ and generates an electrical signal representation (applied on the line 532) of the expected time $t_5$ at which the lead-point E will enter the ejection zone. If an ARTICLE-EJECT signal (generated at time $t_2$) occurs while the ARTICLE-DETECT signal is asserted (times $t_1$ through $t_4$), the lead-point ejection zone entry-time signal representation on the line 532 is compared with the representation of real time input to the comparator 534. That is, if the article $R_1$ is classified unacceptable, an ARTICLE-REJECT signal is generated while an ARTICLE-DETECT signal is asserted, and the time comparator 534 compares the expected lead-point ejection zone entry-time $t_5$ with the signal representation of real time. When they coincide the ARTICLE-EJECT signal is generated. Thus, the ejector is operative in response to the driver 508 to assert an ejecting force when the predetermined lead-point E on the defective article $R_1$ enters the ejection zone, without regard to the location of the defect X with respect thereto.

To terminate the operation of the ejector after the appropriate period of operation, the eject-termination signal generator 516 includes a cut-off point ejection zone entry-time signal generator 538. The signal generator 538 is input with the electrical signal representation of real time from the timing network 520 on the line 524A and responds to the ARTICLE-DETECT signal applied thereto on the line 504B to generate an electrical signal representation of the time $t_6$ at which the cut-off point W will enter the ejection zone. The output of the cut-off point ejection zone entry-time signal generator 538 is applied by a line 540 to a time comparator 542. The comparator is responsive to a signal applied thereto on a line 543 which is output from a logic arrangement itself responsive to the ARTICLE-DETECT signal and to the ARTICLE-REJECT signal. The comparator 542 compares the signal representation of the cut-off point ejection zone entry-time with the signal representation of real time input thereto from the timing network 520 on the line 524B. If the comparison is true, the EJECT-TERMINATION signal is generated on the line 512 to the driver 508 to terminate the operation of the ejector after the predetermined area 502 (that portion of the length of the article between the lead-point E and the cut-off point W) has been exposed to the ejecting force provided by the jet of pressurized fluid.

It is recalled that the duration of the ARTICLE-DETECT signal is co-extensive with the time period $t_1$ through $t_4$ during which that portion of the article $R_1$ between the lead-point E and the terminal point T lies within the viewing zone. Accordingly, the duration of the ARTICLE-DETECT signal is functionally related to the length L of the article $R_1$ between the lead-point E and the terminal point T. Since the cut-off point W is intermediate the lead-point E and the terminal point T, it is known that the distance between the points E and W is some percentage of the distance L between the points E and T. By appropriately scaling the time duration of the ARTICLE-DETECT signal, an electrical signal representation of the time $t_6$ (when the point W enters the ejection zone) may be generated. To this end there is included within the cut-off point ejection zone entry time signal generator 538 a network 548 for generating an electrical signal representation of a time equal to a predetermined percentage of the time duration of the ARTICLE-DETECT signal. This signal representation corresponds to the length and area 502 of the article which is exposed to the ejecting force and is applied on the line 540 to the time comparator arrangement 542.

The time comparator arrangement 542 is responsive to the occurrence of the ARTICLE-REJECT signal to compare the cut-off point ejection zone entry-time signal with the electrical signal representation of real time and to generate the EJECT-TERMINATION signal on the line 512. Thus, when real time equals the time $t_6$ (when the cut-off point W enters the ejection zone), the ejector operation is terminated.

There may also be provided a network 552 for comparing the signal representation of the time duration of the ARTICLE-DETECT signal with a predetermined reference signal representation of the time that an article of average length should remain within the viewing zone. As will be seen, the network 552 is operative to rectify any spurious signals generated as a result of "box-carring" of the articles $R_1$ and $R_2$. (By "box-carrying" it is meant that a portion of the trailing end of the article $R_1$ obscures to the viewer the leading end of the article $R_2$, thus presenting to the viewer element the appearance of an inordinately long article.)

Having described the invention in broad functional terms in FIG. 14, reference is invited to FIG. 15, wherein a more detailed representation in block diagram form of an ejector control arrangement embodying the teachings of the invention is shown. Reference may also be had to FIG. 16, which is a detailed schematic diagram of a digital implementation of the ejector control arrangement 98 in accordance with the block diagram of FIG. 15 and is useful in connection with the discussion of the circuit arrangement of the invention discussed in connection with FIG. 9 (system timing) and shown in FIGS. 10 and 11 (background computer and classifier and system timing diagram, respectively). It is noted that throughout the following discussion of FIGS. 15 and 16, the predetermined lead-point E is construed to be the leading edge of the article $R_1$ and the cut-off point W on the article $R_1$ is located three-fourths of the length L therefrom.

In FIG. 15, the lead-point ejection zone entry-time signal generator 530 includes a sampling arrangement 562 connected to the system timing network (FIG. 9) and responsive to the occurrence of the ARTICLE-DETECT signal on the line 504A to sample the electrical signal representation of the time $t_1$ (FIG. 13B), at which the leading edge of the article $R_1$ enters the viewing zone. The sampling element 562 is connected by an array of lines 564 to a summing element 566. The summing element 566 is also provided on an array of lines 568 with an electrical signal representation of the time delay $t_d$ required for the article $R_1$ to displace the distance D between the upper boundary of the viewing zone and the upper boundary of the ejection zone. This delay time $t_d$ is adjustably controllable, as by a thumb wheel 570 or the like. The output of the summing element 566 is connected to the array of lines 532 and applied to the comparator arrangement 534. The array of lines 564 carries an electrical signal representation of the real time $t_1$ at which the leading edge E of the article $R_1$ enters the viewing zone while the array of lines 532 carries the electrical signal representation of the time $t_5$ when the leading edge of the article $R_1$ will enter into the ejection zone.

As may be seen from the detailed schematic diagram of FIG. 16, the sampling arrangement 562 includes first and second latch elements 562A and 562B, such as those manufactured by Texas Instruments and sold under Model Number 74LS175. The data inputs to the latches 562A and 562B are derived from the binary frequency lines $2^4$ through $2^{11}$ output from the system timing network of FIG. 9 as applied over the array of lines 522A. The latches 562A and 562B are enabled by the signal on the line 504A, derived from the Q output of a flip-flop 563 in turn deriving its data input from the Q output of a flip-flop 565. The flip-flop 563 is clocked by a suitable ENABLE (563) signal generated by the timing network during channel time sixteen (FIG. 11). The flip-flop 565 is preset by a signal related to the ARTICLE-DETECT signal as applied through a gate arrangement 567 including an inverter 567A and a NAND gate 567B. The flip-flop 565 is clocked by the timing signal ENABLE (565) from the system timing (FIG. 11) as inverted by the inverter 569.

The non-inverted outputs of the latches 562A and 562B are applied over the array of lines 564 to the "A" inputs of four-bit digital adders 566A and 566B, such as those manufactured and sold by Texas Instruments under Model Number 74L583. The "B" inputs of the adders 566A and 566B are supplied with the electrical signal representation of the time delay $t_d$ as adjustably chosen by the setting placed into the thumbwheel selector 570 (FIG. 15). The thumbwheel 570 may be directly connected to the "B" inputs of the adders 566A and 566B. Alternatively, as is the case throughout the detailed digital embodiment of the invention, the electrical signal representation of the time delay set into the thumbwheel 570 may be appropriately placed on the system data bus in accordance with appropriate enabling timing signals derivable from the system timing network.

In operation, the latches 562 respond to the occurrence of an ARTICLE-DETECT signal to latch the digital signal representation of real time contemporaneously present at the data inputs thereof. This signal representation is added to the system delay time $t_d$ to produce the lead-point ejection zone entry-time signal representation on the lines 532.

The time comparator arrangement 534 comprises a comparator element 572 coupled at the "B" input by the array of lines 522B from the timing network. The "A" side of the comparator 572 is connected to the output of a memory arrangement 574 by an array of lines 576. The memory arrangement 574 is connected to the output lines 532 from the summing element 566. As discussed above, since more than one article passes through the viewing zone and is classified during the period of time required for the article $R_1$ to traverse the distance D from the viewing zone to the ejection zone, the memory arrangement 574 provides both a signal storage and signal delay function.

If the velocity V at which the article stream moves were such that no other articles would enter into and be classified within the viewing zone during the time required for the article $R_1$ to traverse the distance D, the memory storage capability would not be required. In this instance, any suitable electrical signal connection arrangement responsive to the occurrence of the ARTICLE-EJECT signal may be used to present data representative of the lead-point ejection zone entry-time to the comparator 572.

Referring to the detailed schematic diagram of FIG. 16, memory 574 includes memory elements 574A and 574B operative on a First In-First Out basis. Suitable memory elements are 64×4 bit FIFO memories such as those manufactured by Fairchild and sold under Model Number 3341. The memories are connected at the data input terminals with the lead-point ejection zone entry-time signal ($t_5$) on the lines 532. This data is loaded into the memory in a manner set forth herein in response to an enabling signal on a line 571 output from an AND gate 573A. (The signal 571 is related to the ARTICLE-DETECT and ARTICLE-REJECT signals and corresponds, in general, to the signals 506A and 543 shown in the generalized FIGS. 14 and 15.) The gate 573A derives its inputs from the timing signal ENABLE (537A) and the output of AND gate 573B. The inputs to the gate 573B are derived from the output of an EJECT MODE SELECT network 575. The other input of the gate 573B is taken from the output of a NAND gate 577A as inverted by the inverter 577B. The inputs of the gate 577A are respectively derived from the Q output of the flip-flop 563 on the line 579A and the $\overline{Q}$ output of the flip-flop 565 on a line 579B.

The EJECT MODE SELECT network 575 includes a flip-flop 575A clocked by the $\overline{Q}$ output of the flip-flop 563. The flip-flop 575A is set by the selected output of an ANY OR ALL EJECT network 581 which includes a flip-flop 581A. The flip-flop 581A is preset by the timing signal ENABLE (581A) output from the signal timing. The flip-flop 581A is cleared by the output of a NAND gate 583A. The inputs to the gate 583A are derived from a signal related to the ARTICLE-REJECT output of the classifier arrangement 92 (FIG. 10) and a signal related to the ARTICLE-DETECT signal output from the inverter 567A.

The Q output of the flip-flop 581A is gated with the timing signal ENABLE (573A) by a NAND gate 581B. The output of the gate 581B is NOR-ed by the gate 581C with the Q output of the flip-flop 565. The output of the gate 581C is taken through an inverter 581D and is present on the line 575B to the flip-flop 575A only if an ARTICLE-REJECT signal is generated from "ALL" viewer elements 28 during any one scan. If the "ANY" mode is asserted, a signal appears at the line 575B from the output of a NAND gate 583C taken by a line 583D. The gate 583C derives its inputs from the signal related to the ARTICLE-DETECT signal output of the gate 567A and the signal related to the ARTICLE-REJECT signal as inverted by the inverter 583B. In the "ANY" mode, the generation of an ARTICLE-REJECT signal from ANY viewer element 28 sampled during a given scan will generate a signal output to the line 575B.

The EJECT MODE SELECT may be chosen at a "NORMAL" terminal 575C or at an "EJECT IF NO DEFECT" terminal 575D. The former is derived from the Q output of the flip-flop 575A while the latter is derived from the $\overline{Q}$ output thereof. The "NORMAL" mode generates ARTICLE-EJECT signals as discussed herein to expel defective articles from the article stream. As its name suggests, the other mode causes the assertion of the ejector element to expel "acceptable" articles from the article stream.

In effect as discussed herein, during operation, the memories 574A and 574B load the data presented thereto on the lines 532 only if there occurs an ARTICLE-REJECT signal generated from the classifier 92 during the time that an article is within the viewing zone (i.e., while an ARTICLE-DETECT signal is asserted). Since the system operates to essentially store only reject signals, the storage requirements are drastically reduced over the memory storage requirements of prior art systems which store all article classifications (both acceptable and unacceptable) and operate the driver only when an unacceptable article indication is withdrawn from the memory.

The lead-point ejection zone entry-time signal is output from the memory elements 574A in a first-in, first-out order and applied by the lines 576 to the "A" side of the comparators 572. The "B" side of the comparators 572 is connected to the system timing frequencies $2^4$ through $2^{11}$ by the lines 522B. Suitable comparators are those manufactured by Texas Instruments and sold under Model Number 74LS585.

When the lead-point ejection zone entry-time signal present at the "A" side of the comparators equals the timing signal applied at the "B" side thereof, an output pulse on the line 510 is generated and applied to the driver 508. The driver 508 includes a NAND gate 587A which presets a flip-flop 587B. The ARTICLE-REJECT signal derived from the $\overline{Q}$ output of the flip-flop 587B is applied to a remaining portion of the driver network discussed in connection with FIG. 18 on a line 588. Suffice it to say for present purposes that the driver is asserted to direct an ejecting force as the lead-point on the article enters the ejection zone.

Unless the ejector 32 is of the type which terminates the ejection action "automatically", such as those having a predetermined jet duration (or, if mechanical, are spring loaded to return to initial position), it is necessary to terminate the ejector operation when the predetermined cut-off point W enters the ejection zone. In this manner, only the predetermined area 502 is subjected to the ejecting force in accordance with this invention. The output of the comparator element 572, when true, carries the ARTICLE-EJECT signal to the driver 508 on the line 510.

As seen in FIG. 15, the cut-off point ejection zone entry-time signal generator 538 includes a counter 590 operative to generate a time count representative of the duration of the ARTICLE-DETECT signal on the line 504B. The output of the counter 590 is applied to the percentage signal generator 548 by an array of lines 594. The output of the percentage signal generator 548 represents the time $t_6$ at which the cut-off point W will enter the ejection zone. This representation is applied to the line 540 to a memory arrangement 596 included within the time-comparator arrangement 542. The time-comparator arrangement 542 includes a comparator element 600 connected to the memory 596 by an array of lines 602. The memory 596 is also enabled by the logic output line in response to the ARTICLE-DETECT signal and to the ARTICLE-REJECT signal. The comparator arrangement generates an EJECT-TERMINATION signal applied to the driver 508 on the line 512.

As seen from the detailed schematic diagram FIG. 16 the counter arrangement 590 includes first and second counter elements 590A and 590B such as those manufactured by Texas Instruments and sold under Model Number 74LS193. The counters 590A and 590B are enabled by the output line 504b derived from a gate 608. The gate 608 derives its inputs from the timing signal ENABLE (565) and from the Q output of the flip-flop 563.

The counters 590 respond to the presence of an ARTICLE-DETECT signal to provide a count representative of the time duration of the ARTICLE-DETECT signal. The output of the counters 590A and 590B are output over the array of lines 594 to the summing arrangement 548. The summing arrangement 548 includes digital adders 548A, 548B 548C and 548D, all manufactured by Texas Instruments and sold under Model Number 74LS83. The counters are operative to generate an electrical signal output on the array of lines 540 to the memory arrangement 596 representative of the expected cut-off point ejection zone entry time signal $t_6$.

The adders 548A and 548B are input with signals supplied from the outputs of the adders 566 on an array of lines 614 in addition to the signal outputs applied over the array of lines 594 from the adders 590A. The outputs from the adders 548A and 548B are applied over an array of lines 616 to the inputs of the adders 548C and 548D. The adders 548C and 548D are also supplied with the signal outputs from the adders 590 over an array of lines 618. As a result, presented to the memory arrangement 596 on the lines 540 is an electrical signal representation of the time $t_6$ at which the predetermined cut-off point W located three-fourths of the distance L from the leading edge of the article $R_1$ is expected to enter into the ejection zone.

The memory arrangement 596 includes first and second FIFO memory elements 596A and 596B. The memory elements 596 are enabled by the output line 571 which carries signals derived as discussed above.

The outputs of the memory elements 596 are applied over an array of lines 602 to the A inputs comparator elements 600A and 600B. The comparator elements are identical to the comparators 572. The B inputs of the comparators are supplied with system timing pulses over the array of lines 524B.

In operation when an article enters into the viewing zone at time $t_1$ (FIG. 13), an enabling signal 504A to the latches 562 samples the output of the system timing and presents that time representation on the lines 564 to the adders 566. Also, the counters 590 are enabled to count the duration of the ARTICLE-DETECT signal to generate a representation of the article length.

The adders 566 sum the time representation $t_1$ with the predetermined time delay $t_d$ and present that signal representation of time $t_5$ to the data terminals of the FIFO memories 574. The counters 590 generate the representation of the length of the article which is adjusted in accordance with the desired duration of ejecting force by the adders 548 and time representation of the time $t_6$ (equal to the cut-off point viewing zone entry time signal plus the time delay $t_d$) is applied to the memories 596. The occurrence of an ARTICLE-REJECT signal is also stored in the flip-flop 563 and 565.

When the article exits the viewing zone, at time $t_4$, the memories are enabled on the line 571 and the information at the data terminals is loaded into the first available storage location on a first-in, first-out basis. When the time comparisons as conducted by the comparators 572 and 600 are true, the ARTICLE-EJECT signal on the line 510 and the EJECT-TERMINATION signal on the line 512 are generated at the times $t_5$ and $t_6$. The occurrence of an EJECT-TERMINATION signal serves to increment the FIFO memories.

When the signals presented to the A side of the comparator 600 equal the signals applied to the B side thereof an EJECT-TERMINATION signal is applied to the ejector driver 508 over the line 512. The EJECT-TERMINATION signal is gated through a NAND gate 587C which generates an output pulse to clear the flip-flop 587B. The signal is applied to the portion of the ejector driver 508 discussed in connection with FIG. 18. It is sufficient at this point to say that the occurrence of an EJECT-TERMINATION signal on the line 512 serves to terminate operation of the ejector element. In this manner toward only that predetermined portion 502 of the length L of the article $R_1$ is exposed to the ejecting force provided by the ejector element.

It may sometimes occur that due to imperfect serialization of the articles there may occur an overlap in that the trailing edge of the lead article $R_1$ may overlap within the viewing zone with the leading edge of the next-following serial article $R_2$. In this event, in order to prevent spurious representations of the actual length of each individual article, the output of the counter 590 is applied by an array of lines 626 to the AVERAGE ARTICLE LENGTH comparator arrangement 552.

As seen with reference to FIGS. 14 and 15 the AVERAGE ARTICLE LENGTH comparator arrangement 552 includes first and second comparator elements 552A and 552B identical to comparators 572 and 600. The comparators 552 operate to compare the signal representative of the article length presented at the B inputs thereof by the lines 626 with a predetermined electrical signal representation of an average article length presented on an array of lines 634. The predetermined signal of average article length may be provided by a thumb wheel 636 (FIG. 15) and applied directly to the A side of the comparators 552. On the other hand, consistent with the preferred embodiment the predetermined average article length signal selected by the setting of the thumb wheel 636 may be applied to the system data bus. For this purpose latch elements 638A and 638B such as those manufactured by Texas Instruments and sold under Model Number 74LS175 are enabled by a suitable LATCH (638) ENABLE output from the timing network and operative to present the average article length signal from the system data bus to the A side of the comparators 552.

When the actual article length signal presented to the B side of the comparators 552 exceeds the average article length signal presented on the A side thereof the comparator 552 generates an output pulse on a line 640 which is applied to the gate 567B. The output of the gate 567B forces that gate to a logic condition which makes it appear to the electronics that the trailing edge of the article has passed through the viewing zone. Thus, a condition similar to that normally occurring at a time $t_4$ is forced on the system. The occurrence of the output on the line 640 loads the memories 574 and 596 with the data present at their inputs as discussed above. In this manner article overlap within the viewing zone is effectively precluded. The driver 508 shown in FIG. 16C also includes gates 587D and 587E connected to the memory overload by the line 642 and to the system timing signals, as shown.

Figure 17A:
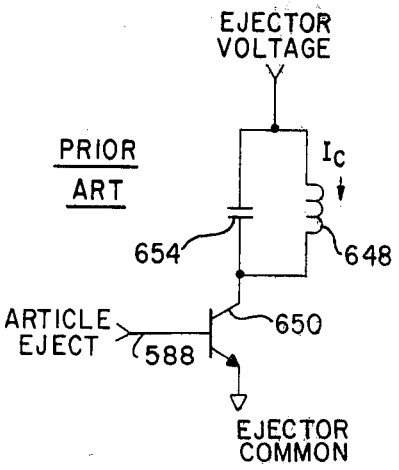
FIGS. 17A and 17B are, respectively, a schematic diagram of a Prior Art ejector driver and a graphic signal output of the current signal therefrom.

The output from the ejector driver 508 is utilized to energize an ejector coil 648 to draw toward it an ejector disc to thereby emit pressurized fluid from the ejector element. As seen in FIG. 17A the ejector driver 508 also includes a power transistor 650 (shown to be of the NPN type) connected at its base to the output line 588 of the flip-flop 587B. The emitter of the transistor 650 is connected to ejector common while the collector thereof is tied to one side of the coil 648. The upper side of the coil 648 is connected to an ejector voltage source approximately equal to 50 volts. Connected in parallel with the coil 648 is a charging capacitor 654.

Figure 17B:
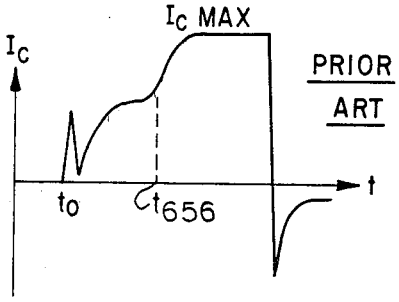

Responsive to the $\overline{Q}$ output line 588 of the ejector driver flip-flop 587B (which in turn responds to the ARTICLE-EJECT and EJECT-TERMINATION signals) the transistor 650 is rendered conductive and an ejector coil current $I_C$ flows in the direction indicated by the arrow in FIG. 17A. The plot of ejector coil current $I_C$ against time for a prior art ejector is indicated in FIG. 17B. In response to the occurrence of an ARTICLE-EJECT signal at a time $t_0$, the ejector driver generates an actuating signal to the transistor 650 turning that transistor on and immediately causing a surge of current to flow from the ejector voltage source through the capacitor 654 to ejector common. The capacitor 654 is thereby charged to a level substantially equal to ejector voltage. Thereafter, ejector current through the coil rises exponentially until the time $t_{656}$ at which the ejector disc is drawn to the coil to effectively change the inductance thereof. The current signal continues to rise until it reaches some maximum current $I_C$ MAX. This current flows through the coil for the duration of the ejector operation.

When the enabling signal to the transistor 650 terminates, a counter-current acting in a direction opposite to the direction of $I_C$ flows through the coil 648 to demagnetize it. This is indicated in a graphical depiction of FIG. 17B as the negative current spike.

It has been observed that the magnitude of the current necessary to initially draw the ejector disc toward the coil is substantially greater than the current necessary to hold the coil in place. It would be advantageous to provide a circuit arrangement operative to apply maximum ejector coil current for a predetermined period of time necessary to draw the ejector disc to the coil and thereafter throttle the magnitude of the ejector coil current to a holding current level sufficient to maintain the disc in the open position until ejecting force is terminated.

From the graphical depiction in 17A it would be advantageous to provide a circuit arrangement in cooperative association with the ejector driver to assert sufficient ejector coil current for a period of time ($t_0$ through $t_{656}$) until the disc is opened and, thereafter, to assert only a holding current $I_{HOLD}$ to maintain the disc in the open position. It is believed that such an arrangement enhances the efficiency of operation of the ejector.

Figure 18A:
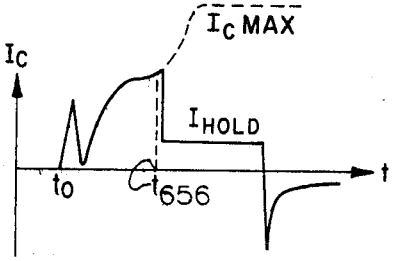
FIGS. 18A and 18B are, respectively, a graphical signal output of the ejector driver current and a schematic diagram of a circuit arrangement operative to generate the current waveform of FIG. 18A; and, FIG. 19 is a detailed schematic diagram of a metering arrangement associated with the output of the analog-to-digital converter in accordance with the invention.
Figure 18B:
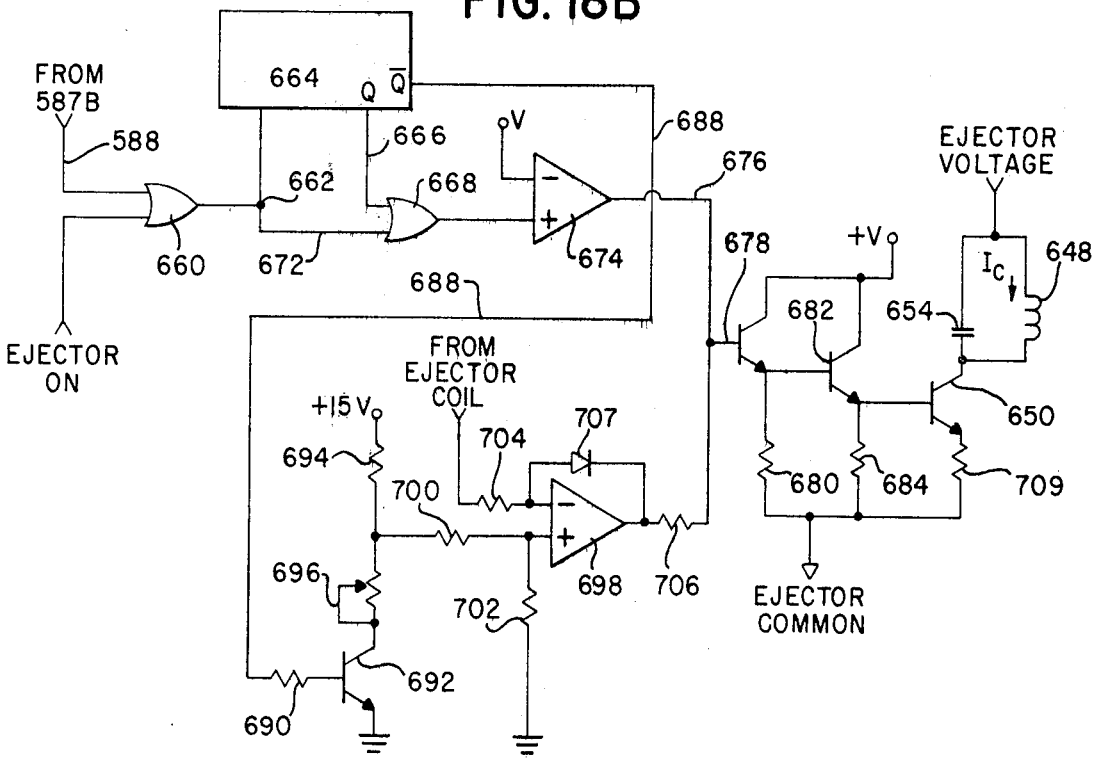

Referring to FIG. 18B, a schematic diagram of a circuit embodying the teachings of this invention adapted to operate in the manner depicted graphically in FIG. 18A is shown. A gate 660 responds to the occurrence of an ARTICLE-EJECT signal (through the flip-flop 587B in the ejector driver 508) and to the energization of the ejector through an EJECTOR ON line to apply an output over line 662 to the enabling terminal of a monostable multivibrator, or one-shot 664. The one-shot may be that manufactured and sold by Texas Instruments under Model Number 74121. The Q output of the one-shot 664 is applied by a line 666 to a gate 668. The gate 668 derives its second input from the output of the gate 660 over a line 672. The output of the gate 668 is applied to the non-inverting input of an open collector operational amplifier 674. The inverting input of the amplifier 674 is connected to a suitable voltage source. The output line 676 from the amplifier 674 is applied to the base of an NPN transistor 678 connected at its collector to a positive, unregulated voltage and having an emitter resistor 680 connected to ejector common. The emitter of the transistor 678 is cascaded to a second NPN transistor 682 connected at its collector to the same unregulated voltage source and having its emitter tied to ejector common through a resistor 684. The emitter of the transistor 682 is applied to the base of the transistor 650.

The $\overline{Q}$ output of the one-shot 664 is connected by a line 688 through a resistor 690 to the base of an NPN transistor 692. The emitter of the transistor 692 is connected to ground while the collector thereof is tied to a positive voltage source through a resistor 694 and a holding current potentiometer 696. The non-inverting input of an operational amplifier 698 is connected through a resistor 700 to the junction point between the resistor 694 and the holding current potentiometer 696. The non-inverting input of the operational amplifier 698 is connected to ground potential through a resistor 702. The inverting input thereof is connected in a feedback loop with the ejector coil through a feedback resistor 704 to, in effect, monitor the output current through the ejector coil 648. The output of the operational amplifier 698 is connected through a resistor 706 to the base of the NPN transistor 678. The amplifier includes a feedback diode 707. A voltage representative of the current through the coil 648 is developed across the resistor 709 connected to the emitter of the transistor 650 and is fed back through the resistor 704 to the amlifier 698.

In operation, with the ejector asserted the lower input to the gate 660 is in a logic low condition. The upper input thereof goes to a logic low condition when an ARTICLE-EJECT signal is asserted. The coincidence of two logic low signals at the input of the gate 660 forces the output thereof to a logic high. This logic high signal is applied over the line 662 to initiate operation of the one-shot 664. The Q output of the one-shot 664 is applied to gate 668 over the line 666 where it is conditioned by the output of the gate 660 applied over the line 672. The output of the gate 668 turns on the amplifier 674. The output of the amplifier 674 is applied over the line 676 to turn on the transistors 678 and 682 and the ejector power transistor 650. While the one-shot times out, full ejector current is applied to the ejector coil 648 to effectively draw the ejector disc toward the open position. The duration of the one-shot 664 is adjusted to assert full ejector coil current for the predetermined time necessary to draw the disc toward the open position.

When the one-shot 664 times out, the $\overline{Q}$ output thereof is asserted over the lines 688 and through the resistor 690 to turn on the transistor 692. By appropriately selecting the setting of the holding current potentiometer 696, the operational amplifier 698 is asserted to provide a reduced current output $I_{HOLD}$ to maintain the disc in the open position for the duration of the assertion of the ARTICLE-EJECT signal. The magnitude of the holding current is adjustably selected by the setting applied to the potentiometer 696.

It may thus be appreciated that during a predetermined period, as determined by the duration of the one-shot 664, an ejector coil current of a magnitude sufficient to draw the ejector disc to the open position is applied to the ejector coil 648. However, once the disc is drawn to the open position, a holding current $I_{HOLD}$ of a reduced magnitude flows through the ejector coil 648. The magnitude of the holding current, although less than the magnitude of the opening current is sufficient to hold the ejector disc open.

The reduced holding current is applied so long as the output of the operational amplifier 674 remains asserted in a logic high condition. The output of the amplifier 674 is a logic high so long as an ARTICLE-EJECT signal is asserted and an appropriate signal representative thereof is applied to the input of the gate 660. However, at the termination of the ARTICLE-EJECT signal (that is, when the driver 508 receives an EJECT-TERMINATION signal from the ejector control) the output of the amplifier 674 goes to a logic low, thus turning off the cascaded transistors 678 and 682 to thereby turn off the ejector coil power transister 650.

It is, of course, understood that although the preferred embodiment of the invention defined above is a digital, multiplexed implementation, any implementation of the background computer 76, the classifier 92, the ejector dwell controller 98, or each of them, may be implemented in analog or digital format, in hardware or in software, and in a multiplexed or non-multiplexed embodiment.

Having described a preferred embodiment of the invention, those skilled in the art having benefit of the teachings discussed herein may effect numerous modifications thereto which remain within the scope of this invention as defined in the appended claims.

What is claimed is:

1. In an apparatus for sorting articles based upon the intensity of light reflected therefrom at a first and a second color wavelength, the apparatus including (a) a viewer element adapted to view a viewed area through which an article to be sorted passes;

(b) an electrical signal generator element adapted to generate a first and a second electrical signal respectively representative of the intensity of light reflected from the article at the first and the second color wavelengths, wherein the improvement comprises:

an article classifier for classifying the article to be sorted on the basis of the intensity of light reflected from the article at the first and second color wavelengths, the classifier including a random access memory element having a plurality of memory storage locations defining a matrix array therein, each memory location being addressable by a different combination of reflected light intensities at the first and second color wavelengths, each memory location having stored therein a classification signal representative of the acceptability of an article exhibiting the reflected light intensities at the first and second color wavelengths corresponding to the address of the memory storage location to electrically define in the matrix array the boundaries of an acceptability profile of the type of article being sorted, and wherein the signal generator generates a multi-bit digital signal representative of the light reflected at the first and second color wavelengths, and wherein each memory storage location is defined by a predetermined number of significant bits of the signal representative of the light reflected from the article at the first color and by a predetermined number of significant bits of the signal representative of the light reflected from the article at the second color.

2. A sorting apparatus according to claim 1 wherein the profile is defined in accordance with the reflected intensities of light at the first and second color wavelengths when an article exhibiting an acceptable reflectivity is passed through the viewer prefatory to a sort.

3. A sorting apparatus according to claim 1, wherein the profile is defined in accordance with a predetermined program loaded prefatory to a sort.

4. A sorting apparatus according to claim 1 wherein the points within the profile stored in the matrix array define acceptably classified articles such that any article not within the profile, including a marginally acceptable article, generates an article-reject signal.

5. A sorting apparatus according to claim 1 wherein the points within the profile stored in the matrix array define unacceptably classified articles, such that only articles within the profile generate an article-reject signal, while acceptable and marginally acceptable articles are classified as acceptable.

6. A sorting apparatus according to claim 1, wherein the signal generator generates an eight-bit digital signal representation of the light reflected at the first and second color wavelengths.

7. In an apparatus for sorting a freely falling stream of irregularly shaped articles based upon the intensity of light reflected therefrom at a first and a second color wavelength, the apparatus including (a) a viewer element adapted to view a viewed area through which an article to be sorted passes;

(b) an electrical signal generator element adapted to generate a first and a second electrical signal respectively representative of the intensity of light reflected from the article at the first and the second color wavelengths, wherein the improvement comprises:

an article classifier for classifying the article to be sorted on the basis of the intensity of light reflected from the article at the first and second color wavelength, the classifier including a memory element having a plurality of memory storage locations defining a matrix array therein, each memory location being addressable by a different combination of reflected light intensities at the first and second color wavelengths, each memory location having stored therein a classification signal representative of the acceptability of an article exhibiting the reflected light intensities at the first and second color wavelengths corresponding to the address of the memory storage location to electrically define in the matrix array the boundaries of an acceptability profile of the type of article being sorted, the profile being defined in accordance with reflected intensities of light at the first and second color wavelengths when an article exhibiting a predetermined acceptable reflectivity is passed through the viewer prefatory to a sort.

8. In an apparatus for sorting a freely falling stream of irregularly shaped articles based upon the intensity of light reflected therefrom at a first and a second color wavelength, the apparatus including (a) a viewer element adapted to view a viewed area through which an article to be sorted passes;

(b) an electrical signal generator element adapted to generate a first and a second electrical signal respectively representative of the intensity of light reflected from the article at the first and the second color wavelengths, wherein the improvement comprises:

an article classifier for classifying the article to be sorted on the basis of the intensity of light reflected from the article at the first and second wavelengths, the classifier including a memory element having a plurality of memory storage locations defining a matrix array therein, each memory location being addressable by a different combination of reflected light intensities at the first and second color wavelengths, each memory location having stored therein a classification signal representative of the acceptability of an article exhibiting the reflected light intensities at the first and second color wavelengths corresponding to the address of the memory storage location to electrically define in the matrix array the boundaries of an acceptability profile of the type of article being sorted, the profile being defined in accordance with a predetermined program loaded prefatory to a sort.

9. A sorting apparatus according to claims 7 or 8 wherein the points within the profile stored in the matrix array define acceptably classified articles such that any article not within the profile, including a marginally acceptable article, generates an article-reject signal.

10. A sorting apparatus according to claims 7 or 8 wherein the points within the profile stored in the matrix array define unacceptably classified articles, such that only articles within the profile generate an article-reject signal, while acceptable and marginally acceptable articles are classified as acceptable.

11. A sorting apparatus according to claim 7 or 8, wherein the memory element is a random access memory.

12. A sorting apparatus according to claim 11, wherein the signal generator generates a multi-bit digital signal representation of the light reflected at the first and second color wavelengths, and wherein each memory storage location is defined by a predetermined number of significant bits of the signal representative of the light reflected from the article at the first color and by a predetermined number of significant bits of the signal representative of the light reflected from the article at the second color.

13. A sorting apparatus according to claim 11, wherein the signal generator generates an eight-bit digital signal representation of the light reflected at the first and second color wavelengths, and wherein each memory storage location is defined by a predetermined number of a significant bits of the signal representative of the light reflected from the article at the first color and by a predetermined number of significant bits of the signal representative of the light reflected from the article at the second color.

* * * * *

UNITED STATES PATENT AND TRADEMARK OFFICE

CERTIFICATE OF CORRECTION

PATENT NO. : 4,235,342

DATED : November 25, 1980

INVENTOR(S) : Richard R. M. Braham

It is certified that error appears in the above-identified patent and that said Letters Patent are hereby corrected as shown below:

Col. 3, Line 2 - "3,889,415" should read -- 3,899,415 --.
Col. 5, Line 51 - "time-consumming" should read -- time-consuming --.
Col. 7, Lines 15 and 16 - "first in-first out" should read -- first-in first-out --.
Col. 8, Line 41 - "is" should read -- are --.
Col. 9, Line 9 - "mesured" should read -- measured --.
Col. 12, Line 53 - "5,)" should read -- 5), --.
Col. 13, Line 16 - "of" should read -- or --.
Col. 14, Line 27 - "L" should be deleted.
Col. 14, Line 32 - After "the" -- L -- should be inserted.
Col. 15, Lines 19 and 31 - "amplifier" should read -- preamplifier --.
Col. 16, Line 31 - A hyphen should be inserted between "cle" and "reject".
Col. 17, Line 50 - "biochromatic" should read -- bichromatic --.
Col. 18, Line 33 - "signle" should read -- single --.
Col. 19, Line 8 - "James L. Lock-" should read -- James F. Lock- --.
Col. 19, Line 16 - "havine" should read -- having --.
Col. 19, Line 18 - "reflecticity" should read -- reflectivity --.
Col. 20, Line 8 - "reflectance" should read -- reflectivity --.

UNITED STATES PATENT AND TRADEMARK OFFICE

CERTIFICATE OF CORRECTION

PATENT NO. : 4,235,342

DATED : November 25, 1980

INVENTOR(S) : Richard R. M. Braham

It is certified that error appears in the above-identified patent and that said Letters Patent are hereby corrected as shown below:

Col. 21, Line 7 - "and" (first occurrence) should read -- or --.
Col. 21, Line 12 - "and" should be deleted.
Col. 21, Lines 18 and 19 - "and, accordingly," should read -- and --.
Col. 21, Line 30 - " "H" " should read -- H --.
Col. 22, Line 19 - "147A" should read -- 147B --.
Col. 22, Line 20 - "147A" should read -- 148B --.
Col. 23, Line 34 - "to the" (second occurrence) should be deleted.
Col. 23, Line 67 - "the" should read -- a --.
Col. 24, Line 38 - "generates" should read -- generate --.
Col. 24, Line 54 - "9," should read -- Programmable --.
Col. 25, Line 55 - "time" should read -- timing --.
Col. 40, Line 32 - "and" should be deleted.
Col. 42, Line 34 - "different" should read -- difference --.
Col. 43, Line 54 - "unacceptable" should be deleted.
Col. 46, Line 8 - "502" should read -- 520 --.
Col. 46, Line 27 - "138)" (first occurrence) should be deleted.
Col. 46, Line 27 - "(FIG. 138)" should read -- (FIG. 13B) --.
Col. 46, Line 45 - "ARTICLE-EJECT" should read -- ARTICLE-REJECT --.
Col. 50, Line 8 - "Q" should read -- $\overline{Q}$ --.
Col. 50, Line 67 - "ejection action" should read -- ejecting force --.

UNITED STATES PATENT AND TRADEMARK OFFICE

CERTIFICATE OF CORRECTION

PATENT NO. : 4,235,342

DATED : November 25, 1980

INVENTOR(S) : Richard R. M. Braham

It is certified that error appears in the above-identified patent and that said Letters Patent are hereby corrected as shown below:

Col. 52, Line 22 - "flip-flop" should read -- flip-flops --.
Col. 52, Line 44 - "toward" should be deleted.
Col. 54, Line 63 - "amlifier" should read -- amplifier --.
Col. 56, Line 24 - "representative" should read -- representation --.

Signed and Sealed this

Ninth Day of June 1981

[SEAL]

Attest:

RENE D. TEGTMEYER

Attesting Officer

Acting Commissioner of Patents and Trademarks